US007936887B2

(12) United States Patent
Smyth

(10) Patent No.: US 7,936,887 B2
(45) Date of Patent: May 3, 2011

(54) PERSONALIZED HEADPHONE VIRTUALIZATION

(75) Inventor: Stephen Malcolm Smyth, Newtownards (GB)

(73) Assignee: Smyth Research LLC, Camarillo, CA (US)

( * ) Notice: Subject to any disclaimer, the term of this patent is extended or adjusted under 35 U.S.C. 154(b) by 1258 days.

(21) Appl. No.: 11/217,637

(22) Filed: Aug. 31, 2005

(65) Prior Publication Data

US 2006/0045294 A1 Mar. 2, 2006

(30) Foreign Application Priority Data

Sep. 1, 2004 (GB) ..... 0419346.2

(51) Int. Cl.
*H04R 1/10* (2006.01)

(52) U.S. Cl. ..... 381/74; 381/309; 381/310

(58) Field of Classification Search ..... 381/309, 381/74

See application file for complete search history.

(56) References Cited

U.S. PATENT DOCUMENTS

| | | | | |
|---|---|---|---|---|
| 5,452,359 | A * | 9/1995 | Inanaga et al. | 381/310 |
| 5,544,249 | A * | 8/1996 | Opitz | 381/63 |
| 6,741,706 | B1 * | 5/2004 | McGrath et al. | 381/22 |
| 7,536,021 | B2 * | 5/2009 | Dickins et al. | 381/310 |

FOREIGN PATENT DOCUMENTS

| | | | |
|---|---|---|---|
| EP | 0465662 | A1 | 1/1992 |
| JP | 03-214896 | A | 9/1991 |
| JP | 07-087589 | A | 3/1995 |
| JP | 08-182100 | A | 7/1996 |
| JP | 09-284899 | A | 10/1997 |
| JP | 10-042399 | A | 2/1998 |
| JP | 2000-324590 | A | 11/2000 |
| JP | 2001-517050 | T | 10/2001 |
| JP | 2001-346298 | A | 12/2001 |
| JP | 2002-135898 | A | 5/2002 |
| WO | WO 97/25834 | A2 | 7/1997 |
| WO | WO 9725834 | * | 7/1997 |
| WO | WO 99/14983 | A1 | 3/1999 |

OTHER PUBLICATIONS

Partial PCT Search Report, International Application No. PCT/GB2005/003372, Jan. 17, 2006, 8 pages.
International Preliminary Report on Patentability, PCT/GB2005/003372, Mar. 15, 2007, 15 pages.
International Search Report and Written Opinion, PCT/GB2005/003372, Apr. 18, 2006, 19 pages.
Chinese Office Action, Chinese Application No. 200580033741.9, Jun. 5, 2009, 17 pages.
Second Chinese Office Action, Chinese Application No. 200580033741.9, Jun. 23, 2010, 14 pages.
Japanese Office Action, Japanese Application No. 2007-528994, Aug. 3, 2010, 8 pages.
European Examination Report, European Application No. 05775825.2, Dec. 14, 2010, 8 pages.

* cited by examiner

*Primary Examiner* — Xu Mei
*Assistant Examiner* — Paul Kim
(74) *Attorney, Agent, or Firm* — Fenwick & West LLP

(57) ABSTRACT

A listener can experience the sound of virtual loudspeakers over headphones with a level of realism that is difficult to distinguish from the real loudspeaker experience. Sets of personalized room impulse responses (PRIRs) are acquired for the loudspeaker sound sources over a limited number of listener head positions. The PRIRs are then used to transform an audio signal for the loudspeakers into a virtualized output for the headphones. Basing the transformation on the listener's head position, the system can adjust the transformation so that the virtual loudspeakers appear not to move as the listener moves the head.

28 Claims, 41 Drawing Sheets

PERSONALIZED HEADPHONE VIRTUALIZATION

CROSS REFERENCE TO RELATED APPLICATIONS

This application claims the right of priority based on United Kingdom application serial no. 0419346.2, filed Sep. 1, 2004, which is incorporated by reference in its entirety.

BACKGROUND

This invention relates generally to the field of three-dimensional audio reproduction over headphones or earphones. Specifically it relates to the personalized virtualization of audio sources, such as loudspeakers used in home entertainment systems, using headphones or earphones and developing a level of realism that is difficult to distinguish from the real loudspeaker experience.

The idea of using headphones to generate virtual loudspeakers is a general concept well understood by those in the art, as described in U.S. Pat. No. 3,920,904. In summary; a loudspeaker can be effectively virtualized over headphones or earphones for any individual primarily by acquiring a personalized room impulse response (PRIR) for the loudspeaker in question measured using microphones placed in the vicinity of that individual's left and right ear. The resulting impulse response contains information relating to the sound reproduction equipment, the loudspeaker, the room acoustics, (reverberation) and the directional properties of the subjects shoulders, head and ears, often referred to as the head related transfer function (HRTF) and typically covers a time span of hundreds of milliseconds. To generate a virtual acoustical image of loudspeaker, the audio signal that would ordinarily be played through the real loudspeaker is instead convolved with the measured left-ear and right-ear PRIR and fed to stereo headphones worn by the individual. If the individual is positioned exactly as they where during the personalization measurement then, assuming the headphones are appropriately equalized, that individual will perceive the sound to be coming from the real loudspeaker and not the headphones. The process of projecting virtual loudspeakers over headphones is herein referred to as virtualization.

The positions of the virtual loudspeakers projected by headphones match the head-to-loudspeaker relationships established during the personalized room impulse response (PRIR) measurements. For example, if a real loudspeaker measured during the personalization stage is in front of and to the left of the individuals head, then the corresponding virtual loudspeaker will also appear to come from the left front. This means that if the individual orientates their head such that, from their view point, the real and virtual loudspeakers coincide, the virtual sound will appear to emanate from the real loudspeaker and, provided the personalized measurements are accurate, that individual will have considerable difficulty distinguishing between virtual and real sound sources. The implication of this is that had a listener made PRIR measurements for each loudspeaker in their home entertainment system, they would be able to recreate the entire multi-channel loudspeaker listening experience simultaneously over headphones without actually having to turn on the loudspeakers.

However, the illusion of simple personalized virtual sound sources is difficult to maintain in the presence of head movements, particularity those on lateral plane. For example, when the individual has the virtual and real loudspeakers aligned, the virtual illusion is strong. However if that individual now turns their head to the left, since the virtual sound source is fixed relative to the individuals head, the perceived virtual sound source will also move with the head to the left. Naturally head movements do not cause real loudspeakers to move, and so to maintain a strong virtual illusion it may be necessary to manipulate the audio signals feeding the headphones such that the virtual loudspeakers also remain fixed.

Binaural processing also has applications for virtualizing loudspeakers using loudspeakers, rather than headphones, as described in U.S. Pat. Nos. 5,105,462 and 5,173,944. These also can make use of head tracking to improve the virtual illusion, as described in U.S. Pat. No. 6,243,476.

U.S. Pat. No. 3,962,543 is one of the earliest publications that describe the concept of manipulating the binaural signals fed to the headphones in response to a head tracking signal in order to stabilize the perceived position of the virtual loudspeaker. However their disclosure pre-dates recent advances in digital signal processing theory and their methods and apparatus are generally not applicable to digital signal processing (DSP) type implementations.

A more recent DSP-based head tracked virtualizer is disclosed by U.S. Pat. Nos. 5,687,239 and 5,717,767. This system is based on a split HRTF/room reverberation representation, typical of low complexity virtualizer systems, and uses a memory look-up to read out HRTF impulse files, in response to a look-up address derived from the head-tracking device. The room reverberation is not altered in response to head tracking. The main idea behind this system is that since the HRTF impulse data files are relatively small, typically between 64 and 256 data points, a large number of HRTF impulse responses, specific to each ear and each loudspeaker and for a wide range of head turn angles, can be stored within the normal memory storage capabilities of typical DSP platforms.

The room reverberation is not modified for two reasons. First, to have stored a unique reverberation impulse response for each head turn angle would have required enormous storage capacity—each individual reverberation impulse response being typically 10000 to 24000 data points in length. Second, the computational complexity of convolving room reverberation impulses of this size would be impractical, even with signal processors available today, and since the inventors do not discuss an efficient implementation for the convolution of long impulses, it is likely that they anticipated an artificial reverberation implementation in order to reduce the computational complexity associated with room convolutions. Such implementations, by definition, would not easily lend themselves to adaptation by the head tracker address. Since personalization is not discussed and was clearly not anticipated for this system, the inventors offer no information regarding what steps would be required to incorporate such a mode of operation either for the HRTF or reverberation processes. Moreover, since this system would require many hundreds of HRTF impulse files to be stored in order to allow for sufficiently smooth HRTF switching under control of the head tracker, it would not be obvious to one skilled in the art how all of these measurements could be made in a practical way such that members of the general public could be expected to undertake them in their own home. Neither is it obvious how a single room reverberation characteristic would be determined from all the personalized measurements. Further, since the room reverberation is not adapted by the head tracker address, it is clear that this system would never be able to replicate the sound of real loudspeakers in a real room and therefore its applicability to realistic virtualization is clearly limited.

Head tracking is well known as a technique for detecting head movement. Many approaches have been suggested and are well known in the art. Head trackers can either be head mounted, i.e., gyroscopic, magnetic, GPS-based, optical, or they can be off head, i.e., video, or proximity. The aim of a head tracker is to measure, on a continuous basis, the orientation of the individual's head while listening to the headphones and to transmit this information to the virtualizer to allow the virtualization process to be modified in real time as changes are detected. The head track data can be sent back to the virtualizer using wires, or it can be delivered wirelessly using optical, or RF transmission techniques.

Existing headphone virtualizer systems do not project a virtual acoustical image with a high enough degree of realism to stand up to a direct comparison against the real loudspeaker experience. This is because the current state of the art has made no attempt to directly incorporate a personalization method into a headphone virtualizer suitable for use by the general public due to the difficulties associated with the measurements and uncertainties about how to incorporate head tracking into such a scheme.

SUMMARY OF THE INVENTION

In view of the above problems, embodiments of the invention provide a method and apparatus that allows an individual to experience, within a limited range of head movements, the sound of virtual loudspeakers over headphones with a level of realism that is difficult to distinguish from the real loudspeaker experience.

According to one aspect of the invention there is provided a method and apparatus for acquiring personalized room impulse responses (PRIRs) of loudspeaker sound sources over a limited number of listener head positions; where the user takes up a normal listening position for home entertainment loudspeaker system; where the user inserts microphones in each ear; where the user establishes the scope of listener head movements by acquiring their personalized room impulse responses (PRIR) for each loudspeaker over a limited number of head positions; a means for determining all personalized measurement head positions; a means for measuring personalized headphone-microphone impulse responses for both ears; a means for storing the PRIR data, the headphone-microphone impulse response data and the PRIR head positions.

According to another aspect of the invention there is provided a method for initializing a head tracked virtualizer using the PRIR data, the headphone-microphone impulse response data and the PRIR head position data; a means for time aligning the PRIRs; a means of generating headphone equalization impulse responses for left and right ears; a means for generating all necessary interpolation-head angle formula, or look-up tables, for the PRIR interpolators; a means for generating all necessary path length-head angle formula, or look-up tables, for the variable delay buffers.

According to a further aspect of the invention there is provided a method and apparatus for implementing a real time personalized head tracked virtualizer; a means for sampling head tracker coordinates and generating appropriate PRIR interpolator coefficient values; a means for deploying head tracker coordinates to generate appropriate inter-aural delay values for all virtual loudspeakers; a means for generating interpolated time aligned PRIRs for all virtual loudspeakers using interpolation coefficients; a means for reading blocks of audio samples for each loudspeaker channel and convolving them with their respective left and right-ear interpolated time aligned PRIRs; a means for effecting inter-aural delays for each virtual loudspeaker by passing their respective left-ear and right-ear samples through variable delay buffers whose delays match the generated delay values; a means for summing all left-ear samples; a means for summing all right-ear samples; a means for filtering left and right-ear samples through headphone equalization filters; a means for writing left and right-ear audio samples in real time to the headphone DAC.

According to a further aspect of the invention there is provided a method for adjusting the virtual loudspeaker positions in order to make them coincide with the positions of the real loudspeakers by introducing offsets into the PRIR interpolation and path length calculations conducted in the virtualizer.

According to a further aspect of the invention there is provided a method for adjusting the perceived distance of the virtual loudspeakers by modifying the PRIR data.

According to a further aspect of the invention there are provided methods for modifying the behavior of the virtualizer for listener head orientations that fall outside the measured scope.

According to a further aspect of the invention there is provided a method that permits the mixing of personalized and generic room impulse responses within the virtualizer.

According to a further aspect of the invention there is provided a method for automatically adjusting the levels of the excitation signal in order to maximize the signal quality during the PRIR measurements.

According to a further aspect of the invention there are provided methods for permitting personalization measurements to be made using multi-channel encoded excitation bit streams.

According to a further aspect of the invention there are provided methods and apparatus for detecting user head movements during the personalization measurement process and for improving the accuracy of the impulse response measurement.

According to a further aspect of the invention there is provided a method for equalizing the loudspeakers that comprise the user's entertainment system such that the sound quality of the virtualized loudspeakers can be improved over that of the real loudspeakers used in the PRIR measurements.

According to a further aspect of the invention there is provided a method for implementing the virtualization convolution processing using a sub-band filter bank and combining this with sub-band PRIR interpolation and either sub-band inter-aural variable delay processing or time domain inter-aural variable delay processing; and means for optimizing the convolution computational load by adjusting the sub-band PRIR impulse lengths; and means for optimizing the convolution computational load by exploiting sub-band signal masking thresholds; and means for compensating for sub-band convolution ripple; and means for trading sub-band convolution complexity for virtualization accuracy by combining the late reflection portions of loudspeaker PRIR such that only a smaller number of convolutions need be executed.

According to a further aspect of the invention there are provided methods for generating pre-virtualized signals such that the computational load of the playback is substantially reduced compared to regular real-time virtualization; and means for encoding the pre-virtualized signals in order to reduce their bit rate and/or storage requirements; and means for generating pre-virtualized audio in remote servers using PRIR data uploaded by the user and for user to download pre-virtualized audio for playback on users own hardware.

According to a further aspect of the invention there is provided a method for conducting networked personalized virtual teleconferencing using a remote virtualization server that uses PRIR data uploaded by each participant to affect the virtualization process under control of each participants head tracker.

These and other features and advantages of the invention will be apparent to those skilled in the art from the following detailed description of preferred embodiments, taken together with the accompanying drawings, in which:

DETAILED DESCRIPTION OF THE PREFERRED EMBODIMENTS

Personalized Head Tracked Virtualization Using Headphones

Figure 1:
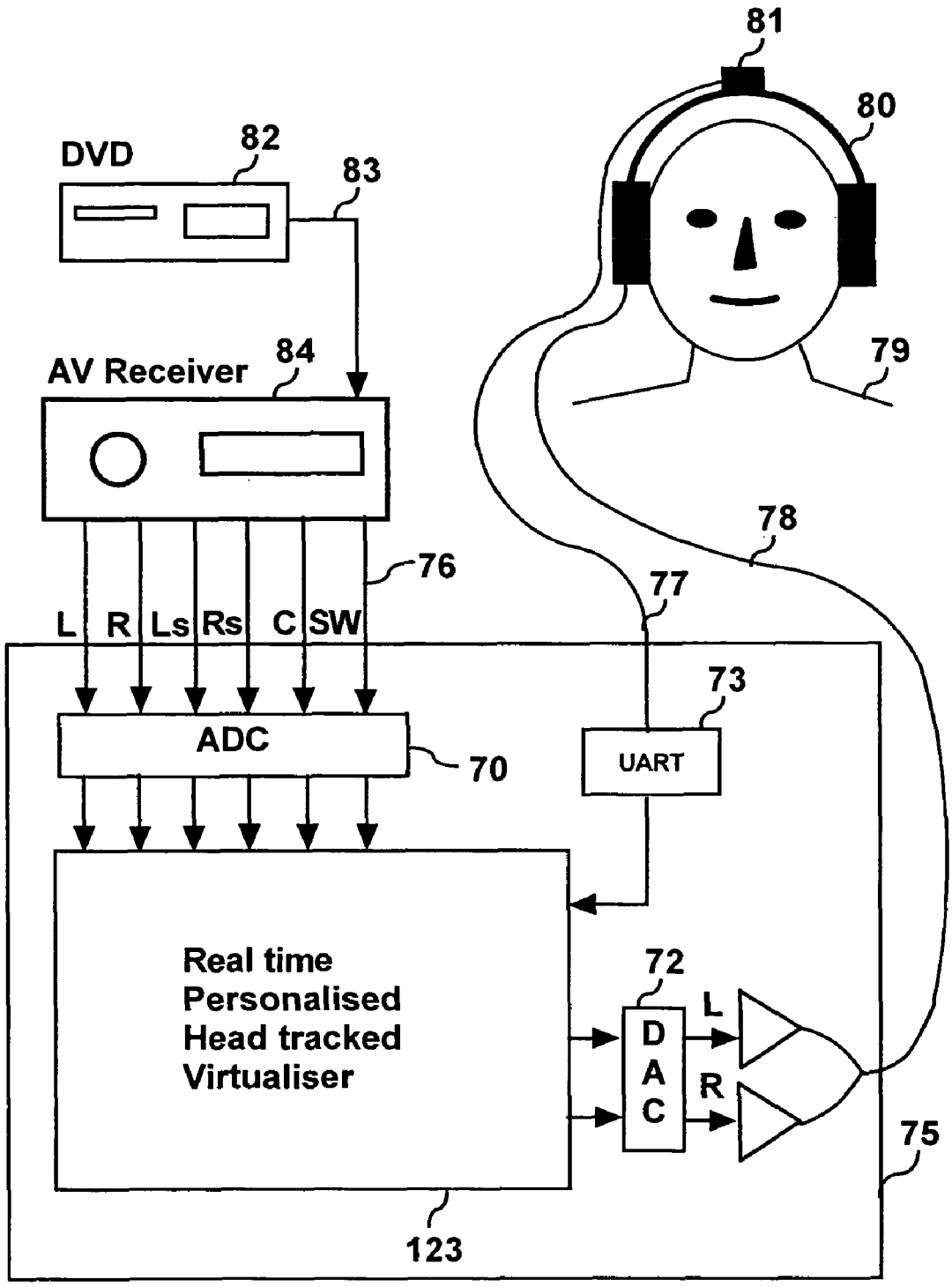
FIG. 1 is a block diagram of a 5.1 ch head tracked virtualizer connected to a multi-channel AV receiver.

A typical application of the personalized head tracked virtualizer method disclosed herein is illustrated in FIG. 1. In this illustration a listener is watching a movie but rather than listening to the movie sound track over their loudspeakers they instead listen to a virtual version of the loudspeaker sounds through the headphones. A DVD player 82 outputs in real-time an encoded (for example Dolby Digital, DTS, MEPG) multi-channel movie sound track via an S/PDIF serial interface 83 while playing a movie disc. The bit-stream is decoded by an Audio/Video (AV) Receiver 84 and the individual analogue audio tracks (Left, Right, Left Surround, Right Surround, Center and Sub-Woofer loudspeaker channels) are output via the pre-amplifier outputs 76 and input to the headphone virtualizer 75. The analogue input channels are digitized 70 and the digital audio is fed to the real-time personalized head tracked virtualizer core processor 123.

This process filters, or convolves, each loudspeaker signal with a set of left-ear and right-ear personalized room impulse responses (PRIR) that represent the transfer functions between the desired virtual loudspeaker and the listener's ears. The left-ear filtered signals and the right-ear filtered signals from all the input signals are summed to produce a single stereo (left-ear and right-ear) output that is converted back to analogue 72 and prior to driving the headphones 80. Since each input signal 76 is filtered with its own particular PRIR set, each is perceived to come from one of the original loudspeaker locations by the listener 79 when heard over the headphones 80. The virtualizer processor 123 is also able to compensate for listener head movement.

The listener's 79 head angles are monitored by a headphone-mounted head-tracker 81 that periodically transmits 77 the angles down to the virtualizer processor 123 via a simple asynchronous serial interface 73. The head angle information is used both to interpolate between a sparse set of PRIRs that cover typical listener's head movement range, and to alter the inter-aural delays that would have existed between the listener's ears and the various loudspeakers being virtualized. The combination of these processes is to de-rotate the virtualized sounds to counteract the head movement such that, to the listener, they appear to remain stationary.

FIG. 1 illustrates the real-time playback mode of a head tracked virtualizer. In order for the listener to hear a convincing illusion of the loudspeaker sounds over the headphones a number of personalization measurements are made first. The primary measurement involves acquiring personalized room impulse responses, or PRIR, for each loudspeaker the user wishes to virtualize over the headphones and over a range of head movements the listener is likely to make while ordinarily using the headphones. A PRIR essentially describes the transfer function of the acoustical path between the loudspeaker and the listener's ear canal. For any one speaker it may be necessary to measure this transfer function for each ear; hence, the PRIRs exist as left-ear and right-ear sets.

The test involves the listener taking up their normal listening position within their loudspeaker set up, placing miniature microphones in each of their ears and then sending an excitation signal to the loudspeaker under test for a certain period of time. This is repeated for each loudspeaker and for each head orientation the user wishes to capture. If an audio signal is filtered, or convolved, with the resulting left and right-ear PRIRs and the filtered signals are used to drive the left-ear and right-ear headphone transducers respectively, then the listener will perceive that signal to come from the same location as the loudspeaker used to measure the PRIRs in the first place. In order to improve the realism of the virtualization process it may be necessary to compensate for the fact that the headphones themselves will impose an additional transfer function between their transducers and the listener's ear canals. Hence a secondary measurement is taken whereby this transfer function is also measured and used to create an inverse filter. The inverse filter is then used either to modify the PRIRs or filter, in real-time, the headphone signals, to equalize for this unwanted response.

Figure 2:
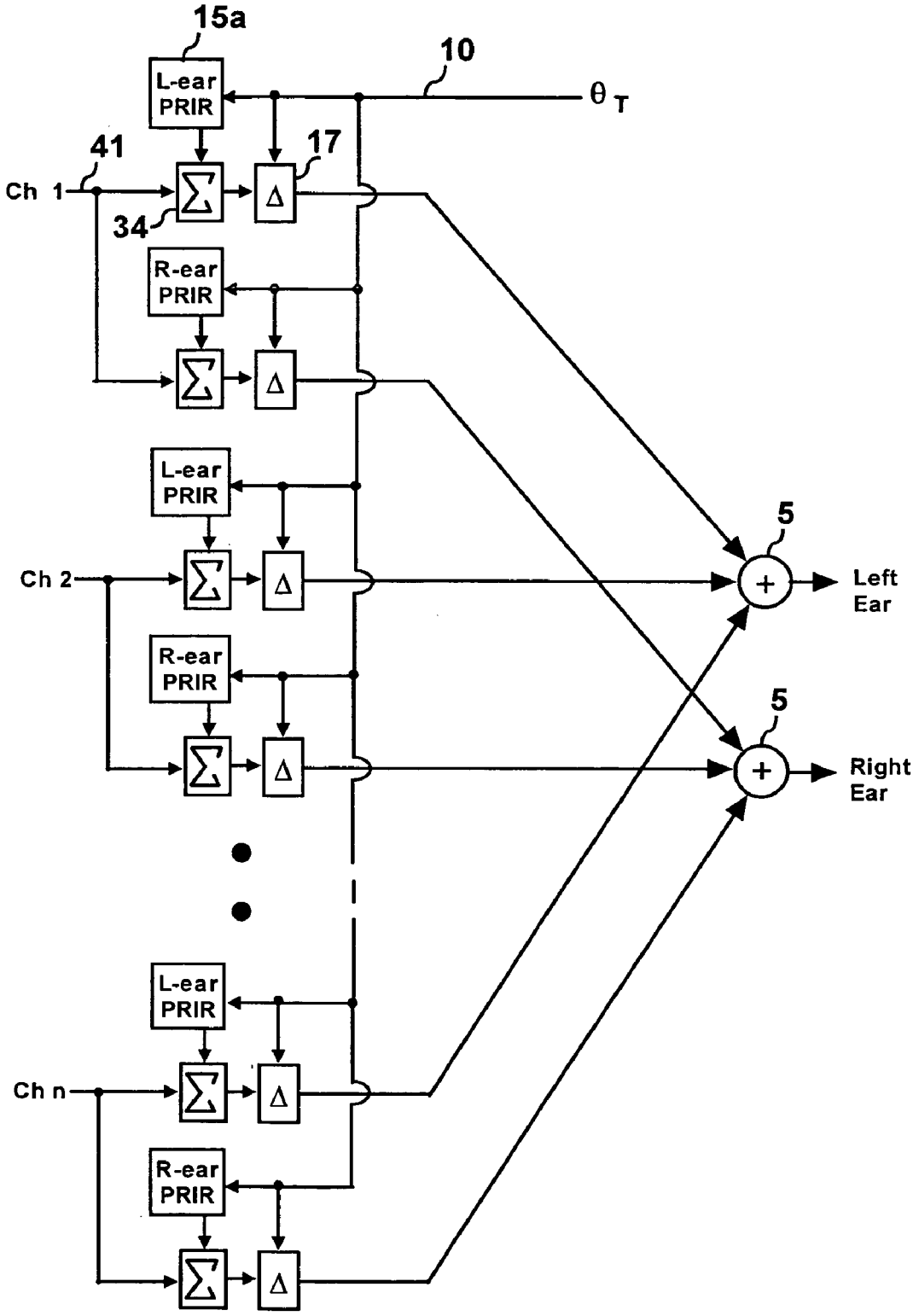
FIG. 2 illustrates the basic structure of an n-channel head tracked virtualizer under control of a head tracker input.

The head tracked PRIR filtering, or convolution, processing 123 indicated in FIG. 1 is illustrated in greater detail in FIG. 2. A digitized audio signal 41 is input to Ch 1 and applied to two convolvers 34. One convolver filters the input signal with the left-ear interpolated PRIR 15*a* and the other convolver filters the same signal with the right-ear interpolated PRIR. The output of each convolver is applied to a variable path length buffer 17 that creates an inter-aural differential delay between the left-ear and right-ear filtered signals. Both the PRIR interpolation 15*a* and the variable delay buffer 17 are adjusted according to the head orientation 10 fed back from the head tracker 81 in order to affect the virtual soundstage de-rotation. The processes described for Ch1 41 are separately implemented for all other input signals. However, all the left-ear signals, and all the right-ear signals are summed 5 separately prior to their output to the headphones.

Personalized Room Impulse Response (PRIR) Acquisition

One feature of an embodiment of the invention is the facility to acquire personalized room impulse responses (herein referred to as PRIR) data measured in the vicinity of the users left and right ears in a convenient manner. After acquisition, the PRIR data is processed and stored for use by the virtualizer convolution engine to create the illusion of real loudspeakers. If desired, this data can also be written to portable storage media, or transmitted off board, for use by a remote compatible virtualizer, not associated with the acquisition equipment.

The basic techniques for acquiring personalized room impulse responses are not new and are well documented and will be known to those skilled in the art. In summary, to acquire the impulse response, an excitation signal, for example an impulse, spark, balloon implosion, pseudo noise sequence etc, is reproduced at the desired location in space relative to the subjects head, using a suitable transducer where required, and the resulting sound waves are recorded using a microphone located either close to the subjects ears, or preferably at the entrance to the subjects ear canals, or anywhere inside the subjects ear canals.

Figure 20:
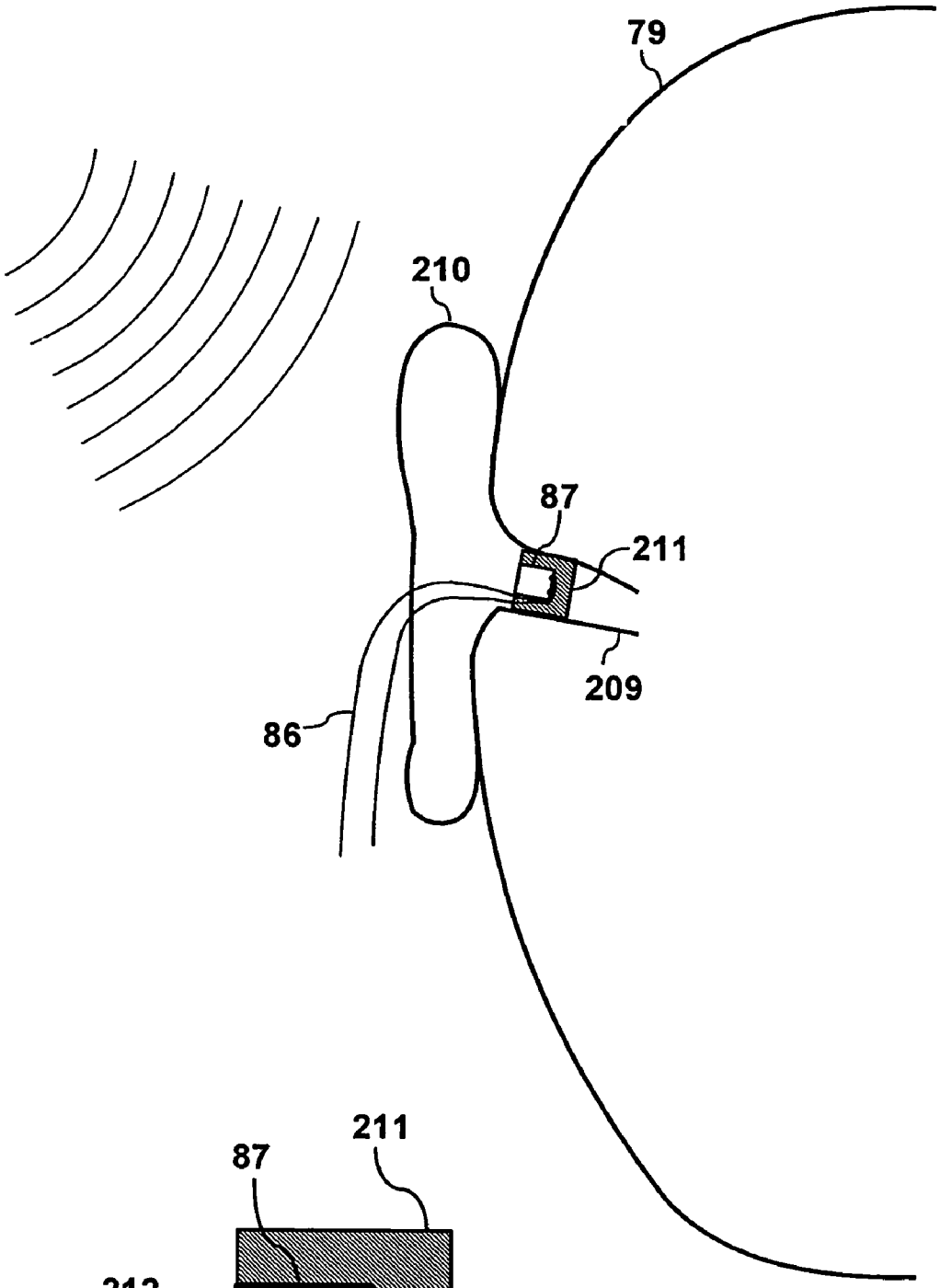
FIG. 20 is a sketch of a miniature microphone mounted in a human subject's ear canal.
Figure 21:
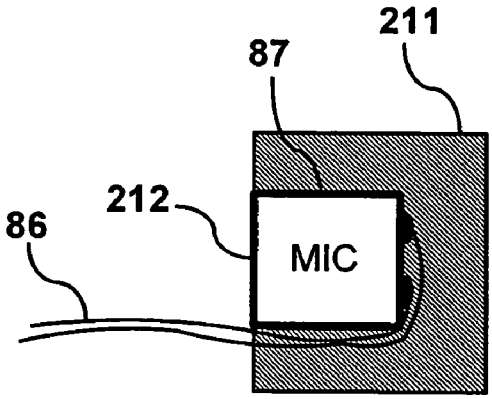
FIG. 21 is a sketch of the construction of the miniature microphone plug.

FIG. 20 illustrates the placement of a miniature omnidirectional electret microphone capsule 87 (6 mm diameter) in a single ear canal 209 of human subject 79. The outline of the subject's outer ear (pinna) is also shown 210. FIG. 21 better illustrates the construction of the microphone plug that is fitted into the ear canal. The microphone capsule is embedded into a deformable foam ear plug 211, whose normal use is for noise attenuation, with the open end of the microphone 212 facing out. The capsule can be glued into the foam plug, or it can be friction fitted by expanding the foam using a sleeve fitter and allowing the foam to close over it. Depending on the height of the microphone capsule itself, the foam plug 211 would typically be trimmed to a length of around 10 mm long.

Plugs are typically manufactured with uncompressed diameters in the range 10-14 mm to accommodate difference sizes of ear canal. The signal/power and ground wires 86 soldered to the back run along the outside of the capsule wall, exiting from the front also on their way to the microphone amplifiers. The wires can be fixed to the side of the capsule if desired to reduce possibility of damage to the solder joints. To insert the microphone into the ear the user simply rolls the foam plug with the capsule inside between their fingers and having compressed the diameter of the plug, quickly inserts it into the ear using the index finger. The foam will immediately begin to slowly expand out, providing a comfortable, but tight fit in the ear canal 5 to 10 seconds later. The microphone plug is therefore able to stay in place without additional aids. Ideally when the plug is fitted, the open end of the microphone will sit flush with the entrance of the ear canal. The wires 86 should protrude as shown in FIG. 20, and pulling on these allows the user to conveniently remove the microphone plug once the tests are complete. The foam provides an additional benefit in that it seals the ears and reduces the level of exposure to excitation noise during the personalization tests.

Once the left-ear and right-ear microphones have been installed the personalization measurements can begin. Depending on the reverberation characteristics of the environment surrounding the measurement space, the resulting impulse waveforms will typically decay to zero within a few seconds and the recordings need not extend beyond this time. The quality of the acquired impulse responses will depend to a certain extent on the background noise level of the environment, the quality of the transducer and recording signal chain, and on the degree of head movement experienced during the measurement process. Unfortunately, a loss of impulse response signal fidelity will impact directly the quality, or realism, of any sounds virtualized through convolution with this impulse response and so it is desirable to maximize the quality of the measurement.

To address this problem, an embodiment uses, as the basis of the acquisition method, a pseudo noise sequence as the excitation signal for the personalized room impulse response measurement, known as MLS, or Maximum Length Sequence. Once again, the MLS technique is well documented, for example in Berish J., "Self-contained cross-correlation program for maximum-length sequences," J. Audio Eng. Soc., vol. 33, no. 11, November 1985. The MLS measurement has certain advantages over impulse or spark type excitation methods in that the pseudo noise sequences provide for higher impulse signal-to-noise ratios. In addition, the process permits one to easily conduct sequential measurements in an automated way, such that the background noise of the measurement environment and equipment inherent in the measured impulse response can be further suppressed through the process of averaging.

In the MLS method, a pre-calculated binary sampled sequence, whose duration is at least twice that of the expected reverberation time of the test environment, is output to a digital to analogue converter at some desired sampling rate and fed to the loudspeaker in real time as an excitation signal. Hereafter this loudspeaker is referred to as the excitation loudspeaker. The same sequence can be repeated as often as may be necessary to achieve the desired level of background noise suppression. The microphone picks up the resulting sound waves in real time, and simultaneously the signal is sampled and digitized, using the same sample time base as the excitation playback, and stored to memory. Once the desired number of sequence repetitions have been played the recording is stopped. The recorded sample file is then circularly cross-correlated against the original binary sequence to produce an averaged personalized room impulse response unique to the excitation loudspeakers position relative to the acoustical environment surrounding it and to the human subjects head on which the microphones are mounted.

In theory it is possible to measure the impulse response at each ear separately, i.e., using only one microphone and repeating the measurement for each ear, but it is both convenient and advantageous to place a microphone in each ear and to make simultaneous dual channel recordings in the presence of the excitation signal. In this case each sampled audio file recorded at each ear is processed separately giving two unique impulse responses. These files are referred to herein as the left-ear PRIR and the right-ear PRIR.

Figure 3:
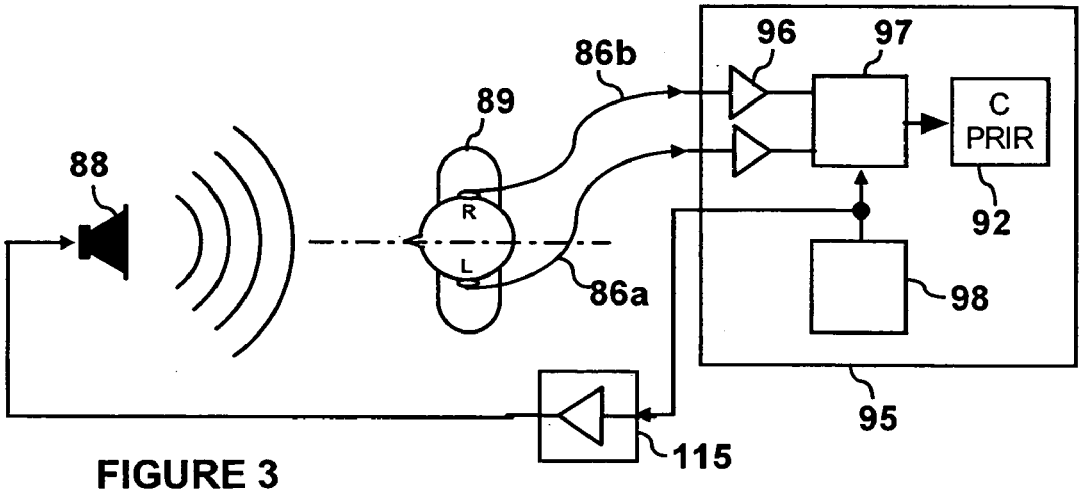
FIG. 3 illustrates a plan view of a human subject undergoing a PRIR measurement looking towards the excitation loudspeaker.

FIG. 3 is a simplified illustration of the method of acquiring a personalized room impulse response used within the preferred embodiments. All analogue and digital conversion, as well as timing circuits, have been excluded for clarity. The loudspeaker 88 is first located to the desired position within the room or acoustical environment with respect to a plan view of the human subject 89. In this illustration the loudspeaker is positioned straight ahead of the subject. The human subject has mounted, one in the vicinity of each ear canal, two microphones whose outputs 86*a* and 86*b* are connected to two microphone amplifiers 96. Before the beginning of the test, the human subject positions their head to the desired orientation relative to the excitation loudspeaker and maintains this orientation, as best they can, for the duration of the measurement. In the case of FIG. 3 the human subject 89 is looking straight at the loudspeaker 88. The use of the term 'looks', 'looking', 'views' or 'viewing' herein means to orientate the head such that an imaginary line perpendicular to the subjects face would pass through the point that they are looking at.

In one embodiment, the measurement is conducted as follows. An MLS is output from 98 in a repetitive fashion and is input both to a loudspeaker amplifier 115 and circular cross correlation processor 97. The loudspeaker amplifier drives the loudspeaker 88 at the desired level, thereby causing a sound wave to travel outwards and towards the left and right ear microphones mounted on the human subject 89. The left and right microphone signals, 86*a* and 86*b* respectively, are input to microphone amplifiers 96. The amplified signals are sampled and digitized and input to the circular cross-correlation processing unit 97. Here they can be stored for processing off-line, after all sequences have been played, or they can be processed in real-time as each complete MLS block arrives, depending on the available digital signal processing power. Either way, the recorded digital signals are cross-correlated against the original MLS input from 98 and on completion the resulting averaged personalized room impulse response file is stored in memory 92 for later use.

Figure 7:
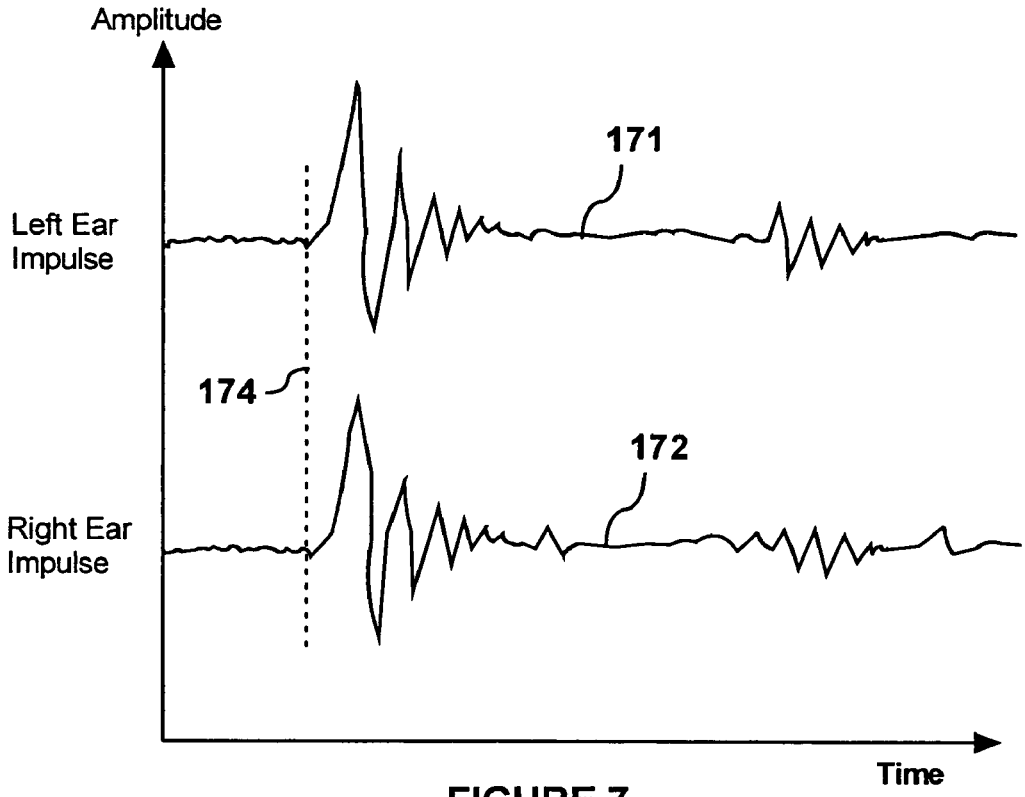
FIG. 7 is an example of a plot of amplitude against time of an impulse response measured at the left ear and an impulse measured at the right ear, with the human subject looking at the excitation loudspeaker.

FIG. 7 illustrates the early portion of a typical impulse response plotted as amplitude against time, for the left-ear microphone 171 and the right-ear microphone 172 as might be acquired with the head oriented looking straight at the excitation speaker as indicated in FIG. 3. As indicated in FIG. 7, with the head pointed towards the excitation source, the direct path lengths from the loudspeaker to the left-ear and right-ear microphones, respectively, will be almost equal, resulting in almost coincident impulse onset times 174.

Figure 4:
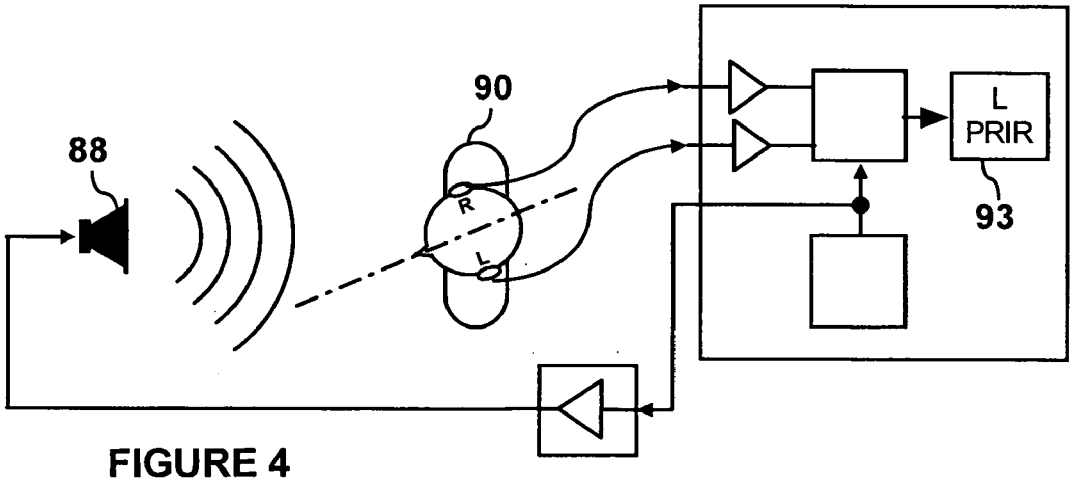
FIG. 4 illustrates a plan view of a human subject undergoing a PRIR measurement looking to the left of the excitation loudspeaker.
Figure 8:
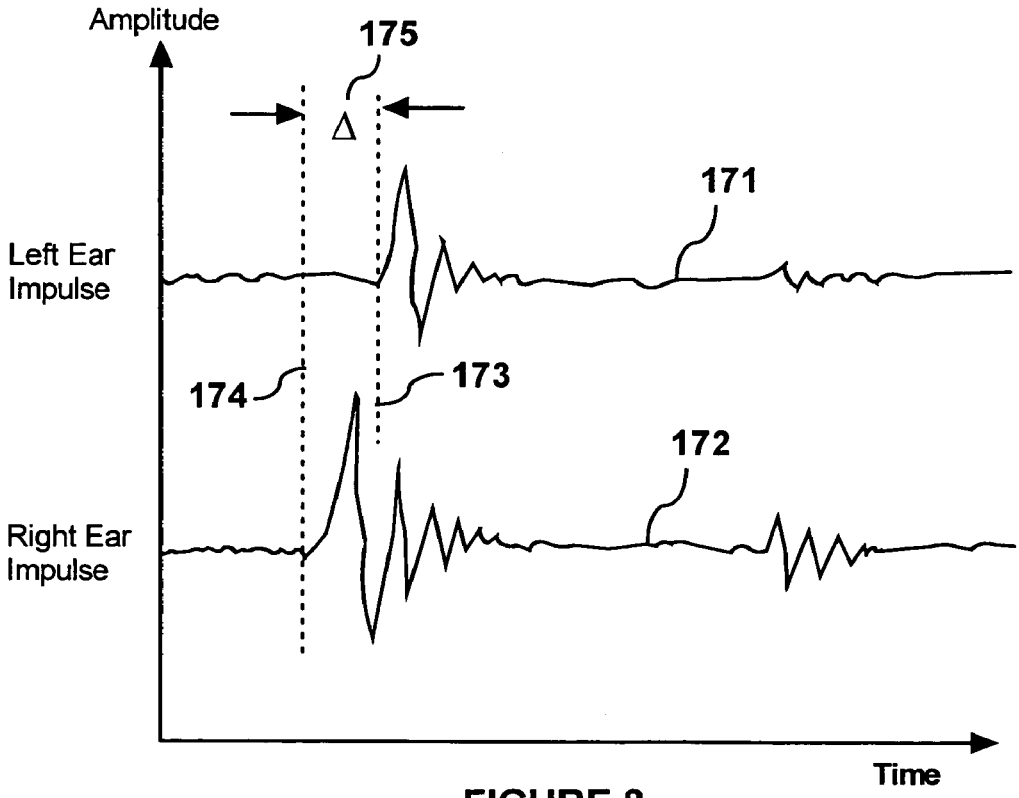
FIG. 8 is an example of a plot of amplitude against time of an impulse response measured at the left ear and an impulse measured at the right ear, with the human subject looking to the left of the excitation loudspeaker.

FIG. 4 is similar to FIG. 3 except that this illustrates an example of acquiring a personalized room impulse response with the human subject 90 looking at a point to the left of the excitation loudspeaker. Again, once the head orientation has been decided, this should not be changed during the measurement. FIG. 8 illustrates the early portion of a typical impulse response plotted as amplitude against time, for the left-ear microphone 171 and the right-ear microphone 172 as might be acquired with the head oriented looking to the left of the excitation loudspeaker as indicated in FIG. 4. As indicated in FIG. 8, with the head pointed to the left of the excitation source, the direct path length from the loudspeaker to the left-ear microphone will now be greater than that between the loudspeaker and the right-ear microphone, causing the left-ear impulse onset 173 to be delayed 175 compared to the right-ear impulse onset 174.

Figure 5:
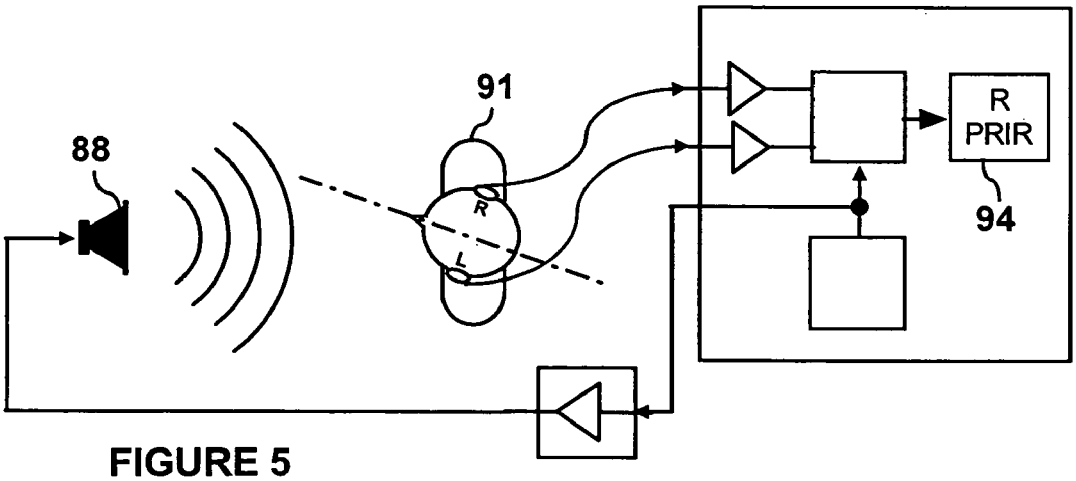
FIG. 5 illustrates a plan view of a human subject undergoing a PRIR measurement looking to the right of the excitation loudspeaker.
Figure 6:
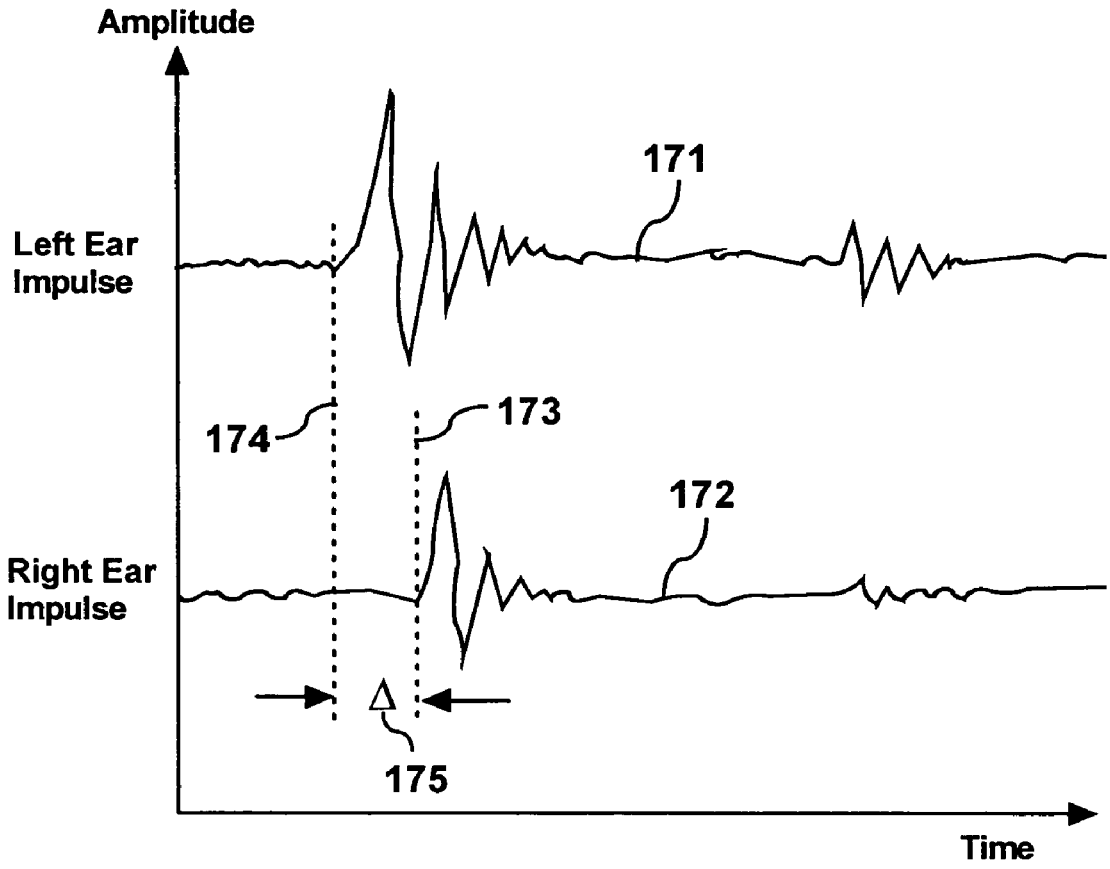
FIG. 6 is an example of a plot of amplitude against time of an impulse response measured at the left ear and an impulse measured at the right ear, with the human subject looking to the right of the excitation loudspeaker.

FIG. 5 is similar again except that this illustrates an example of acquiring a personalized room response impulse with the human subject 91 looking at a point to the right of the excitation loudspeaker. FIG. 6 illustrates the early portion of a typical impulse response plotted as amplitude against time, for the left-ear microphone 171 and the right-ear microphone 172 as might be acquired with the head oriented looking to the right of the excitation loudspeaker as indicated in FIG. 5. As indicated in FIG. 6, with the head pointed to the right of the excitation source, the direct path length from the loudspeaker to the right-ear microphone will now be greater than that between the loudspeaker and the left-ear microphone, causing the right-ear impulse onset 173 to be delayed 175 compared to the left-ear impulse onset 174.

If the three measurements illustrated in FIGS. 3,4 and 5 are completed successfully, that is, the human subject maintains their head orientation with a sufficient degree of accuracy during each acquisition phase, then three pairs of personalized room impulse responses would now be found in storage areas 92 (FIG. 3), 93 (FIG. 4) and 94 (FIG. 5), each pair corresponding to the left and right-ear PRIRs for the human subject in question, looking directly at, looking to the left off, and looking to the right off, loudspeaker 88.

Establishing the Scope of Listener Head Movement

Disclosed herein is a method of acquiring PRIR data, for use in a personalized head tracking apparatus, that is designed to be undertaken using a persons own loudspeaker sound system and within their normal listening room environment. The acquisition method assumes that the human subject desiring to undertake the personalization tests is first positioned in the ideal listening position, i.e., the position that they would normally take up if they were using their loudspeakers to listen to music or watch a movie. For example, with typical multi-channel home entertainment systems, as illustrated in the plan view of FIG. 34*a*, the loudspeakers are arranged as left front 200, center front 196, right front 197, left surround 199 and right surround 198.

Figure 34A:
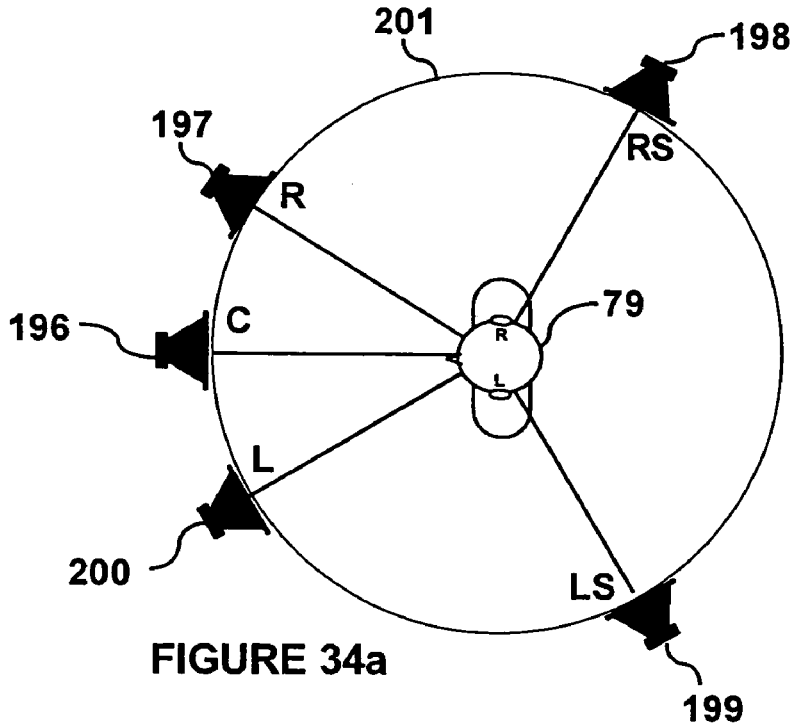
FIGS. 34*a* and 34*b* illustrate a plan view of a 5-channel surround loudspeaker system and a technique that allows the PRIR interpolation to continue outside the intended head orientation scope.

Often a center surround speaker and bass subwoofer also form part of many home entertainment systems. In FIG. 34*a* the human subject 79, is positioned equidistant from all loudspeakers. As is typical in home movie systems, the front center speaker is located either above or below or behind the television/monitor/projection screen used to display the motion picture associated with the sound. The human subject then proceeds to acquire personalized measurements for each loudspeaker over a limited number of head orientations covering a listening area in and around the frontal viewing area. The measurement points can be on the same lateral plane (yaw) or they can include an elevation component (pitch), or they can account for the three degrees of head movement—yaw, pitch and roll.

The method aims to capture a sparse set of measurements for each loudspeaker around a periphery that defines the maximum likely range of head movements experienced by the user while listening to music, or watching movies. For example, when watching movies, it would be normal for listeners to maintain a head orientation that allows them to view the television or projector screen while listening to the movie soundtrack. Measurements could therefore be made for all loudspeakers for head positions looking off to the left of the screen, looking off to the right of the screen and, if desired, looking at some points above and below the screen, in the knowledge that, for the vast majority of time, this zone would cover all the listeners head orientations during the process of watching a movie. Introducing a range of head roll angles into the PRIR process would also be possible if this type of motion was expected during playback.

If the head tracking virtualizer has access to room impulse response data measured for head orientations that bound the expected user head movement range, then it is able to calculate, through interpolation, an approximate impulse response for any head orientation within that range, as indicated by a head tracker. Herein the range of head movements that the interpolator has sufficient PRIR data for which to de-rotate the virtualized loudspeakers in this way is referred to as the 'scope' of the measurements or the 'scope' of the listener's head movements. The performance of the virtualizer can be further enhanced by taking an additional personalized measurement with the head looking towards the mid point of the head tracked zone. Typically this is simply the straight-ahead position as would be the natural head orientation while watching a movie on a TV or movie screen. Further improvements may be had if measurements are taken for different head roll angles, particularly while viewing the front screen, effectively adding a third dimension into the interpolation equation. The benefits of the sparse sampling method are many, including:

1) The number of PRIR measurements to be acquired by the human subject can be relatively low, without sacrificing performance, since head orientations outside the listener scope are not part of the measurement procedure.
2) Any number of loudspeakers can be accommodated in the measurement process.
3) The spatial positioning of the loudspeakers with respect to the human subject can be arbitrary, and do not need to measured, since a complete set of head related PRIR data is measured for each separate loudspeaker and subsequently deployed by the interpolator to virtualize those loudspeakers.
4) Only the relatively few head positions used while acquiring each PRIR data set need to be accurately measured with respect to the reference head orientation.
5) The spatial positioning and reverberation characteristics of the virtual loudspeakers match exactly those of the real loudspeakers for head positions within the listener scope, provided the measurement and the subsequent listening is conducted using the same sound system.

6) The method makes no assumptions about the characteristics of the loudspeaker presentation format. Sound tracks, for example, may be carried by more than one loudspeaker, as is common for diffuse surround effects channels in larger home entertainment configurations. In this case, since all associated loudspeakers will be driven by the same excitation signal, the personalization measurements will automatically carry all the information necessary to virtualize such groups of loudspeakers, within the listener scope.

Figure 31:
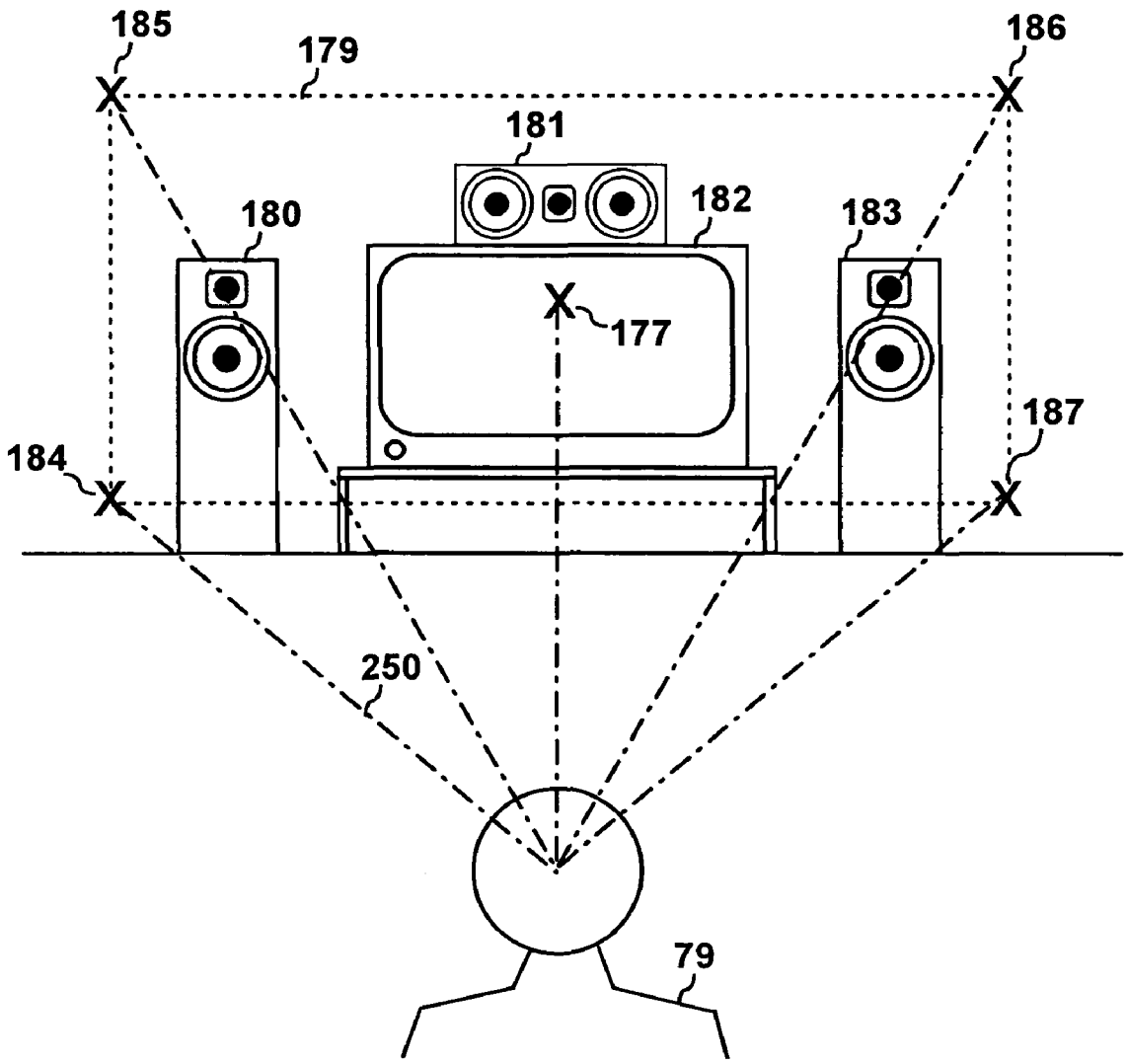
FIG. 31 is similar to FIG. 29 except that five viewing positions mark out the PRIR measurement scope.

FIG. 31 illustrates a human subject 79 looking towards a television 182 based home entertainment system. The surround and subwoofer loudspeakers are assumed to be out of sight for the purposes of this illustration. The left-front loudspeaker 180 is positioned on the left side of the TV and the right-front loudspeaker 183 on the right side. The center loudspeaker 181 is placed on top of the TV set 182. The dotted line 179 indicates a bounded area within which the listener is expected to maintain their head orientation. The X points 184, 185, 186, 187 and 177 represent imaginary points in space at which the human subject looks while each set of personalization measurement are made. The center lines 250 represent the different lines-of-sight as the subject looks at each of the X points. In the case of FIG. 31 personalization measurements for all the loudspeakers, including those out-of-sight will be repeated five times, each time the human subject will reposition their head to look towards one of the measurement X points.

In this example, the five personalized head orientations are, upper left 185 i.e., the subject looks above and to the left of the left-front loudspeaker 180, upper right 186, which is above and to the right of the right-front loudspeaker 183, lower left 184, lower right 187 and screen center 177 which approximates the nominal head orientation while viewing a movie. Once all the measurements are acquired, the resulting PRIR data and their associated head orientations are stored for use by the interpolator.

Figure 29:
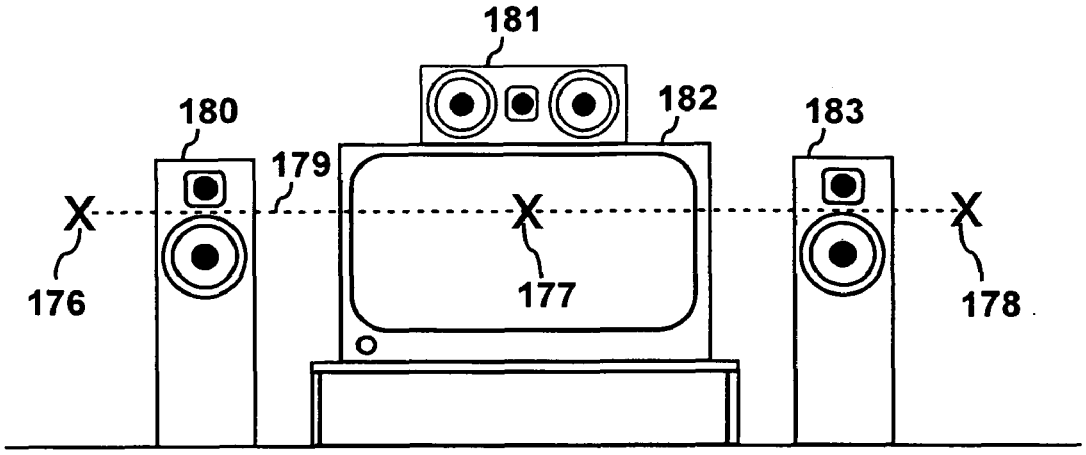
FIG. 29 is a front elevation view of left, right and center loudspeakers positioned around a widescreen television set and showing three viewing positions that comprise the PRIR measurement scope.
Figure 30:
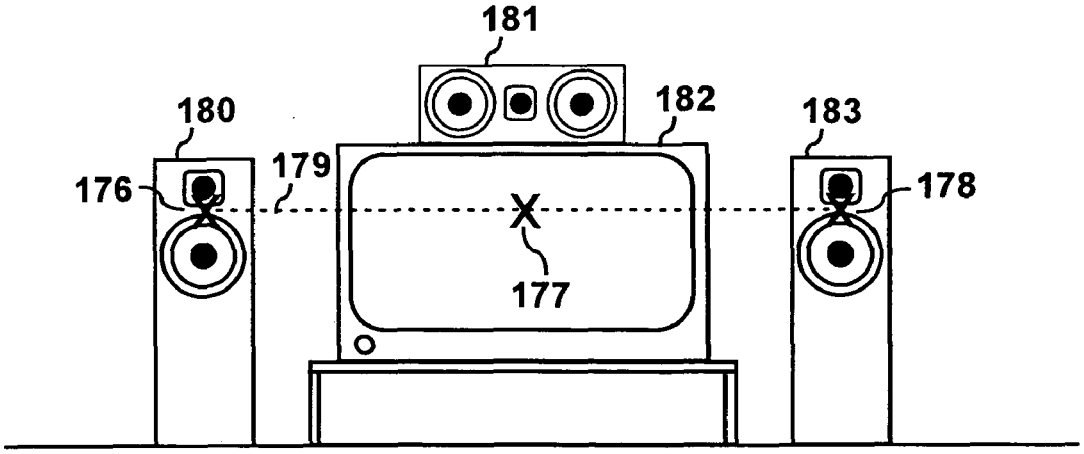
FIG. 30 is similar to FIG. 29 except that the two outer viewing positions correspond to the positions of the left and right loudspeakers.

FIG. 29 illustrates an alternative personalization measurement procedure whereby only three head orientations on the same lateral plane 179 are used to make the personalized measurements, X point 176 to the left of the left-front speaker 180, X point 177 at center screen and X point 178 to the right of right-front loudspeaker. This form of measurement assumes that the most important component in head tracked virtualization is pure head rotation (yaw), since the room impulse response for head elevations (pitch) either side of this line would not be known. FIG. 30 illustrates a further simplification whereby the left and right X points 176 and 178 correspond with the left and right-front loudspeakers themselves. In this variation the human subject simply needs only to look at the left-front loudspeaker, the right-front loudspeaker and the screen center, all on approximately the same lateral plane, for each set of personalization measurements, respectively.

The personalized room impulse response (PRIR) data sets permit the virtualization of loudspeakers and the position of each virtual loudspeaker will correspond to the position of the real loudspeaker relative to the human subjects head established during the measurement process. Hence for the interpolation method to work accurately, that is, to cause the virtual loudspeaker to appear to be positioned coincident with the real loudspeaker, provided the subjects listening position relative to the real loudspeakers is the same as during the personalization measurements, then it is only necessary for the virtualizer to know for which head orientations the personalized impulse responses correspond to, in order for it to interpolate between the data in response to head orientation signals being fed back from a head tracking device. Provided the head tracker uses the same directionality reference as the system that determined the head orientation for each personalization data set then the virtual and real loudspeakers will coincide from the listener's perspective, within the scope of the original measurements.

Matching Virtual-Real Loudspeaker Lateral and Height Positions

The personalization measurement process relies on the fact that each loudspeaker is measured over some range, or scope, of the human subjects head movement. While the head orientations for each personalized data set are known and referenced to the playback head tracker coordinates, strictly speaking, embodiments of the invention do not need to know the physical position of any of the loudspeakers under test in order for accurate virtualization to be achieved. Provided the real loudspeaker positions remain the same as those used for the personalization process, then the virtual sounds will emanate from the same physical locations, However, knowledge of the physical loudspeaker positions is useful when it may be necessary to make adjustments to the virtual loudspeaker positions as a result of virtual-real loudspeaker positional misalignment. For example if the user wishes to set up loudspeakers in a listening environment other than the one used to make the measurements, then ideally they would physically arrange the loudspeakers to match the virtual loudspeaker positions as accurately as possible so as to cause the virtual sounds to coincide with the real loudspeakers. Where this is not possible then the listener will perceive the virtual sounds to emanate from locations other than the loudspeakers, a phenomenon that can reduce the realism of the virtualizer for some individuals. This problem is less of an issue for loudspeakers that are ordinarily out of sight over the normal listener's head movement scope, as might be the case for the surround loudspeakers 198 and 199 FIG. 34*a*, or those loudspeakers positioned above the listener.

Embodiments of the invention may allow for some degree of adjustment to the virtual loudspeaker lateral and/or height positions by introducing an offset to the interpolation processes. The offset represents the position of the desired virtual loudspeaker relative to the measured loudspeaker position. However the degree of head movement permitted while virtualizing such loudspeakers will be reduced by an amount equal to the offset, due to fact that the personalized room impulse responses do not cover head movements beyond the original measured boundaries. This implies that the original personalization process should be conducted over a wider head orientation range than might ordinarily be required for normal listening/viewing if minor positional adjustments are likely to be made at a later date.

Figure 33A:
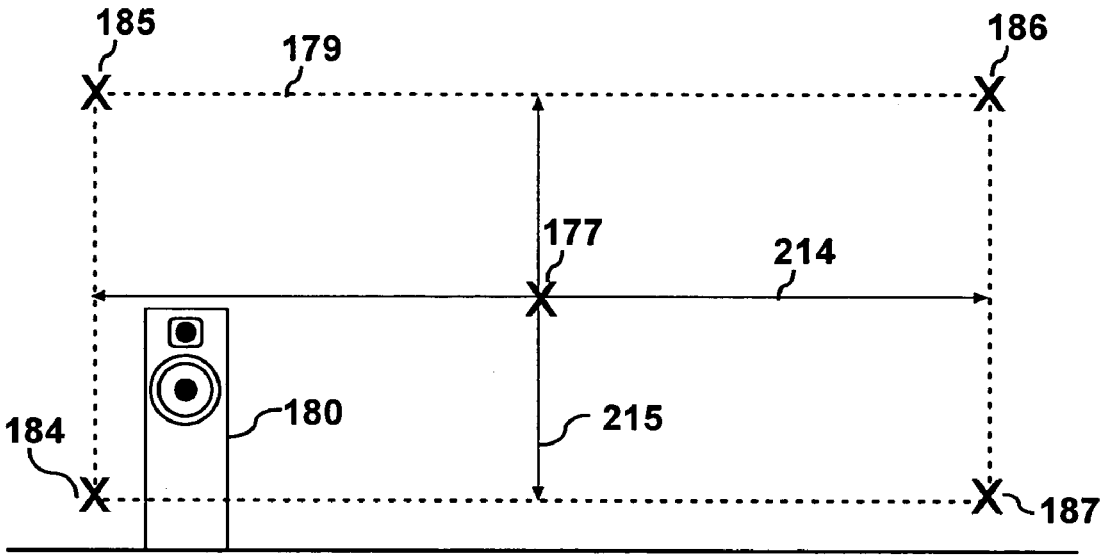
FIGS. 33*a* and 33*b* illustrate the use of virtual loudspeaker offsets to realign the position of a virtual source with that of a real loudspeaker.
Figure 33B:
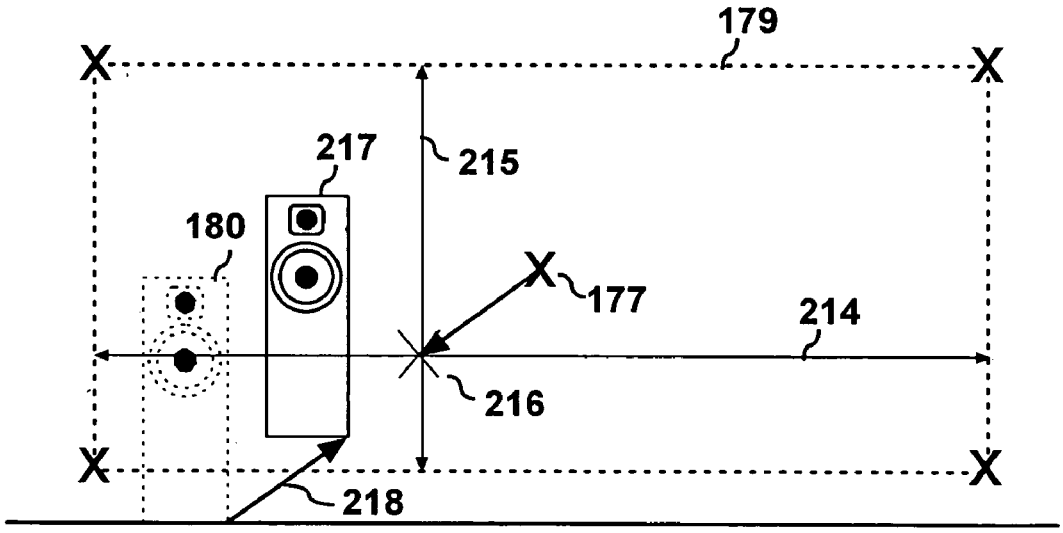

Use of an interpolation offset to alter the position of a virtual loudspeaker is illustrated in FIGS. 33*a* and 33*b*. In FIG. 33*a* the dotted boundary line 179 represents the listeners viewing boundary over which the virtualizer interpolator operates using the personalized data sets measured at points 184, 185, 186, 187 and 177 for real loudspeaker 180. The center measurement point 177 represents the nominal listening/viewing head orientation and this corresponds to the playback head tracker zero reference position. The maximum extent of left-right and up-down head movement is indicated by 214 and 215 respectively. In FIG. 33*b* the position of the real loudspeaker 217 now does not correspond to that which was used to make the personalized measurements 180. This implies that the virtualizer interpolator introduces an offset into its calculations 216 in order to force the virtual loudspeaker 180 to be realigned with the real loudspeaker 217—the offset running counter to the desired virtual loudspeaker positional shift 218. The same offset is also used to adjust the inter-aural path differences. As a result, the head movement range that can be accommodated by the interpolator for this virtual loudspeaker is significantly reduced 214 and 215—in this particular illustration, left-off-center and below-center head movements will reach the personalization measurement boundary 179 much sooner than without the offset.

Measuring Head Orientations Taken up During Personalization Measurements

In order for the personalized room impulse response interpolation to cause the virtual loudspeaker position to coincide with that of the real loudspeaker it may be necessary for the head orientation to be established and logged for each of the personalized room response measurements, and for these orientations to be referenced to the head tracking coordinates that will be used in the virtualizer playback. These coordinates would typically be stored permanently along side the PRIR data sets since without them the head angles and virtual loudspeakers they represent may be difficult to unravel from the PRIRs themselves. The head orientation measurements can be achieved in a number of ways.

The most straightforward method involves the human subject wearing some form of head tracker device, in addition to the ear-mounted microphones, during the personalized measurements. This method can determine head orientations over three degrees of freedom and is therefore applicable to all levels of measurement complexity, including those that take head roll into account. For example, a head tracker could be used for the measurements illustrated in FIGS. 29, 30 and 31. Hence the head yaw (or rotation), pitch (elevation) and roll readings output from the head tracker may be logged prior to the start of each set of loudspeaker measurements and this information is retained for use by the virtualizer.

Alternatively, if a head tracker is not available, fixed physical viewing points can be set up prior to the testing, whose associated head orientations are measured manually ahead of time. This would normally involve erecting a number of viewing targets around the front loudspeakers or movie screen. The human subject simply looks towards these targets for each personalized measurement, and the associated head orientation data entered manually into the virtualizer. In cases where the measurement head orientations are limited to the lateral plane, for example FIGS. 29 and 30, it is also possible to use the front loudspeakers themselves 180 and 183 of FIG. 30, as viewing targets and to enter their positions into the virtualizer.

Unfortunately when human subjects look at targets or loudspeakers often their head does not exactly point to the object they are looking at and the resulting misalignment can lead to minor dynamic tracking errors during virtualizer headphone playback. One solution to this problem is to consider the measurement points as arbitrary head angles, FIG. 29, where the head rotation angle associated with positions 176 and 178 can be estimated by analyzing the inter-aural delays of the measured personalized room impulse responses themselves. For example, if the subject positions their head looking off to the left and the front center loudspeaker 181 is selected as the excitation loudspeaker, then the delay between the left and right-ear impulse response onsets will provide an estimation of the head angle with respect to the center loudspeaker.

Assuming the maximum delay is known, i.e., the delay measured between the left and right-ear microphone signals when the excitation signal is directly perpendicular to the left or right ear, and the head angle is within +/−90 degrees of the excitation loudspeaker, the head angle referenced to that loudspeaker is given as:

$$\text{Head angle}=\text{arcsine}(-\text{delay}/\text{maximum absolute delay}) \quad \text{(eqn 1)}$$

where a positive delay occurs when the delay of the left-ear microphones exceeds that of the right-ear microphone. The accuracy of the technique is greatest when the angle subtended between the excitation loudspeaker and the subject's head is at it lowest, i.e., for off-left measurements it may be better to use the left front loudspeaker as the excitation source rather than the center front loudspeaker. Furthermore, the method can either use an estimate of the maximum absolute delay, in particular when the head to loudspeaker angle is small, or the maximum absolute delay between the users ear mounted microphones may be measured as part of the personalization procedure. Another variation is to use some type of pilot tone rather than an impulse measurement excitation signal. Under certain circumstances a tone will enable more accurate head angle measurements to be made. In this case the tone can be continuous or burst, and the delays determined by analyzing the phase difference or onset times between the left and right-ear microphone signals.

The head orientation angles taken up during each personalization acquisition are typically measured with respect to a reference head orientation, herein referred to as θ ref, ω ref or ψ ref, depending on the degrees of freedom permitted during the personalization. The reference head orientation defines the listener's head orientation that would be taken up while viewing the movie screen or listening to music. Depending on the nature of the head tracker, the tracking coordinates may have a fixed point of reference e.g., the earth's magnetic field or an optical transmitter sitting on the TV set, or their point of reference may vary over time. With a fixed reference system it would be possible to measure the normal viewing orientation and then retain this measurement inside the virtualizer on a permanent basis for use as the reference head orientation. The measurement would be repeated only if the listener's home entertainment system were to be altered in a way that caused the viewing angles to change with respect to this reference. With floating reference head trackers, for example gyroscope based, the reference head orientation may need to be established every time the virtualizer/head tracker is switched on.

One possible implication of all of this is that it may not be unusual to have some virtual-real loudspeaker misalignment brought about by differences in head reference values over time. A headphone virtualization system may therefore provide to the user a convenient way of resetting the head reference orientation angles (θ ref, ω ref or ψ ref) as part of the normal listening set up. This could be achieved, for example, by providing a one-shot switch that when depressed would prompt the virtualizer, or head tracker, to store off the listener's current head orientation angles. The listener could interactively home in on the correct head alignment by simply listening to the virtualized loudspeakers over the headphones, move their head in the opposite direction to the perceived misalignment, while repeatedly sampling the angles using the switch, until the virtual and real loudspeakers coincide. Alternatively, some form of absolute reference method could be used, for example, using a head mounted laser and pointing the laser beam to some previously defined reference point in the listening room, for example the center of the movie screen, prior to storing off the head angles.

Interpolation Between PRIR Data Based on Head Tracker Input

Disclosed herein is a method that permits accurate interpolation between sparsely sampled PRIRs without loss of virtualization accuracy and may be important to the success of the personalized head tracking methodology disclosed herein. Left and right-ear personalized room impulse responses, (PRIRs), when convolved with an audio signal such that the left-ear convolved signal is played through the left side of a pair of headphones and the right-ear convolved signal played through right side of the headphones, cause the listener to perceive the audio coming from the same location, with respect to his head orientation, as the loudspeaker used to acquire the left-ear and right-ear PRIRs in the first place. If the listener moves their head, then the virtual loudspeaker sound will retain the same spatial relationship with the head and the image will likely be perceived to move in unison with the head. If the same loudspeaker is measured using a range of head orientations and the alternate PRIRs are selected by the convolver when the head tracker indicates the listener's head coincides with the original measurement positions, then the virtual loudspeaker will be correctly positioned at these same head positions.

For head positions that do not correspond to those used during the measurements the virtual loudspeaker position may not be aligned with that of the real loudspeaker. The idea behind the interpolation method is that the impulse response characteristic between the loudspeaker and the ear-mounted microphones will probably change relatively slowly as the head turns and if measured for a small number of head positions the impulse characteristic for those head positions not specifically measured can be calculated by interpolating between those head positions for which impulse data does exist. The impulse response data loaded to the convolvers would therefore exactly match those of the original PRIRs only for head positions that correspond to the measurement head positions. Theoretically head orientations can cover the entire auditory sphere and if only a few measurements are taken to cover this range of movements, then it is likely that the differences between the PRIRs will be large and therefore not well suited to interpolation.

Disclosed herein is a method whereby the typical listener head movements are identified and only measurements sufficient to cover this narrow range of head movements are carried out and applied to the interpolation process. If the differences between the adjacent PRIRs are small, then by calculating intermediate impulse responses based on the measured PRIRs, the interpolation process should cause the virtual loudspeaker position to remain stationary, even when the head tracker indicates the listener's head position is no longer coincident with those of the PRIRs. In order for the interpolation process to work accurately, it is broken down into a number of steps.

1) The inter-aural time delays inherent in the raw impulse responses output from the personalization process is measured, logged and then removed from the impulse data, i.e., all impulse responses are time aligned. This is done only once after the personalization measurements are complete.
2) The time-aligned impulses are directly interpolated, where the interpolation coefficients are calculated in real-time, or derived from a look-up table, based on the head orientation indicated by the listener's head tracker, and the interpolated impulse is used to convolve the audio signals.
3) The left-ear and right-ear audio signals are, either prior to or following the PRIR convolution process, passed through separate variable delay buffers whose delays are continuously adapted to match the virtual inter-aural delays that simulate the effect of the different path lengths that would ordinarily exist between the listener's left and right ears and a real loudspeaker coincident with the virtual loudspeaker. The path lengths can be calculated in real time or they can be derived from look-up tables, based on the head orientation indicated by the listener's head tracker.

Time Alignment of Impulse Responses

In order to provide effective impulse interpolation it is desirable to time-align the PRIRs. However the differential time delays between all the PRIRs are put back into the audio signals either prior to, or following, the PRIR convolution process using a combination of fixed and head-tracker-driven variable delay buffers in order to fully recreate the virtualizer illusion. One way of achieving this is to measure the various time delays, log them, and then remove these delay samples from each PRIR such that they are approximately time aligned. Another approach is to simply remove the delays and to rely on the user to input sufficient information about the PRIR head angles and the loudspeaker positions such that the delays can be calculated independent of the PRIR data.

If it is desired to estimate the delays from the PRIR data (rather than have the user enter the data) then the first step is to measure the absolute time delays from the loudspeaker to the ear mounted microphone by searching the raw PRIR data files and locating the onset of each impulse. Since in one implementation the playback and recording of the MLS is tightly controlled and highly reproducible, the location of each impulse onset relates to the path length between that loudspeaker and microphone. Due to latencies in the analogue and digital circuitry a certain fixed delay offset will always exist in the PRIR, even when the loudspeaker-microphone distance is small, but this can be measured during a calibration procedure and removed from the calculation.

Many methods exist for detecting waveform peaks and are well known in the art. A method that works consistently is one that measures the absolute peak value over the entire impulse response waveform and then uses this value to calculate a peak detection threshold. A search is then started from the beginning of the impulse file, which sequentially compares each sample to the threshold. The sample that first exceeds the threshold defines the impulse onset. The position of the sample in from the start of the file, less any hardware offset, is a measure of the total path length, in samples, between the loudspeaker and the microphone.

Once the delays are measured and logged for each PRIR, all the data samples up to the impulse onset are removed from the PRIR data files leaving the direct impulse waveforms coincident with, or very close to, the start of each file. The second step involves measuring the sample delay from each real loudspeaker to the center of the head and then using this to calculate the inter-aural delays present between the left and right ear microphones for each head position taken up during the personalization measurements. The loudspeaker-head sample path length is calculated by taking the average value between the left-ear and right-ear impulse onsets. The same value should be found for all head positions used to measure the same loudspeaker, however slight differences may exist and an averaged loudspeaker path may be desirable. The inter-aural path difference is then calculated by subtracting the right-ear path length from the left-ear path length for all pairs of impulses responses for all head positions and for all loudspeakers.

The method described this far operates on the raw PRIR data sampled at a rate equal to that of the MLS playback through the excitation loudspeaker. Typically this sampling rate would be the region of 48 kHz. Higher MLS sampling rates are possible and indeed are often preferred when one wishes to run the virtualization system at high sampling rates, e.g., 96 kHz. Higher sampling rates also allow for a more accurate time alignment of the PRIR files and since the variable buffer implementations will typically offer delay steps down to small fractions of a sample period the additional accuracy can easily be exploited. Rather than raise the fundamental sampling rate of the MLS process, it is also possible to over-sample the PRIR data samples to any desired resolution and to time align the impulses based on the over sampled data. Once this is achieved, the impulse data is then down sampled, returning it to its original sampling rate, and stored off for use by the interpolator. Strictly speaking it is only necessary to over sample either the left-ear or right-ear of each impulse pair in order to achieve alignment.

Impulse Response Interpolation

Interpolating the time aligned impulse data is relatively straightforward and is implemented linearly based on the listener's head orientation angles sent by the head tracker in real time. The most straightforward implementation interpolates between just two impulses responses, corresponding to two measurement angles either side of the desired nominal viewing angle. However, a significant improvement in performance may be realized by making a third measurement midway between the two outside measurements by taking up a head position that approximates the nominal viewing head orientation.

Figure 15:
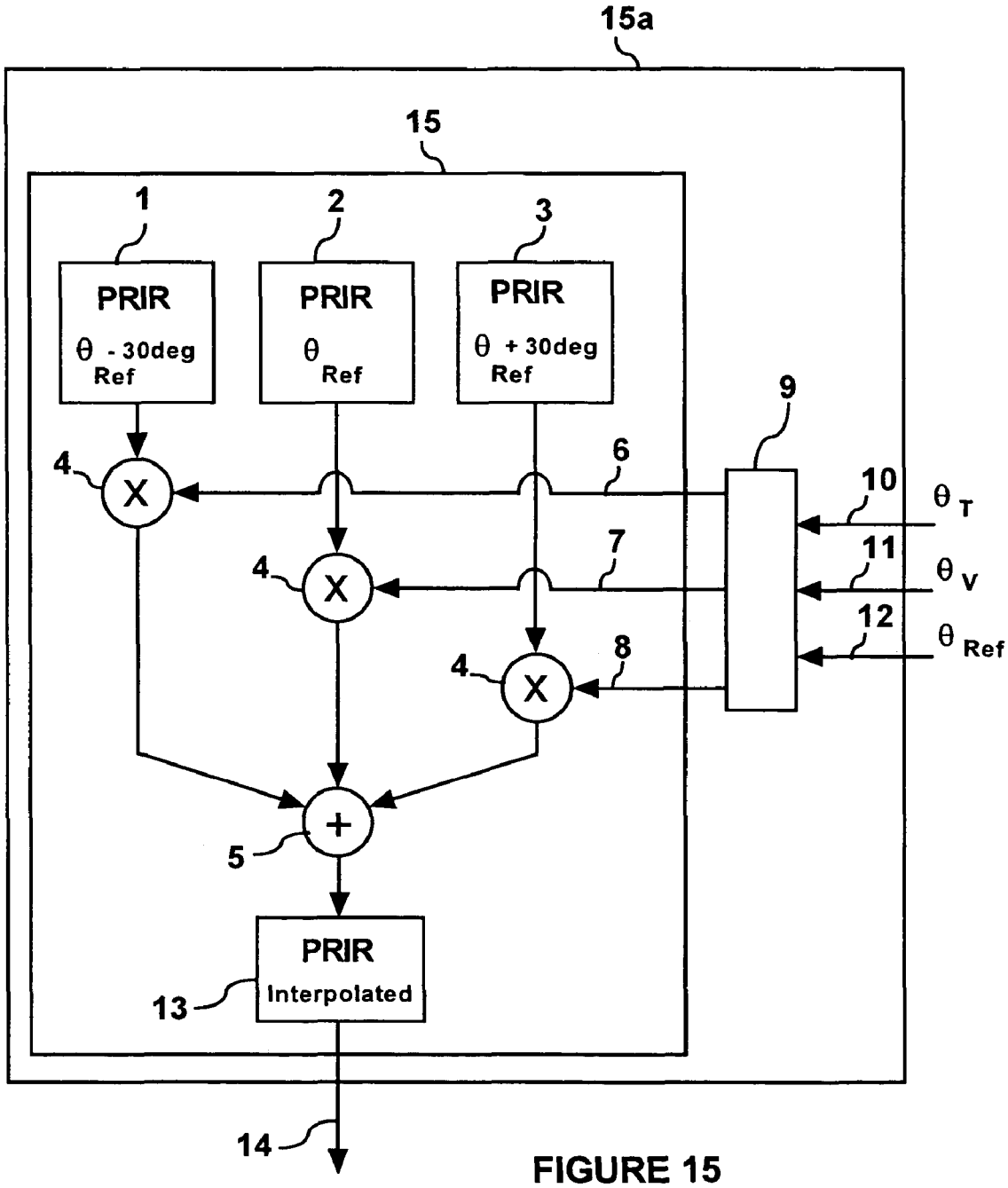
FIG. 15 illustrates a method of interpolating between PRIRs where the measurement scope is represented by head positions +30, 0 and −30 degrees with respect to the reference viewing angle.

By way of example, the process for such a 3-point linear interpolation is illustrated in FIG. 15. The time aligned PRIR interpolation process 15, inputs three interpolation coefficients 6, 7 and 8, calculated 9 from an analysis of the head tracker head angle 10, the reference head angle 12 and a virtual loudspeaker offset angle 11. The interpolation coefficients are used to scale the amplitude of the impulse response samples output from buffers 1, 2 and 3 respectively, using multipliers 4. The scaled samples are summed 5 and stored 13 and output 14 to the convolver on demand. The impulse response buffers each typically hold many thousands on samples, representing a personalized room impulse response with a reverberation time of 100's of milliseconds. The interpolation process ordinarily steps through all samples held in the buffers 1, 2 and 3 although for reasons of economy and speed, it is possible to run the interpolation over a smaller number of samples and use corresponding samples from one of the impulse response buffers to fill out those locations in 13 that are not interpolated. The process of reading the head tracker angles, calculating the interpolation coefficients and updating the interpolated PRIR data file 13 would ordinarily occur at the virtualizer input audio frame rate or the head tracker update rate. The basic interpolation equation for this illustration is given by:

$$\text{Interpolated } IR(n)=a*IR1(n)+b*IR2(n)+c*IR3(n);\ \text{for } n=0,\ \text{impulse length} \quad \text{(eqn 2)}$$

In this example the impulse response buffers 1, 2 and 3 contain PRIRs that correspond to listener lateral head angles, relative to the reference head angle θ ref 12, of −30 degrees (or 30 degrees anticlockwise), 0 degrees and +30 degrees respectively. The interpolation coefficients in this case would typically be calculated in response to head tracker angle $\theta_T$ as follows. First the normalized head tracked angle θn is given by:

$$\theta n=(\theta_T-\theta\text{ref}) \text{ and constrained to } -30<\theta n<30 \quad \text{(eqn 3)}$$

where the reference head angle θ ref is a fixed head tracker angle corresponding to the desired viewing or listening head angle. If the virtual loudspeaker offset angle is zero then the coefficients are given by:

$$a=(\theta n)/-30 \text{ for } -30<\theta n<=0 \quad \text{(eqn 4L)}$$

$$b=1.0-a \text{ for } -30<\theta n<=0 \quad \text{(eqn 5L)}$$

$$c=0.0 \text{ for } -30<\theta n<=0 \quad \text{(eqn 6L)}$$

$$a=0.0 \text{ for } 30>\theta n>0 \quad \text{(eqn 4R)}$$

$$c=(\theta n)/30 \text{ for } 30>\theta n>0 \quad \text{(eqn 5R)}$$

$$b=1.0-c \text{ for } 30>\theta n>0 \quad \text{(eqn 6R)}$$

and therefore are all bounded by 1 and 0. A virtual loudspeaker offset angle θv is an angular offset that is added to the normalized head tracked angle to cause a virtual loudspeaker position to be shifted slightly with respect to θ ref, as might be required, for example, to align it with a real loudspeakers whose position does not match the measured loudspeaker. A separate θv exists for each virtual loudspeaker. Use of the offsets lead to the head track range, relative to θ ref, to be reduced since the PRIR files held in the three buffers are only representative for a fixed range of head angles—in this example +/−30 degrees. For example, where $\theta v_L$ represents an offset to be applied to the left front virtual loudspeaker the normalized head tracked angle $\theta n_L$ for this loudspeaker is:

$$\theta n_L=(\theta_T-\theta\text{ref}+\theta v_L) \text{ again constrained to } -30<\theta n_L<30 \quad \text{(eqn 7)}$$

This far the discussion has interpolated between a single set of PRIR files, corresponding to a loudspeaker measured at three head angles −30, 0 and +30 degrees. Under normal operation the personalization measurement angles will be arbitrary and almost certainly asymmetrical around the reference θ ref. The more general form of the interpolation equations under these circumstances is given by:

$$\theta n_X=(\theta_T-\theta\text{ref}+\theta v_X) \text{ constrained to } \theta L<\theta n_X<\theta R \quad \text{(eqn 8)}$$

$$a=(\theta n_X-\theta C)/(\theta L-\theta C) \text{ for } \theta L<\theta n_X<=\theta C \quad \text{(eqn 9)}$$

$$b=1.0-a \text{ for } \theta L<\theta n_X<=\theta C \quad \text{(eqn 10)}$$

$$c=0.0 \text{ for } \theta L<\theta n_X<=\theta C \quad \text{(eqn 11)}$$

$$a=0.0 \text{ for } \theta R>\theta n_X>\theta C \quad \text{(eqn 12)}$$

$$c=(\theta n_X-\theta C)/(\theta R-\theta C) \text{ for } \theta R>\theta n_X>\theta C \quad \text{(eqn 13)}$$

$$b=1.0-c \text{ for } \theta R>\theta n_X>\theta C \quad \text{(eqn 14)}$$

where $\theta v_X$ is the virtual offset for loudspeaker x, $\theta n_X$ is the normalized head tracked angle for virtual loudspeaker x, θL, θC and θR are the three measurement angles looking to the left, looking to the center and looking to the right respectively referenced to θ ref. The interpolation process is repeated for each left-ear and right-ear PRIR for all virtual loudspeakers, taking into account that the virtual offsets $\theta v_X$ may be different for each loudspeaker.

Figure 32A:
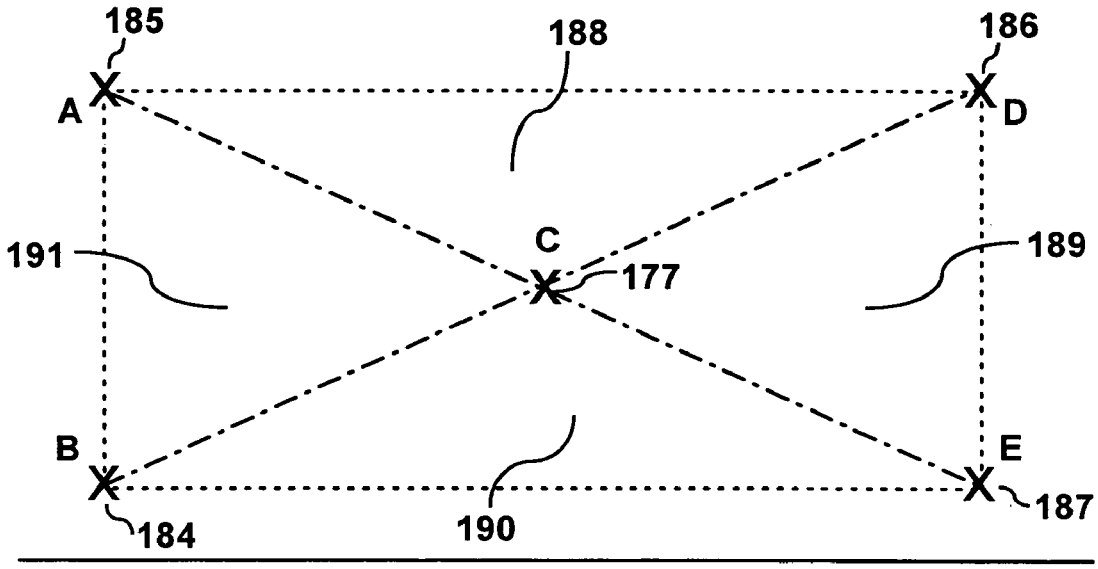
FIGS. 32*a* and 32*b* illustrate a triangulation method for determining head tracked PRIR interpolation coefficients for the five point scope of FIG. 31.
Figure 32B:
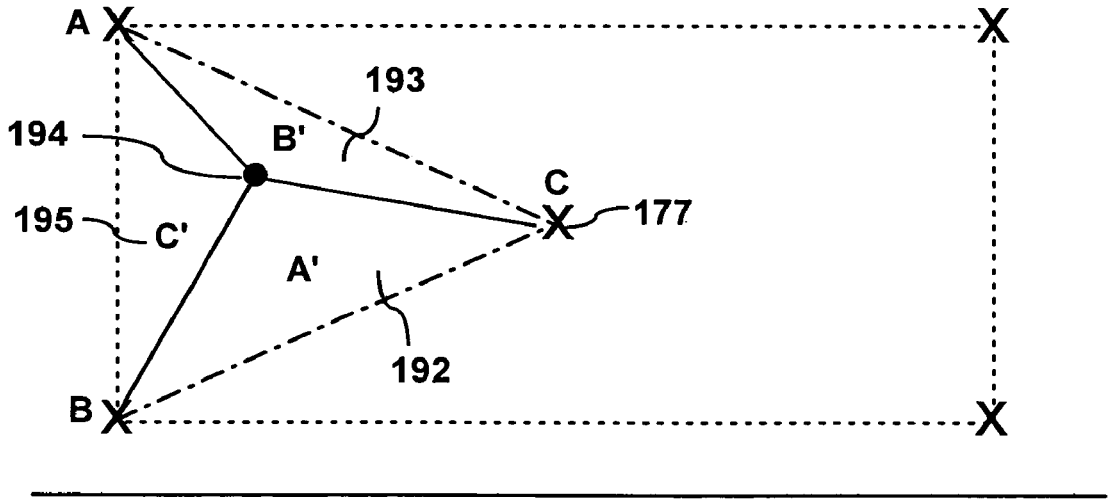

Interpolation can also be achieved when PRIR exist for head positions that include elevation (pitch). FIG. 32*a* illustrates an example where five PRIR measurements sets exist for head orientations A 185, B 184, C 177 D 186 and E 187. The interpolation is typically achieved by dividing the area into triangles 188, 189, 190 and 191 determining into which triangle the listener's head angle falls and then calculating the three interpolation coefficients based on where the head angle falls with respect to the three apex measurement points that form the triangle. FIG. 32*b* illustrates, by way of example, the current listener's head orientation 194 located within triangle whose apexes A, B, and C correspond to three of the original measurement points 185, 184 and 177 respectively. This triangle is sub-divided again as shown where the head angle point 194 forms the new apex for each sub-triangle. Sub-area A' 192 is bounded by the head angle point 177 and apexes B and C. Likewise, sub-area B' 193 is bounded by 194, A and C, and sub-area C' 195 is bounded by 194, A and B. The interpolation equation is given by:

$$\text{Interpolated } IR(n)=a*IRA(n)+b*IRB(n)+c*IRC(n);\ \text{for } n=0,\ \text{impulse length} \quad \text{(eqn 15)}$$

where IRA(n), IRB(n) and IRC(n) are the impulse response data buffers corresponding to measurement points A, B and C respectively. The interpolation coefficients a, b and c are given by:

$$a=A'/(A'+B'+C') \quad \text{(eqn 16)}$$

$$b=B'/(A'+B'+C') \quad \text{(eqn 17)}$$

$$c=C'/(A'+B'+C') \quad \text{(eqn 18)}$$

This method can be used for any of the triangles that make up the original measurement boundaries, to which the head tracker indicates the listener's head is pointing. Many methods exist in the art for calculating the sub areas A', B', and C'. The most accurate methods assume the measurement points A, B, C, D, E and the head position point 194 all lie on the surface of a sphere whose center coincides with the listeners head. If the listener's head yaw and pitch coordinates are given by $\omega_T$, then, as with the case of the lateral interpolation, it is referenced to the desired viewing yaw and pitch orientation ω ref and constrained to lie within the measurement 2-dimensional bounds. In the case of FIG. 32*a*, the normalized tracker coordinates ωn are defined as:

$$\omega n=(\omega_T-\omega\text{ref})\ \text{constrained to } AB<\omega n(\text{yaw})<DE \quad \text{(eqn 19)}$$

$$BE<\omega n(\text{pitch})<AD \quad \text{(eqn 20)}$$

where AB, DE, AD and BE represent the left, right, upper and lower bounds of the measurement area. Again, a 2-dimensional offset $\omega v_X$ for virtual loudspeaker x can be added to the normalized coordinates ωn to cause the perceived location of the virtual loudspeaker to be shifted with respect to the reference viewing orientation ω ref to give, $$\omega n_X=(\omega_T-\omega\text{ref}+\omega v_X)\ \text{constrained to } AB<\omega n_X(\text{yaw})<DE \quad \text{(eqn 21)}$$

$$BE<\omega n_X(\text{pitch})<AD \quad \text{(eqn 22)}$$

The above discussions have assumed that the PRIR measurement head orientations are measured with respect to the reference head orientation. If the PRIR orientations are only known relative to each other, then their exact relationship to the reference head orientation may be uncertain. In this case it will be necessary to establish an approximate center reference by calculating the median point of the PRIR measurement scope and referencing the measurement coordinates to this point. This does not guarantee exact virtual-real loudspeaker alignment during virtualization playback, since this median point may not coincide with the reference head orientation used during their acquisition. Alignment in this case can only be reliability achieved interactively while listening to virtualized loudspeakers over the headphones as described herein.

To reduce the computational loading of the interpolation coefficient calculations it is possible to build look-up tables of discrete values during the virtualizer initialization stage. These values would then be read out of the table based on head tracker angles. Such look-up tables could be stored alongside the PRIR data avoiding the need to regenerate the tables every time the PRIR is loaded by the virtualizer initialization routines. The discussions have also made reference to 2-position, 3-position and 5-position PRIR interpolation methods by way of example. It will be appreciated that the PRIR interpolation techniques are not confined to these specific examples and can be applied to many combinations of head orientations without departing from the scope of the invention.

Pre-Interpolated Impulse Response Storage

One method of altering the PRIRs in response to changes in the listeners head angles is to calculate, on-the-fly, an interpolated impulse response from some set of sparsely measured PRIRs. An alternative method is to pre-calculate in advance a range of intermediate responses and to have them stored in memory. The head tracker angles, including any offsets, are then used to access these files directly, avoiding the need to generate interpolation coefficients or run the PRIR interpolation process during the real-time virtualization. This method has the advantage that the number of real time memory reads and calculations are lower than the interpolated case. The big disadvantage is that in order to achieve sufficiently smooth transitions between the intermediate responses during dynamic head tracking, many impulse response files are required, making heavy demands on system memory.

Path Length Calculation

Since the original left and right-ear PRIRs measured for each loudspeaker and each head position are not necessarily time aligned, i.e., they may exhibit an inter-aural time difference (or delay), then after convolving the left and right-ear audio signals with the time aligned impulse responses it may be necessary to reintroduce this difference by passing the convolved audio through variable delay buffers. Inter-aural delays will vary in a sinusoidal fashion only for head movements in the lateral plane (yaw) and for head roll. Elevating (pitch) the head does not affect the arrival times since the pitch axis is essentially aligned with the ears themselves. Hence for personalized measurements where the head position includes both rotation and elevation, it is only the yaw angle of the head tracker that is used to drive the variable delay buffers. Where PRIR data exists for head roll angles other than horizontal, the inter-aural time delay calculation takes into account changes in head tracker roll angle. The maximum extent of either the yaw or roll movements on the inter-aural time delays will ultimately depend on the position of the loudspeaker relative to the listener's head.

Figure 9:
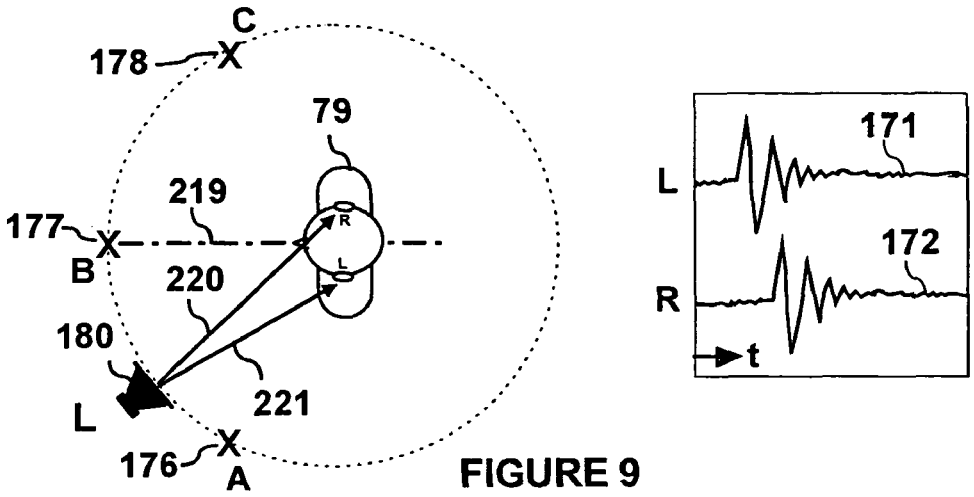
FIG. 9 is a plan view of human subject undergoing a PRIR measurement of the center point of the measurement scope—along with the resulting impulse time waveforms.
Figure 10:
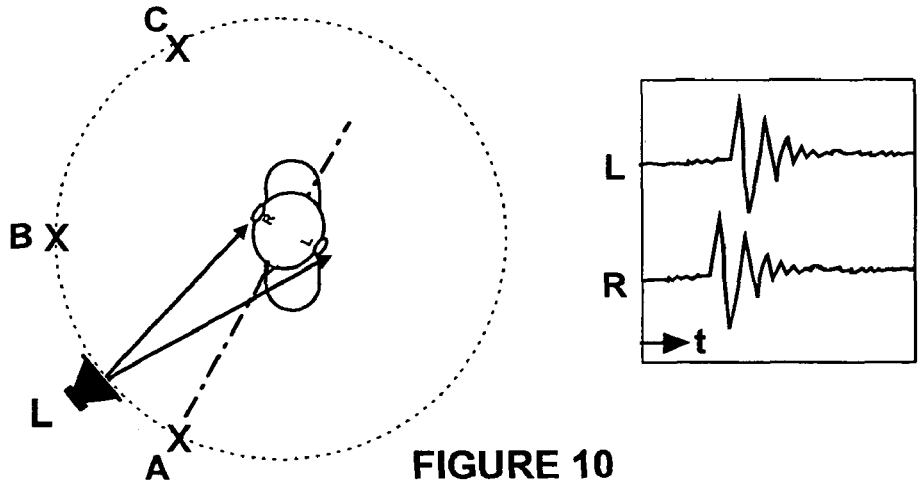
FIG. 10 is a plan view of human subject undergoing a PRIR measurement of the left most point of the measurement scope—along with the resulting impulse time waveforms.
Figure 11:
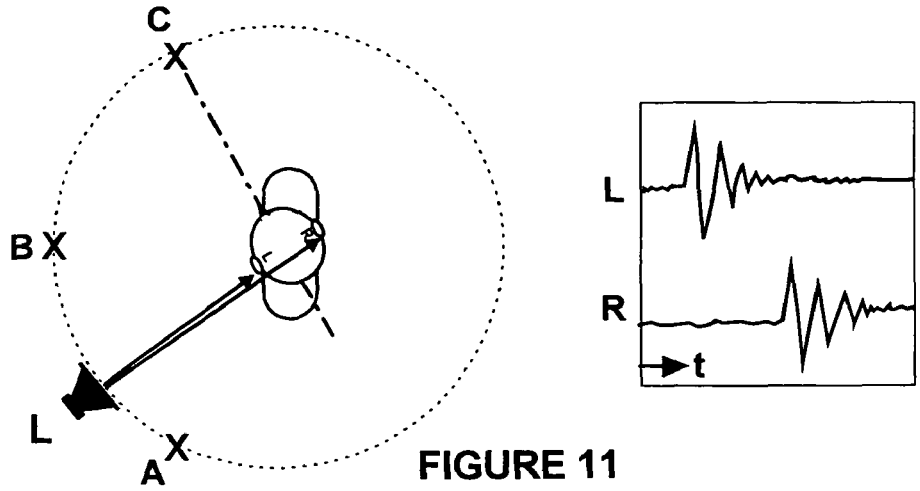
FIG. 11 is a plan view of human subject undergoing a PRIR measurement of the right most point of the measurement scope—along with the resulting impulse time waveforms.
Figure 13:
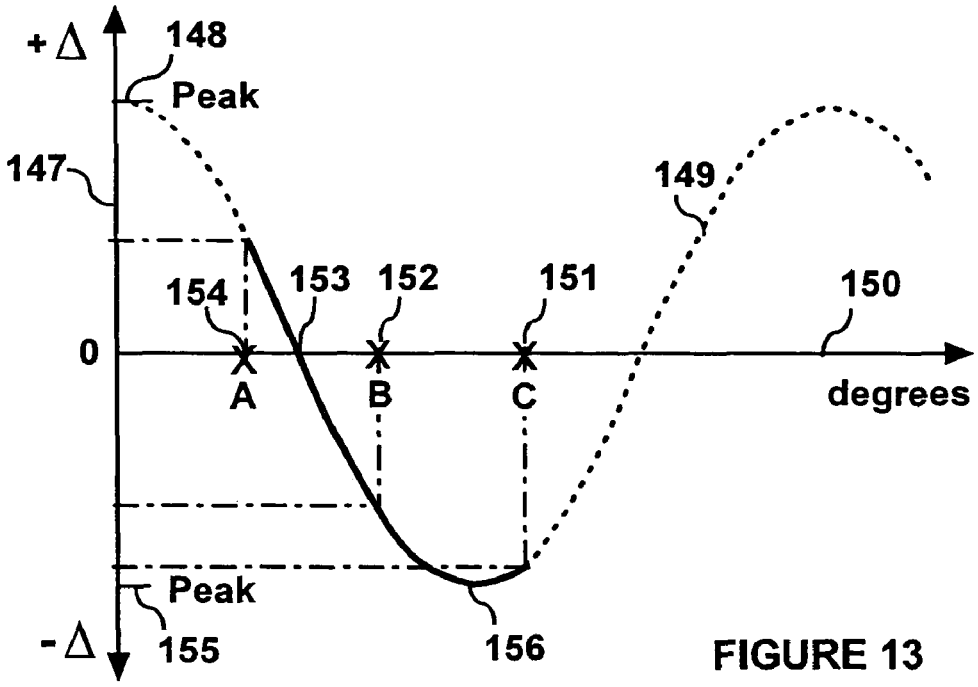
FIG. 13 illustrates the mapping of the PRIR measurement angles in order to formulate the inter-aural differential delay—head angle sine wave function.

By way of example, the typical inter-aural path difference Δ between the left and right ear-mounted microphones for the lateral plane measurements of FIGS. 9, 10 and 11 is illustrated in FIG. 13. Where Δ 149 is positive, as plotted on the y-axis 147, the path length is greatest for the left-ear microphone. The variation of Δ with respect to head rotation is plotted on the x-axis 150 and is approximated by a sinusoid 149, reaching peak values 148 and 155 when the axis through the ears is aligned with the sound source. The solid part of the sinusoid indicates the region of the curve that bounds the three head viewing positions 154, 153 and 151 illustrated in FIGS. 10, 9 and 11 respectively. The amplitude of the sinusoid at these three points represents the path length difference measured from the PRIR data for each head position, and their relative head angle is set off against the x-axis. The path-length interpolation method involves calculating the amplitude of the sinusoid for head angles 150 indicated by the head tracker such that any intermediate path delay can be created between head angles A, B and C. Path length calculations can continue even when the head tracker indicates the head has moved outside the measured bounds as illustrated by the dotted line 149 in FIG. 13, since the sinusoid is automatically defined for the complete 0-360 degree head turn range.

For any particular loudspeaker the sinusoid equation is solved using the path difference and head angle values of at least two of the PRIR measurement points. The basic equations for the points A, B and C are:

$$1)\ PEAK*\sin(\theta)=\Delta_A \quad \text{(eqn 23)}$$

$$2)\ PEAK*\sin(\theta+\omega)=\Delta_B \quad \text{(eqn 24)}$$

$$3)\ PEAK*\sin(\theta+\omega+\epsilon)=\Delta_C \quad \text{(eqn 25)}$$

where PEAK is the maximum inter-aural delay when a sound source is perpendicular to the ears, $\theta$ is the angle on the sinusoid curve corresponding to measurement point A, $\Delta_A$, $\Delta_B$, $\Delta_C$ are the differential delays for points A, B and C respectively, $\omega$ is the angle subtended between points A and B, and $\epsilon$ is the angle subtended between points B and C.

Solving for $\theta$, and using the first two equations gives:

$$\mathrm{Sin}(\theta+\omega)/\mathrm{Sin}(\theta)=\Delta_B/\Delta_A \quad \text{(eqn 26)}$$

Since at least two head angles define the listener scope and associated with these angles are left and right-ear PRIR data sets that exhibit known path differences $\Delta$, (for example $\Delta_A$ and $\Delta_B$) and the angular displacement $\omega$ between the head angles is also known, then $\theta$ can be readily determined by iteration. Due to measurement inaccuracies, it may be desirable to create a second ratio where additional measurements exist, say $\Delta_C/\Delta_A$ in this example, in order to confirm the results of the first, or to generate an average. The amplitude of the sinusoid, PEAK, can then be found by substitution. The above method is repeated for all left-ear and right-ear sets of loudspeaker PRIR data. The general path difference equation for virtual loudspeaker x is given as, $$\Delta_X=PEAK_X*\sin(\theta_X+\rho) \quad \text{(eqn 27)}$$

where $\rho$ is an angle related to the listener's head rotation. More specifically, since the original measurement points are referenced to $\theta$ ref, the listener's head angle $\theta$t, as indicated by the tracker, is appropriately offset to give the normalized listener head angle $\theta$n:

$$\theta n=(\theta t-\theta ref) \quad \text{(eqn 28)}$$

This angle would typically be constrained to within the angular limits of the measurement points, but this is not strictly necessary since the path differences can be calculated correctly for all head angles. The same is true when applying the virtualized loudspeaker offsets $\theta v_X$ $$\theta n_X=(\theta t-\theta ref+\theta v_X) \quad \text{(eqn 29)}$$

The normalized head angle is now referenced to the sinusoid function of FIG. 13. The path length angle for each virtual loudspeaker $\theta_{\Delta X}$ is calculated by subtracting the left most measurement angle $\theta$A from the normalized head angle:

$$\theta_{\Delta X}=(\theta n_X-\theta A) \quad \text{(eqn 30)}$$

Hence when the normalized angle equals the left measurement point the path length angle $\theta_{\Delta X}$ is zero. The path length difference for loudspeaker x is now calculated using $$\Delta n_X=PEAK_X*\sin(\theta_X+\theta_{\Delta X}) \quad \text{(eqn 31)}$$

Typically the sine function would be calculated using a subroutine or it would be estimated using some form of discrete look-up table.

The above explanation has focused on the example of lateral head rotation (yaw). Changes in head elevation (pitch) do not affect the inter-aural delays. This implies the choice of pitch angle is not important when it comes to constructing the sinusoidal function from their PRIR data sets. Where head roll is to be used to adjust the virtualized inter-aural delays then the same general approach can be taken using the inter-aural time delays measured from the PRIR data acquired for the different roll angles. In this case the inter-aural delays calculated from yaw head movements are modified based on the extent of the roll angle. Various procedures are available to implement such a 2-dimensional interpolation process and are well understood in the art. Moreover, the illustrations used to explain the yaw path length calculation have focused on a 3-point PRIR configuration. It will be appreciated that the path length formula can be constructed using a wide range of combinations of PRIR head orientations without departing from the scope of the invention.

Apart from inter-aural (differential) delays that exist between the ears for any one loudspeaker, potentially path length differences exist between the various loudspeakers. That is, the loudspeakers may not be equidistant from the listener's head. The inter-loudspeaker differential delays are calculated by first identifying the shortest path length, i.e., the loudspeaker nearest the listener's head, and subtracting this value from itself and all the other loudspeaker path length values. These differential values can become a fixed element of the adaptive delay buffers created to implement the inter-aural delay processing. Alternatively it may be more desirable to implement these delays in the audio signal paths prior to their being split up to feed the variable inter-aural delay buffers or PRIR convolvers—whichever come first.

The common loudspeaker delay, i.e., the minimum path length to the head, can be implemented at any stage of the process using fixed delay buffers. Again it may be desirable to delay the inputs to the virtualizer or, alternatively, if the delay is sufficiently small that it does not introduce significant head tracking latency, it can be introduced into the headphone signal feed at the output of the virtualizer. Often however, the virtualizer hardware implementation itself will exhibit a significant signal processing delay, or latency, and so the minimum loudspeaker path delay would ordinarily be reduced by the amount of the hardware latency, and may not be required at all.

Manually Formulated Path Length Calculator

The discussion this far has described a method of determining the path length equations and/or associated look-up tables, by analyzing the PRIR data. If the relationships between PRIR head orientation angles and the PRIR loudspeakers are already known then it is possible to build the path length formula directly using this data. For example, if the user was to wear a head tracker while making the PRIR measurements then the PRIR angles would already be known. If, in addition, the positions of the loudspeakers were also known, with respect to the reference orientation, then it is possible to formulate the path length equations directly without any further analysis. To support such a method it would be necessary for the user to manually enter the locations of their loudspeakers into a virtualizer to allow the calculations to be made. These locations would be referenced to the same coordinates used to measure the PRIR head angles. The PRIR head angles could also be entered in the same way, or they could be sampled from the head tracker during the PRIR procedure.

Once the PRIR head angles and loudspeaker locations are installed in the virtualizer this data can be stored alongside the PRIR data, allowing the path length formula to be regenerated each time the PRIR is loaded by the virtualizer initialization routines.

Implementation of a Variable Delay Buffer

Figure 17:
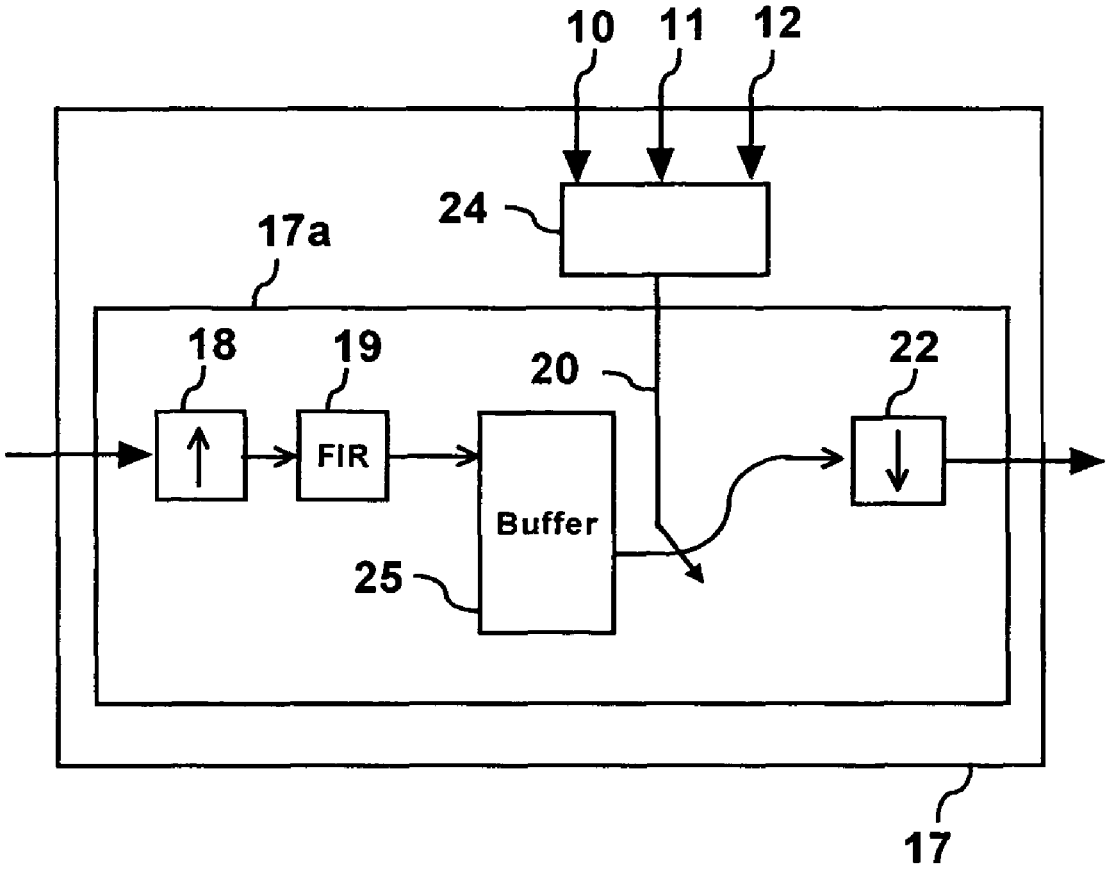
FIG. 17 illustrates an over-sampled variable delay buffer whose delay is adjusted dynamically by a head tracker.

Digital variable delay buffers are well known and many efficient implementations exist in the art. FIG. 17 illustrates a typical implementation. The variable delay buffer 17 over samples 18 the input stream by inserting zeros between the samples, and then low pass filters 19 to reject image aliases. The samples enter the top of a fixed length buffer 25, and the contents of this buffer are systematically shuffled downwards to the bottom on each over sampled period. Samples are read out of a buffer location whose address 20 is determined by the inter-aural time delay calculator 24 driven by the listeners head orientation, the reference angles and any virtual loudspeaker offset, 10, 11 and 12. For example, in the absence of head roll angles, this calculator would take the form of equation 31. The samples read from the buffer are down sampled 22 and the remaining samples output. The delay of the buffer is affected by changing the address 20 of the location from where the samples are read and this can occur dynamically while the virtualizer is running. The delay can range from zero, where the output samples are fetched from the top of the buffer, to the sample size of the buffer itself, where the output samples are fetched from the bottom most location. Typically the over sampling rate 18 is in the order of 100 s to ensure that the action of changing the output address does not cause audible artifacts.

Pre-Calculated Path Lengths

One method of altering the inter aural path lengths in response to changes in the listeners head angles is to calculate the variable delay path lengths based on the sinusoid function via an on-the-fly calculation or through some type of sine look-up table. An alternative method is to pre-calculate in advance a range of path lengths, for each loudspeaker, that cover the expected head movement range and to store these in look-up tables. The discrete path length values would then be accessed in response to varying head tracker angles.

Matching Virtual-Real Loudspeaker Perceived Distance

While humans are relatively insensitive to differences in perceived distances of sound sources, large differences in distance between the listener and the loudspeaker used to make personalized measurements and between the listener and the actual loudspeaker being used to visually reinforce the virtual image will be difficult to reconcile psycho-acoustically. The problem is particularly apparent when the viewing screen is relatively close to the listener's head, for example airplane and in-car entertainment systems. Moreover, in these circumstances it is often impractical to personalize such playback systems. For this reason, embodiments of the invention include a method that modifies the personalized room impulse responses themselves in order to change the perceived virtual loudspeaker distance. The modification involves identifying the direct portion of the personalized room impulse response, specific to the loudspeaker in question, and changing its amplitude and position, relative to the latter reverberant portion. If this modified room impulse response is now used in the virtualizer, the apparent distance of the virtual loudspeaker will be altered to some degree.

Figure 12:
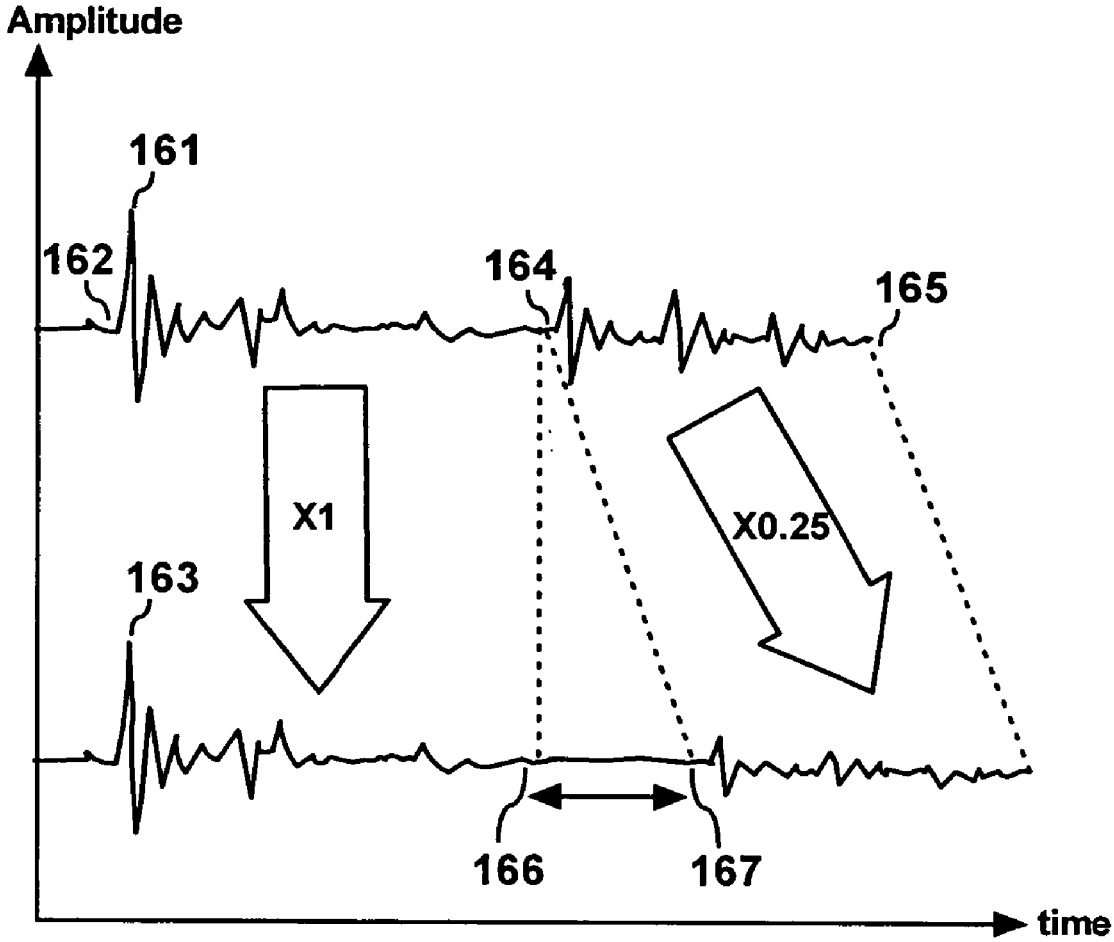
FIG. 12 illustrates a method of altering the perceived distance of a virtual sound source by modifying the impulse response waveform.

An illustration of such a modification is shown in FIG. 12. In this example the original impulse response (the upper trace) projects a virtual loudspeaker that is perceived to be too far away from the physical loudspeaker, and the modification attempts to shorten this distance (the bottom trace). Typically the direct portion of a personalized room response 161 will comprise the first 5 to 10 ms of the waveform beginning from the impulse onset 162 and is defined by that part of the response that represents the impulse wave that arrives at the microphone directly from the loudspeaker prior to the arrival of any room reflections 164.

The direct portion of the impulse 161 between the onset 162 and first reflection 164 is copied to the modified impulse response 163 without alteration. The perceived distance of a loudspeaker is heavily influenced by the relative amplitude of the direct and reverberant portions of the impulse response, the closer the loudspeaker the greater the energy in the direct signal relative to the reflected signal. Since sound levels fall off by the inverse square of the distance from the source, if one was attempting to halve the perceived distance between the virtual and real loudspeakers then the reverberant portion would be attenuated by a factor of 4. Hence, the amplitude of the impulse response starting from the onset of the first room reflection 164 to the end of the room impulse response 165 is adjusted appropriately and copied to the modified impulse response 163. In this example the time between the end of direct portion 166 and the start of the first reflection 167 is artificially increased by padding-out the impulse samples with zeros. This simulates the fact that the relative arrival times of the direct and reverberant portions will increase the closer a subject gets to the loudspeaker sound source. To make a loudspeaker sound more distant the modification to the impulse is done in a reverse manner—the direct portion of the impulse is attenuated relative to the reverberant portion and the arrival time can be shortened by removing impulse samples just prior to the first reflection.

Adjusting Off-Center Listening Positions

Even when the same loudspeaker arrangement is maintained for both personalization and listening activities, virtual-real loudspeaker alignment may not be achieved if the listening position is not the same as that used to make the personalization measurements. This problem would typically arise when, for example, more than one person is listening to the music, or watching the movie, simultaneously—in which case one or more individuals could be positioned a short distance off the desired sweet-spot. Small positional errors such as these can be easily compensated for using the techniques described herein. First, an offset in the listening position relative to the measurement position can change the lateral and height coordinates of the real loudspeakers relative to the central viewing orientation—the degree of change being different for each loudspeaker and dependant on the magnitude of the listening position offset error. If the positions of the real loudspeakers are known, then to realign them with the virtual loudspeakers, an interpolator offset, $\omega v$ (or $\theta v$) is deployed separately for each loudspeaker using the method described herein. Second, the distance between the listener's head and the real loudspeakers may no longer match the perceived virtual distance. Since the original distances are known, being a by-product of the personalization measurements, the distance error for each virtual loudspeaker can be calculated and the respective room impulse response data modified using the techniques described herein to remove the discrepancy.

Head Movements that Fall Outside the Measured Scope

Disclosed herein are a number of methods that can be deployed to deal with situations were the listeners head movement exceeds the limits of the personalization measurement boundary, i.e., falls outside the scope of the head tracked de-rotation process, for example the dotted line 179 illustrated in FIG. 31. The most basic method simply freezes the interpolation process for any axis the head tracker indicates a breach of the boundary has occurred and holds the value until the head moves back into range. The effect of this method is that virtual loudspeaker images may possibly follow the head motion for orientations outside the scope but will stabilize once inside scope.

Another method permits the differential path length calculation process to continue to adapt outside the scope (eqn 31), leaving the impulse response interpolation fixed at the last value used prior to breaching the scope boundary. The effect of this method is that only the high frequencies emanating from the virtual loudspeakers are likely to move with the head outside scope.

A further method forces the amplitude of the virtualizer outputs to be attenuated outside the scope using some type of head position attenuation profile. This can be used in combination with any of the prior methods. The effect of the attenuation is to create an acoustical window, whereby sound comes from the virtual loudspeakers only when the user is looking in the vicinity of the personalized zone (scope). This method does not need to begin attenuating the audio immediately after the head crosses outside the scope boundary, for example, in the case where only lateral measurements have been made (as illustrated in FIGS. 29 and 30), it is desirable to allow significant deviations in elevation (pitch), i.e., above and below the measurement center line 179, before triggering the attenuation process. One psycho-acoustical benefit of the attenuation method is that it significantly reinforces the virtual sound stage since it minimizes the likelihood of the listener being subjected to the illusion diminishing effect of sound image rotation. Another benefit of the attenuation method is that it allows the user to easily control the volume applied the headphones, for example, by turning their head away from the movie screen the listener can effectively mute the headphones.

The final method involves extending the personalization scope artificially using room impulse response data associated with other virtual loudspeakers in the same personalized data set. The method is particularly useful for multi-channel surround sound type loudspeaker systems (FIG. 34*a*) where there are sufficient loudspeakers to permit a reasonably accurate virtualization experience over the full +/−180 degree head turn range. However, the method does not guarantee that the virtual loudspeakers will sonically match those of the real loudspeakers since, by extending the interpolation zone, it may be necessary to use room impulse response data measured using loudspeakers positioned in locations other than the one being virtualized.

Apart from sonic mismatches, the method is also problematic in that loudspeakers arranged in a surround sound system may not be positioned equidistant nor at the same elevation and thus where the personalization is conducted on a single lateral plane it may be difficult to retain an accurate alignment between the virtual and real loudspeakers as the listener's head moves through the extended scope. Where the personalization measurements include an elevation element then these height mismatches can be compensated for, dynamically as the head turns, using an interpolator offset as discussed earlier. Differences in loudspeaker distance can also be corrected dynamically, as the head rotates, using the techniques already discussed.

Figure 34B:
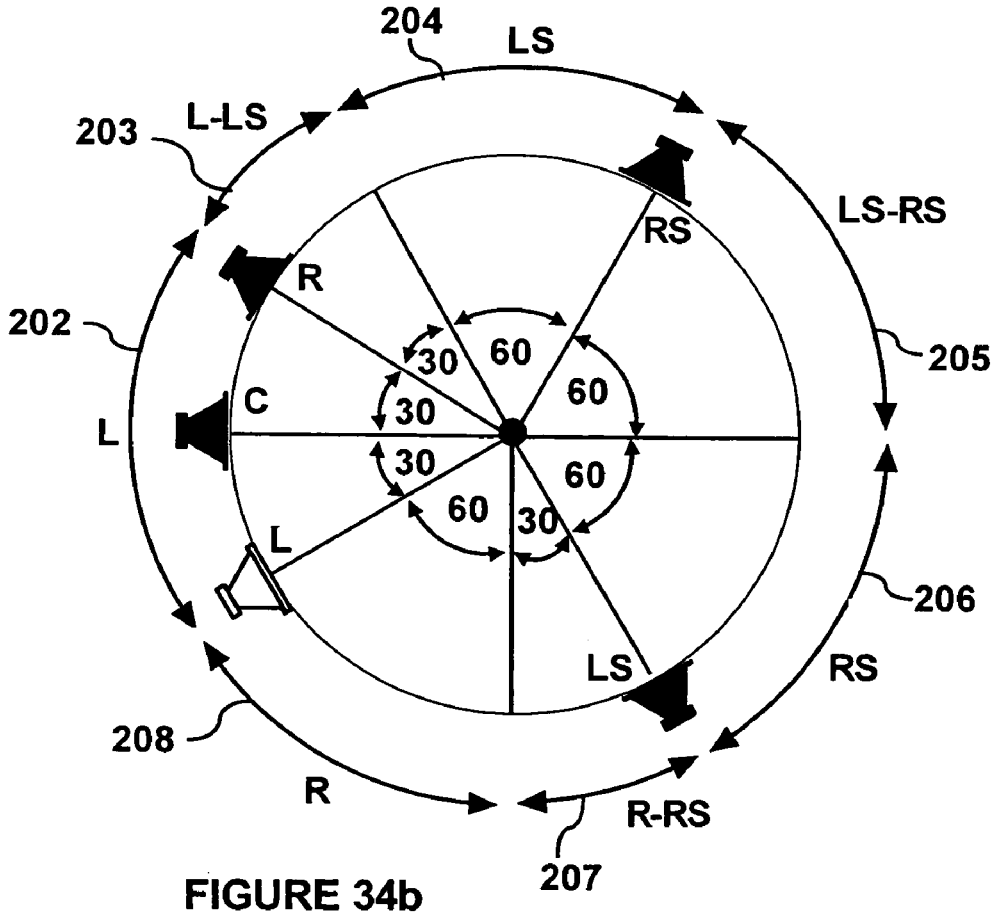

The method is illustrated in FIG. 34*b* using a common 5-channel surround sound loudspeaker format and depicts the various interpolation combinations that are deployed to virtualize the left front loudspeaker 200 (FIG. 34*a*) as the listener turns through 360 degrees. The illustration of FIG. 34*a* is a plan view and sets out the angular relationship between the listener 79, located in the center of imaginary circle 201, and the five loudspeakers, center 196, right front 197, right surround 198, left surround 199 and left front 200 positioned on imaginary circle 201. The front center loudspeaker 196 represents the 0 degree direction and is the direction the listener would take when viewing center screen. The left front loudspeaker 200 is positioned −30 degrees from center screen, right front loudspeaker 197 is +30 degrees from screen center, left surround loudspeaker 199 is −120 degrees from screen center and right surround loudspeaker 198 is +120 from screen center.

FIG. 34*b* assumes that personalization measurements have been carried out on a single lateral plane and that all five loudspeakers where measured for three viewing points consisting of the left front 200, screen center 196 and right front 197 loudspeakers respectively providing a scope of +/−30 degrees on the lateral plane (previously illustrated in FIG. 30). FIG. 34*b* depicts the combinations of personalized data sets 202, 203, 204, 205, 206, 207 and 208 used by the interpolator to virtualize the left front loudspeaker 200 as the listener's head moves through the full 360 degrees. Since the personalization measurements for all loudspeakers were made viewing the three front loudspeaker positions, then for head angles that stay within this range (+/−30 degrees from center screen) 202 the interpolator uses the three sets of room impulse responses measured using the real left front loudspeaker. This is the normal mode of operation.

When the head moves beyond the left front loudspeaker into the region −30 to −90 degrees 208, the interpolator can no longer use the left front loudspeaker data and the interpolator is forced to deploy the three sets of room response impulse data measured for the right front loudspeaker. In this case the head rotation angle input to the interpolator is offset clockwise by 60 degrees to force the right front loudspeaker impulse data to be correctly accessed as the head turns through this zone. If the sonic characteristics of the left and right front loudspeakers are similar and they are positioned at the same elevation, then the change over will be seamless and the user should not normally be aware of the loudspeaker data mismatch.

For head angles between −90 and −120 degrees 207, the virtualizer interpolates between the room impulse response data measured for the right loudspeaker when the user is looking at the left front loudspeaker, and the room impulse response data measured for the right surround loudspeaker when the user is looking at the right front loudspeaker.

For head angles between −120 and −180 degrees 206 the interpolator uses the three sets of room impulse response data measured for the right surround loudspeaker with the appropriate angular offset applied to the interpolator.

For head angles between 180 and 120 degrees 205, the virtualizer interpolates between the room impulse response data measured for the right surround loudspeaker looking at the left front loudspeaker, and the room impulse response data measured for the left surround loudspeaker looking at the right front loudspeaker.

For head angles between 120 and 60 degrees 204 the interpolator uses the three sets of room impulse response data measured for the left surround loudspeaker again with the appropriate angular offset applied to the interpolator.

For head angles between 60 and 30 degrees 203, the virtualizer interpolates between the room impulse response data measured for the left surround loudspeaker looking at the left front loudspeaker, and the room impulse response data measured for the left front loudspeaker looking at the right front loudspeaker. It will be apparent to those skilled in the art that the techniques just described and illustrated in FIG. F can easily be applied to entertainment systems with more or less loudspeakers and it can be applied to personalized data sets made using both lateral (yaw) and elevation (pitch) head orientations.

Mixing Personalized and Non-Personalized Room Impulse Responses

Experiments undertaken by the inventor strongly suggest that the accuracy of virtualization is highly dependant on the deployment of the listeners own personalized room impulse response (PRIR) data. However it has also been found that the loudspeakers that are ordinarily out of sight are less critical of the accuracy of the personalized data and indeed it is often possible to use non-personal room impulses, or those acquired using a dummy head, without serious loss of rear virtualization illusion. Therefore, combinations of personalized and non-personalized, or generic, room responses to virtualize multi-channel loudspeaker configurations may be employed. This mode of operation is likely where the user does not have time to make the necessary measurements, or where it is impractical to arrange the loudspeakers in the desired positions for measuring. Generic room impulse responses (GRIRs) take the same form as PRIRs, i.e., they represent a sparse sampling of a loudspeaker over a typical listener's head movement range or scope. Processing of the GRIR would also be similar, i.e., the inter-aural delays would be logged, the impulse waveforms time aligned and then the inter-aural delays reinstated using the variable delay buffer, and the interpolator generate intermediate impulse response data, driven dynamically by the listeners head position.

Automatic Level Adjustment for Personalized Measurement Procedure

Impulse response measurements made using the MLS technique become inaccurate in the presence of non-linearity in the recorded signals fed back to the circular cross-correlation processor. Non-linearity typically arises as a result of clipping at the analogue to digital conversion stage following the microphone amplifiers, or distortion in the loudspeaker transducer or loudspeaker amplifier as a result of overdriving. This implies that for robust MLS personalized room impulse response measurement methods it may be necessary to control the signals levels at each stage of the measurement chain during the measurement.

In one embodiment a MLS level scaling method that is used prior to each personalized measurement session is disclosed. Once the appropriate MLS level has been determined, the resulting scale factor is used to set the MLS volume level during all subsequent personalized measurements for the particular room-speaker setup and human subject. By using a single scale factor during the personalized room impulse response acquisitions, additional scaling or inter-aural level adjustments are unnecessary prior to their deployment in the virtualizer engine.

Figure 23:
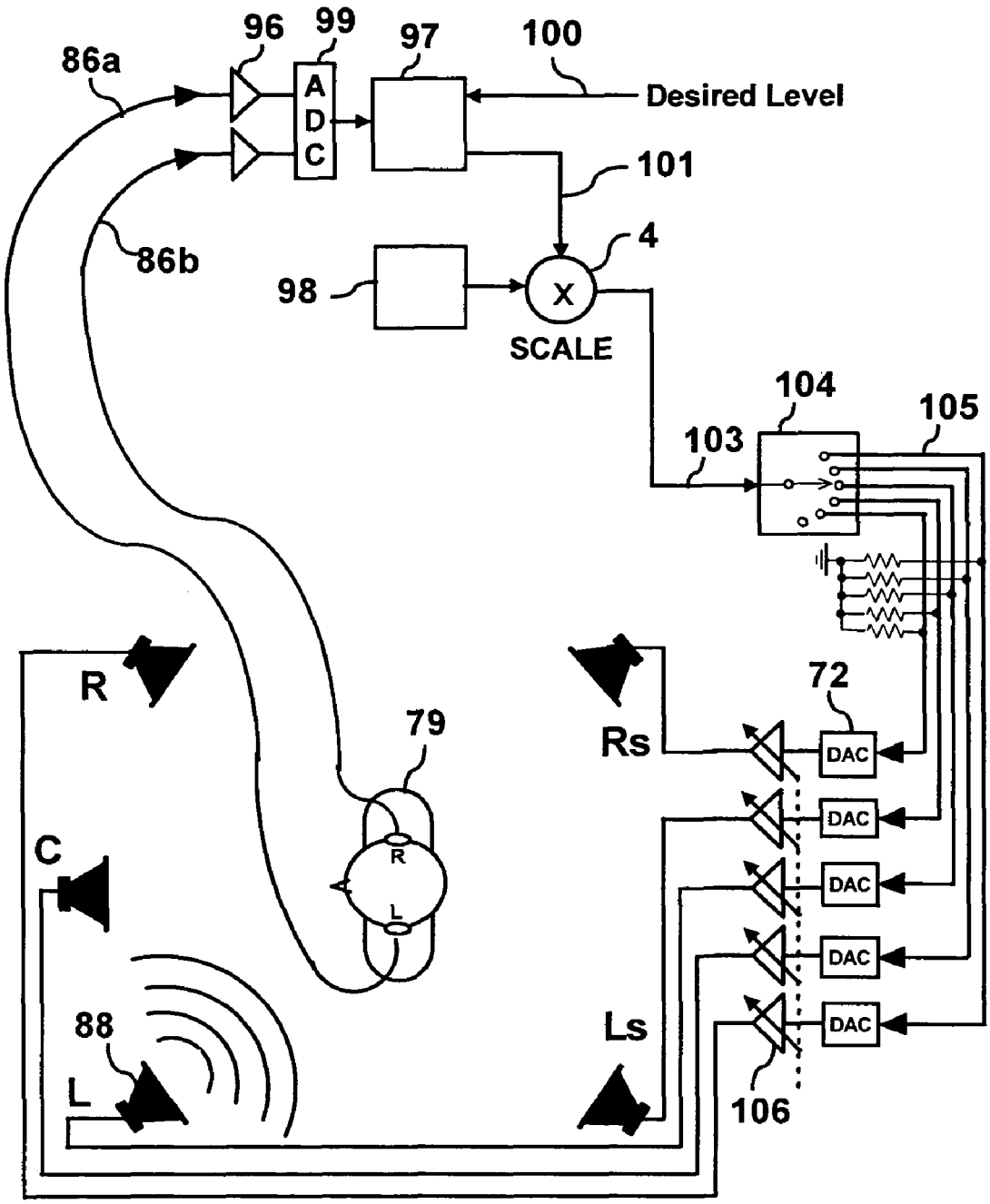
FIG. 23 is a plan view of human subject undergoing PRIR measurement where the recorded level of the excitation signal from the left front loudspeaker is scaled prior to commencement of the test.

FIG. 23 illustrates a typical 5-channel loudspeaker MLS personalization setup. The human subject (plan view) 79 is surrounded by five loudspeakers (also plan view), and is situated at the desired measurement point, looking towards the front center loudspeaker, and has mounted in each ear, microphones whose outputs are connected to microphone amplifiers 96. The MLS, output from 98, is scaled 4 by multiplying with scale factor 101. The adjusted MLS signal 103 is input to a 1-to-5 inverse multiplexer 104 whose outputs 105 each drive one of the five loudspeakers via digital-to-analogue converters 72 and variable gain power amplifiers 106. FIG. 23 specifically illustrates the MLS signal 98 being routed to the front left loudspeaker 88. The ear-mounted microphones pick up the MLS sound waves radiated by loudspeaker 88 and these signals are amplified 96 and digitized 99 and their peak amplitudes analyzed 97 and compared to a desired threshold level 100.

The test begins with the loudspeaker amplifier volume 106 set high enough to allow a full scale MLS signal presented by the loudspeakers to generate a sound pressure level at the ear mounted microphones that will result in a microphone signal level that will reach or exceed the desired threshold level 100. If there is any doubt, the volume is left at its maximum setting and is not adjusted again until all the personalized room impulse responses have been acquired. The level measurement routine begins with the MLS scaled to a relatively low level, say −50 dB. Since the MLS output from 98 is generated internally at digital peak level (i.e., 0 dB) this results in the MLS arriving at the DACs 50 dB below their digital clip level. The attenuated MLS is played out to just one loudspeaker, selected by 104, for a period long enough to allow the real-time measurement at 97 to reliably determine the peak level. In one embodiment a period of 0.25 seconds is used. This peak value at 97 is compared to a desired level 100 and if neither of the recorded MLS microphone signals is found to exceed this threshold, the scale factor attenuation is reduced slightly and the measurement repeated.

In one embodiment the scale factor attenuation is reduced in steps of 3 dB. This process of incrementally boosting the amplitude of the MLS drive to the loudspeakers and testing the resultant microphone pickup level continues until either of the microphone signals exceeds the desired level. Once the desired level has been reached, the scale factor 101 is retained for use in the actual personalization measurements. The MLS level test can be repeated for all loudspeakers to be subjected to the personalization measurement, by selecting alternative loudspeakers to test using 104. In this case the scale factors for each loudspeaker are held until all loudspeakers have been tested and the scale factor with the highest attenuation is retained for all subsequent personalization measurements.

To maximize the signal-to-noise ratio of the MLS derived personalized room impulse responses the desired level threshold 100 should be set close to the digital clip level. Normally however, it is set some way below clip to provide a margin for error. Moreover, if the MLS sound pressure level is uncomfortable for the human subject, or the measurement chain has insufficient gain such that there is a risk of overdriving the loudspeaker or amplifier, then this level may be reduced further.

The MLS level test is abandoned if the scale factor 101 reaches a value of 1.0 (0 dB) and the measured MLS level remains below the desired level 100. The test is also abandoned if the measured microphone levels do not increase in proportion to that of the scale factor iteration step. That is, if the scale factor attenuation is reduced by 3 dB at each step, then the microphone signal levels should increase by 3 dB. A fixed signal level on any microphone normally indicates a problem with the microphones, loudspeaker, amplifiers and/or their interconnections.

The discussion above has made reference to specific step sizes and threshold values. It will be appreciated that a wide range of step sizes and thresholds may be applied to the method without departing from the scope of this aspect of the invention.

Personalization Measurements Using Direct Loudspeaker Connection

Figure 26:
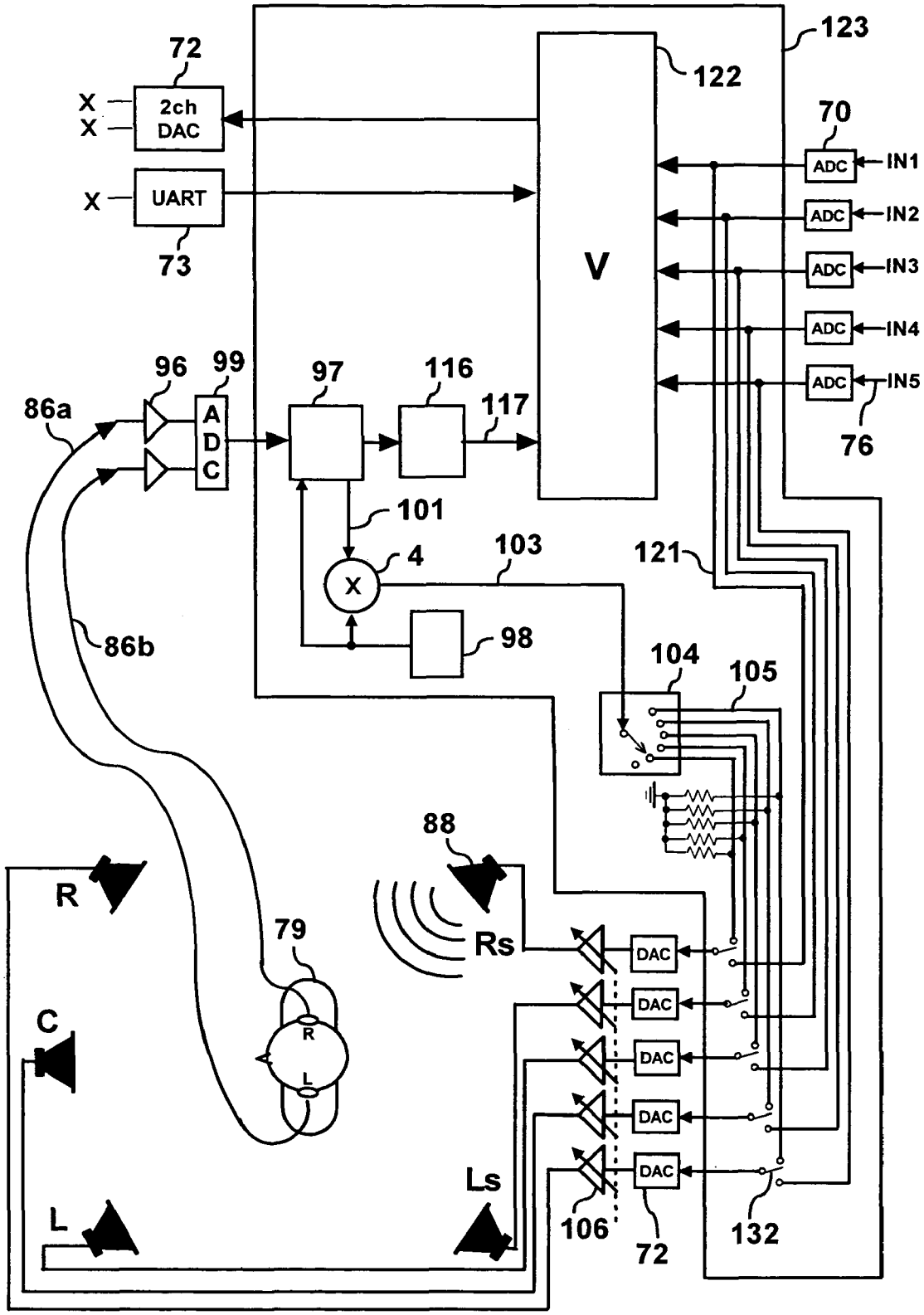
FIG. 26 is a plan view of human subject undergoing PRIR measurement of the right surround loudspeaker where the excitation signals are output directly to the loudspeakers.

Performing the personalized room impulse response (PRIR) measurements requires that an excitation signal be output through selected loudspeakers in real time and for the resulting room response to be recorded using ear mounted microphones. One embodiment uses the MLS technique for making these measurements and this signal is selectively switched into the DACs prior to the power amplification stages of a typical AV receiver design. A configuration that has direct access to the loudspeaker signal feeds is illustrated in FIG. 26. The multi-channel audio inputs 76 are input via analogue-to-digital converters (ADC) 70 and connect both to the headphone virtualizer 122 inputs and to a bank of 2-way digital switches 132. Ordinarily the switches 132 are set to allow the audio signals 121 to pass through to the digital-to-analogue (DAC) converters 72 and drive the loudspeakers via variable gain power amplifiers 106. This would be the normal mode of operation and gives the user the option of listening either to the audio over the loudspeakers or the headphones. However, when the user wishes to begin a personalization measurement the virtualizer 123 isolates the loudspeakers by changing over switches 132 and a scaled digital MLS signal 103 is routed 104 to one of the loudspeakers instead, with all the remaining loudspeakers feeds muted. The virtualizer can select different loudspeakers to test by changing the MLS routing 104. After all MLS tests are complete, switches 132 are typically reset to allow the audio signals 121 to again pass to the loudspeakers.

Personalization Measurements Using Outboard Processors

Certain product designs are envisaged that do not have access to the loudspeaker signal paths as described above, for example when the headphone virtualizer is designed as a separate out-board processor and the multi-channel audio signals are decoded from an incoming coded bit stream. In many cases it would be cost prohibitive to include separate outputs from the virtualizer processor that could be connected to an external line-level switching systems, as would be required to send MLSs out to selected loudspeakers. While it is possible to play the excitation signal from a CD or DVD disc, via a coded digital bit stream, it is inconvenient since it is not easy to interrupt the disc play once it begins. This would mean that simple tasks such as MLS level adjustments, head stabilization or skipping loudspeaker measurements are manually guided by the user, or assistant, dramatically increasing the difficulty and duration of the personalization process.

Figure 27:
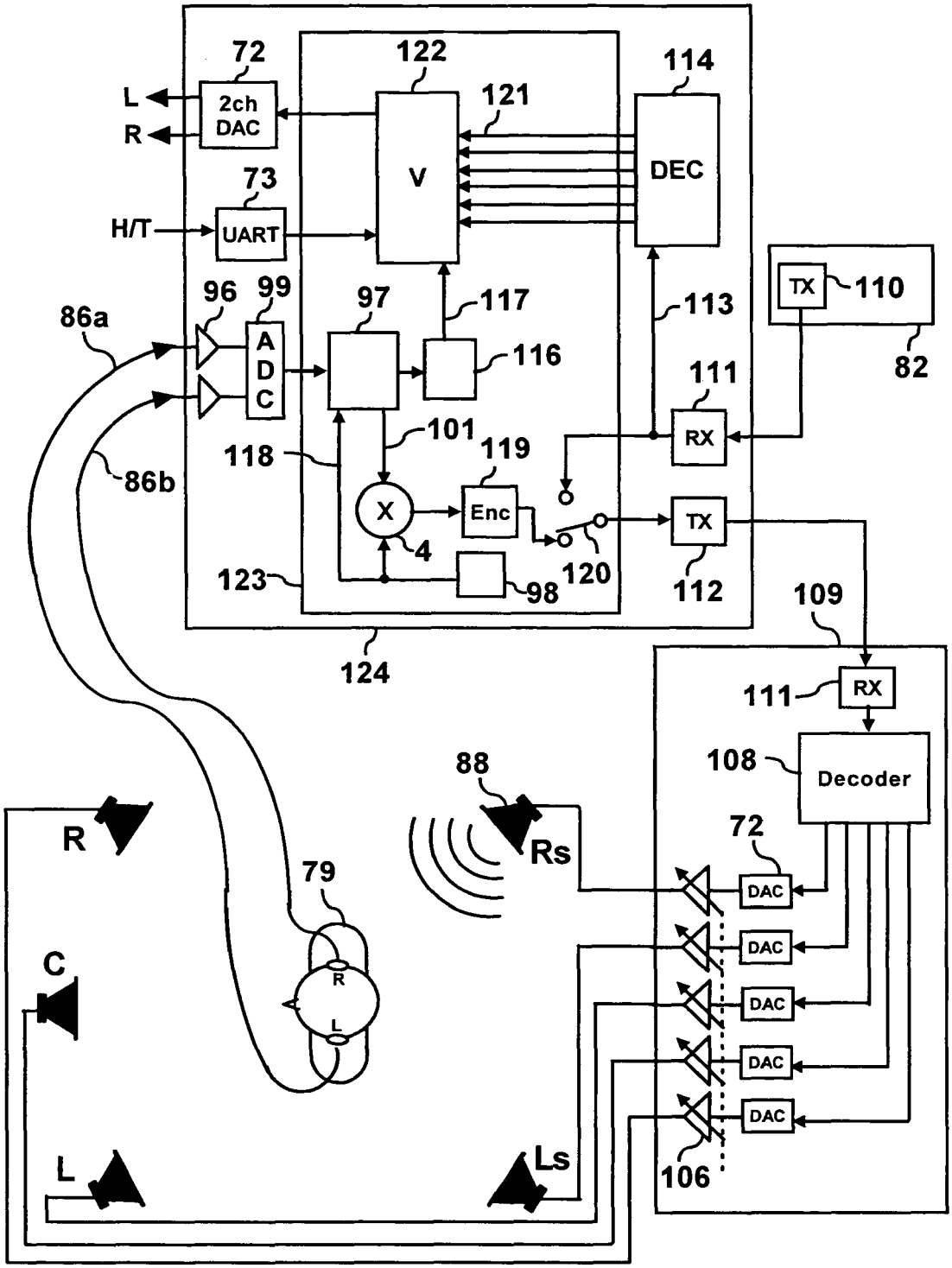
FIG. 27 is a plan view of human subject undergoing PRIR measurement of the right surround loudspeaker where the excitation signals are encoded and transmitted to a AV receiver prior to driving the loudspeakers.

Disclosed herein is a method that uses industry standard multi-channel coding systems to provide access to the loudspeakers in an AV receiver type design with minimal overhead and cost. Such a system is illustrated in FIG. 27. The headphone virtualizer 124 houses the virtualizer 123 complete with headphone, head tracker and microphone i/o 72, 73, 96 and 99, a multi-channel decoder 114 and S/PDIF receiver 111 and transmitter 112. An external DVD player 82 connects to 124 via a digital SPDIF connection, transmitted 110 from the DVD player and received by the virtualizer using an internal SPDIF receiver 111. This signal is passed to the internal multi-channel decoder 114 and the decoded audio signals 121 passed to the virtualizer core processor 122. Ordinarily the switch 120 is positioned to allow the SPDIF data from the DVD player to pass directly to an internal SPDIF transmitter 112 and on to the AV receiver 109. The AV receiver decodes the SPDIF data stream and the resulting decoded audio signals are output to the loudspeakers 88 via variable gain power amplifiers 106. This would be the normal mode of operation and gives the user the option of listening either to the audio over the loudspeakers or the headphones, without having to make any changes to the inter-equipment signal connections.

However, when the user wishes to begin a personalization measurement the virtualizer 123 isolates the SPDIF signal from the DVD player by changing over switch 120 and a coded MLS bit stream, output from multi-channel encoder 119, passes out to the AV receiver 109 instead. The generated MLS samples 98 are gain ranged 4 and 101 prior to their encoding 119. Since only one audio channel is measured at any one time, the MLS is directed by the virtualizer to that specific input channel of the multi-channel encoder the virtualizer wishes to measure. All other channels would ordinarily be muted. This has the advantage that the encoding bit allocation can concentrate the available bits solely to the channel carrying the MLS and so minimize the effects of the encoding system itself. The MLS encoded bit stream is transmitted in real time to the AV receiver 109 where the MLS is decoded to PCM using a compatible multi-channel decoder 108.

The PCM audio is output from the decoder and the MLS passes through to the desired excitation loudspeaker 88. Simultaneously, the human subject's 79 left and right ear-mounted microphones pick up the resulting sounds and relay them, 86*a* and 86*b* to the microphone amplifiers 96 for processing by the MLS cross-correlation process 97. All other loudspeakers will remain silent since their audio channels were muted during the encoding process 119. The method is reliant on the presence of a compatible multi-channel decoder within the AV receiver. Presently audio encoded using, e.g., the Dolby Digital, DTS (see, e.g., U.S. Pat. No. 5,978,762) or MPEG I methodologies can be decoded using the vast majority of existing consumer entertainment equipment. The method will work well with all three types of encoding, but all will introduce some distortion to the MLS or excitation waveform, leading to a slight reduction of PRIR fidelity. Nevertheless, the DTS and MPEG systems can operate at higher bit rates and have forward adaptive bit allocation systems that can be modified to better exploit the fact that only one audio channel is active, and so may alter the excitation waveform less than the Dolby system. Moreover, the DTS system provides up to 23-bit quantization and perfect-reconstruction in certain modes of operation and this may result in even lower excitation distortion levels over the MPEG system.

In FIG. 27 the MLS is generated 98, scaled 4 and then encoded 119 in real time on its way to the excitation loudspeaker. Another method is to hold in memory pre-encoded blocks of encoded MLS data, each representing a different excitation channel over a range of amplitudes. The encoded data need only represent a single MLS block, or small number of blocks, since they can be repeatedly output in a loop to the decoder during the MLS measurement. The benefit of this technique is that the computational loading is much lower, since all encoding has been done off-line. The disadvantage of the pre-encoded MLS method is that significant memory is required to store all the pre-encoded MLS data blocks. For example, a full bit rate DTS (1.536 Mbps) encoded 15-bit MLS block would require approximately 1 Mbit of storage for each channel and for each amplitude value.

Raw MLS blocks are not readily divisible by the encoding frame sizes offered by coding systems. For example, a bi-level 15-bit MLS comprises 32767 states, whereas coding frame size multiples of 384, 512, and 1536 samples are only available from MPEG I, DTS and Dolby respectively. Where it is desirable to play the encoded MLS blocks in a continuous end-to-end loop, an integer number of coding frames cover the MLS block sample length exactly. This implies that the MLS is first re-sampled in order to adjust its length so that is divisible by the coding frames. For example, the 32767 samples could be re-sampled to increase its length by one sample to 32768 and then encoded into 64 sequential DTS coded frames. The MLS cross-correlation processor then uses this same re-sampled waveform to effect the MLS de-convolution.

A way of avoiding having to store a range of pre-encoded MLS amplitudes for each loudspeaker is instead to alter the scale factor gains, associated with the encoded audio channel that carries the excitation audio, by directly manipulating the scale factor codes embedded in the bit stream, prior to sending it out to the AV receiver. Adjustment of the bit stream scale factors will proportionately affect the amplitude of the decoded excitation waveform with out loss of fidelity. Such a process would reduce the number of pre-encoded blocks to be stored to just a single block per loudspeaker. This technique is particularly applicable to DTS and MPEG encoded bit streams due to their forward adaptive nature.

A further variation in the method involves compiling the bit streams from their pre-encoded elements prior to each loudspeaker test. For example, since only one channel is active at any one time, then in theory it may be necessary only to store the bit stream elements for a single encoded excitation audio channel. For every loudspeaker the virtualizer wishes to test, the raw encoded excitation data is repacked into the desired bit stream channel slot, muting out all other channel slots, and the stream output to the AV receiver. This technique can also make use of the scale factor adjustment process just described. In theory all channels and all amplitudes can be represented by just a single 1 Mbit file, in the case of a full bit rate DTS stream format.

Although the MLS is one possible excitation signal, the method of using an industry standard multi-channel encoder, or pre-encoded bit streams, to carry the excitation signal to a remote decoder in order to simplify access to the loudspeakers, is equally applicable to other types of excitation waveforms such as impulses and sine waves.

Head Stabilization During Personalization Measurements

Background noise and head movement during the MLS based acquisition process both conspire to reduce the accuracy of the resultant personalized room impulse response (PRIR). Background noise directly affects the broadband signal-to-noise ratio of the impulse response data, but because it is uncorrelated to the MLS, it appears as random noise superimposed on each impulse response extracted from the cross-correlation process. By repeating the MLS measurement and maintaining a running average of the impulse response, the random noise will build up at half the rate of the impulse itself, thereby facilitating an improvement of the impulse signal-to-noise ratio for each new measurement. On the other hand, head movement, which causes a time smearing of the MLS waveform captured by each microphone, is not random, but correlated about an average head position.

The effect of smearing is to reduce the signal-to-noise ratio of the averaged impulse and to alter the response, particularly in the high frequency regions. This means that without direct intervention no amount of averaging will ever fully recover the high frequency information lost as a result of head movement. Experiments conducted by the inventor indicate that involuntary head movements, using human subjects familiar with the personalization process, result in changes in the path length between the microphone and the excitation loudspeaker to vary by up to approximately +/−3 mm, although the average variation will be much lower than this. At a sampling rate of 48 kHz this translates to about +/− half a sample period. In practice head movements measured with inexperienced subjects can be considerably greater.

Although it is possible to use some form of head support during measurements, for example a neck brace, or chin support, it is preferable to conduct the personalization measurements unsupported since this avoids the possibility of the support itself affecting the measured impulse response. On analysis significant head movements are primarily caused by the action of breathing and blood circulation and so are relatively low frequency and easy to track.

Disclosed herein are a number of alternative methods developed to improve the accuracy of acquired impulse response in the presence of head movement. The first involves identifying variations in the actual recorded MLS waveforms output from the left and right ear microphones caused by head movement. The advantage of this process is that it does not require any pilot or reference signal to implement the procedure, but its disadvantage is that the processing, necessary to measure the variations, can be intensive and/or may require the MLS signals to be stored in real-time and the processing conducted off-line. The analysis is conducted on a MLS block-by-block basis using a time or frequency based cross-correlation measure to establish the level of similarity between the incoming block waveforms. Blocks that are deemed similar to each other are kept for processing through the MLS cross-correlation. Those outside the acceptable limits are discarded. The correlation measure can use a running average of block waveforms, or it can use some type of median measure, or all MLS blocks can be cross-correlated with all others and those most similar retained for conversion to impulses.

Many alternate correlation techniques known in the art are equally applicable to driving this selection process. Rather than analyzing the MLS time waveform, another method involves analyzing the correlations between the resulting impulse responses output from the circular cross-correlation stage and adding, to the running average, only those impulse responses that are deemed to be sufficiently similar to some nominal impulse response associated with the desired head position. The selection process can be achieved in a similar way to that just described for the MLS waveform blocks. For example, for each individual impulse response, a cross-correlation measure could be made against all other impulses. This measure would indicate the similarity between responses. Again, there exists in the art, many ways to measure the similarity between impulses that would be applicable to this process. Impulses that show poor correlation with respect to all other impulses would be discarded. The remaining impulses would be added together to form the average impulse response. To reduce the computational load, it may be sufficient to measure the cross-correlation for selected portions of each impulse response, for example the early portion of the impulse response, and to use these simplified measures to drive the selection process.

The second method involves using some form of head tracking device that measures head movement while the MLS acquisitions are in progress. Head movement can be measured using head mounted trackers working in conjunction with the left and right-ear mounted microphones, for example a magnetic, gyroscopic, or optical type detector, or it can be measured using a camera pointing at the subjects head. Such forms of head tracking devices are well known in the art. The head movement readings are sent to the MLS processor 97 in order to drive the MLS block or impulse response selection procedure just described. Off-line processing is also possible by recording the head tracker data alongside the MLS recordings.

The third method involves the transmission of a pilot or reference signal that is output from a loudspeaker at the same time as the MLS to act as an acoustic head tracker. The pilot can be output from the same loudspeaker used to deliver the MLS, or it can be output from a second loudspeaker. The advantage of the pilot method over the traditional head tracked methods, in particular when the same loudspeaker is used to drive both the MLS and the pilot signal, is that no additional information regarding the MLS loudspeaker position relative to the head are required to estimate how the measured head movement will effect the left and right-ear microphone signals. For example, an MLS driven by a loudspeaker directly to the left of the human subject will be much less susceptible to head movement than an MLS emanating from a loudspeaker directly in front of the subject head. Therefore it may be necessary for a head tracked analyzer to know the angle that the MLS signal is incident to the head. Because the pilot and the MLS come from the same loudspeaker, head movement will have much the same effect on both signals.

Figure 24:
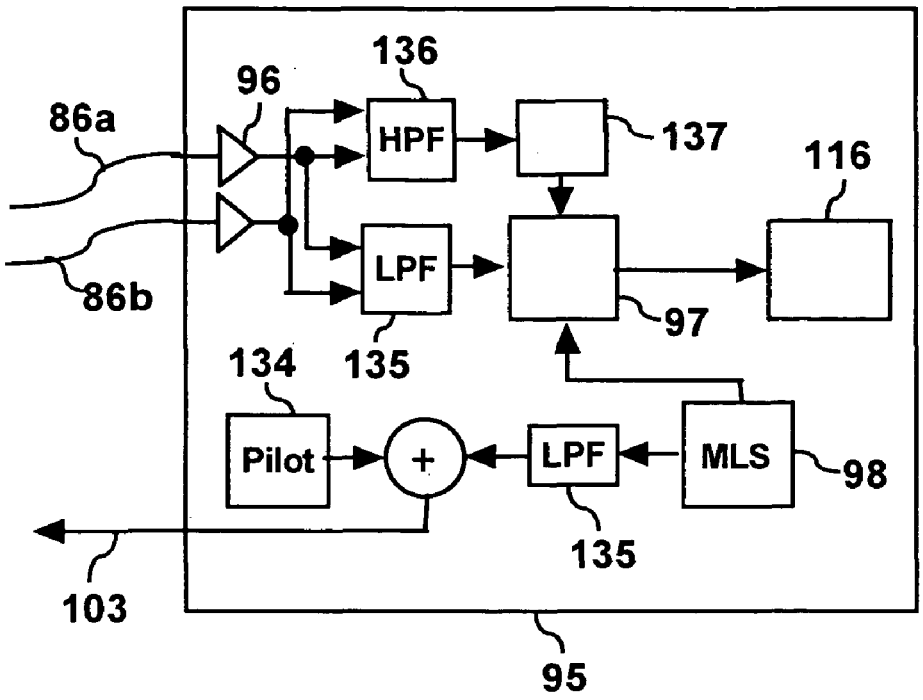
FIG. 24 is a block diagram of a MLS system that uses a pilot tone to detect excessive movements in the human subject head during PRIR measurements.

Another advantage of the pilot method is that no additional equipment is required to measure the head movements, since the same microphones acquire both the MLS and pilot signals simultaneously. Therefore in it simplest form, the pilot tone method permits a very straightforward analysis of the incoming MLS signals to be made and for appropriate action to be taken in real-time while the recordings are being acquired. FIG. 24 illustrates the pilot tone implementation where the MLS 98 is low pass filtered 135, summed with the pilot 134 and output 103 to a loudspeaker. The microphone outputs 86*a* and 86*b* are amplified 96, and since the MLS and pilot tone will appear together in the recorded waveforms each microphone signal, in order to separate out the MLS and tone components, pass through low-pass 135 and complementary high-pass 136 filters respectively. The characteristics of both MLS low-pass filters 135 would typically match.

Figure 25:
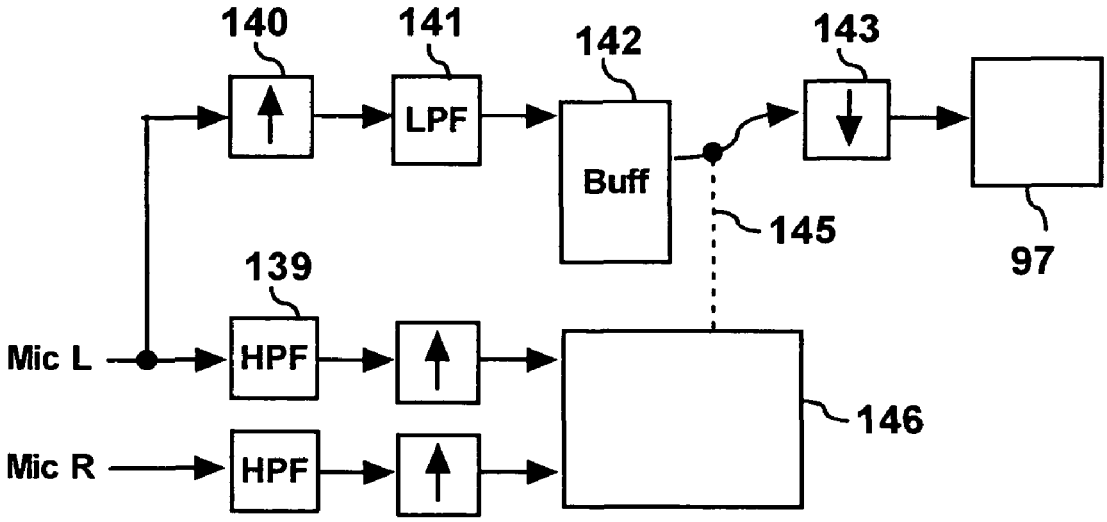
FIG. 25 is an extension of 24 were variations in the pilot tone phase are used to stretch or compress the recorded MLS signals in order to compensate for small head movements.

By over sampling the high-pass filtered pilot tones picked up by the left-ear and right-ear microphones and analyzing 137 their relative phase, or individual variations in their absolute phase, head movements down to fractions of a millimeter are easily detected. This information can be used to drive the selection process relating to the suitability of either the MLS waveform blocks or the resulting impulse responses, as described using the non-pilot-tone approach above. In addition, analysis of the pilot tone also permits a method that attempts to stretch or compress, in time, the recorded MLS signals in order to counteract the head movement. Such a method is illustrated in FIG. 25 for the MLS signal recorded by the left-ear microphone. The process can be conducted in real-time, as the signals arrive from the microphones, or the composite MLS-tone signal can be stored during the measurement for processing later off-line once the recording is complete.

Altering the waveform timing can be achieved by over sampling the MLS waveforms 141 arriving from the microphones and implementing a variable delay buffer 142 whose delay is determined by the phase analysis of the reference tones 146. A high degree over sampling 141 is desirable in order to ensure that the action of stretching or compressing the MLS time waveform does not, in itself, introduce significant levels of distortion into the MLS signals, which would then translate into errors in the subsequent impulse responses. The variable delay buffer 142 technique described herein is well known in the art. To ensure that both the over sampled MLS and left and right-ear pilot tones remain time aligned it may be preferable to use the same over sampling anti-aliasing filters for both pilot and MLS signals. Analysis of the over sampled pilot tone phases 146 are used to implement a variable buffer output address pointer 145. The action of changing the pointer output position with respect to the input causes the effective delay of the passage of MLS samples through the buffer 142 to change. Samples read out of the buffer are down sampled 143 and input to the normal MLS cross-correlation processor 97 for conversion to impulse responses.

The MLS waveform stretch-compression process can also use a head tracker signal to drive the over sampled buffer output pointer position. In this case, it may be necessary to know, or estimate, the head position relative to the MLS loudspeaker position in order to estimate the change in path length between the MLS loudspeaker and the left and right-ear microphones, that would occur as a result of the head movement detected by the tracker device.

Equalization of Headphone

The personalization process desires to measure the transfer function from the loudspeaker to the ear mounted microphones. With the resulting PRIR, audio signals can be filtered or virtualized using this transfer function. If these filtered audio signals can be converted back to sound and driven into the ear cavity, close to where the microphones were located that captured the original measurement, then the human subject will perceive the sound to come from the loudspeaker. Headphones are a convenient way of reproducing this sound in the vicinity of the ear but all headphones exhibit some additional filtering of their own. That is, the transfer function from the headphone to the ear is not flat and this additional filtering is compensated for, or equalized, to ensure the virtual loudspeaker fidelity matches that of the real loudspeaker as closely as possible.

In one embodiment of the invention the MLS deconvolution technique is used, as discussed previously in connection to the PRIR measurements, to make a one-time measurement of the headphone-to-ear-mounted-microphone impulse response. This impulse response is then inverted and used as a headphone equalization filter. By convolving the headphone audio signals, present at the output of the virtualizer with this equalization filter, the effect of the headphone-ear transfer functions are effectively cancelled, or equalized, and the signals will arrive at the microphone pick up point with a flat response. It is preferable to calculate an inverse filter for each ear separately, but averaging the left and right-ear response is also possible. Once the inverse filters have been calculated they can be implemented as separate real-time equalization filters located anywhere along the virtualizer signal chain, for example at the outputs. Alternately they can be used to pre-emphasize the time aligned PRIR data sets used by the PRIR interpolator, i.e., they are used on a one-off basis to filter the PRIRs during virtualizer initialization.

Figure 22:
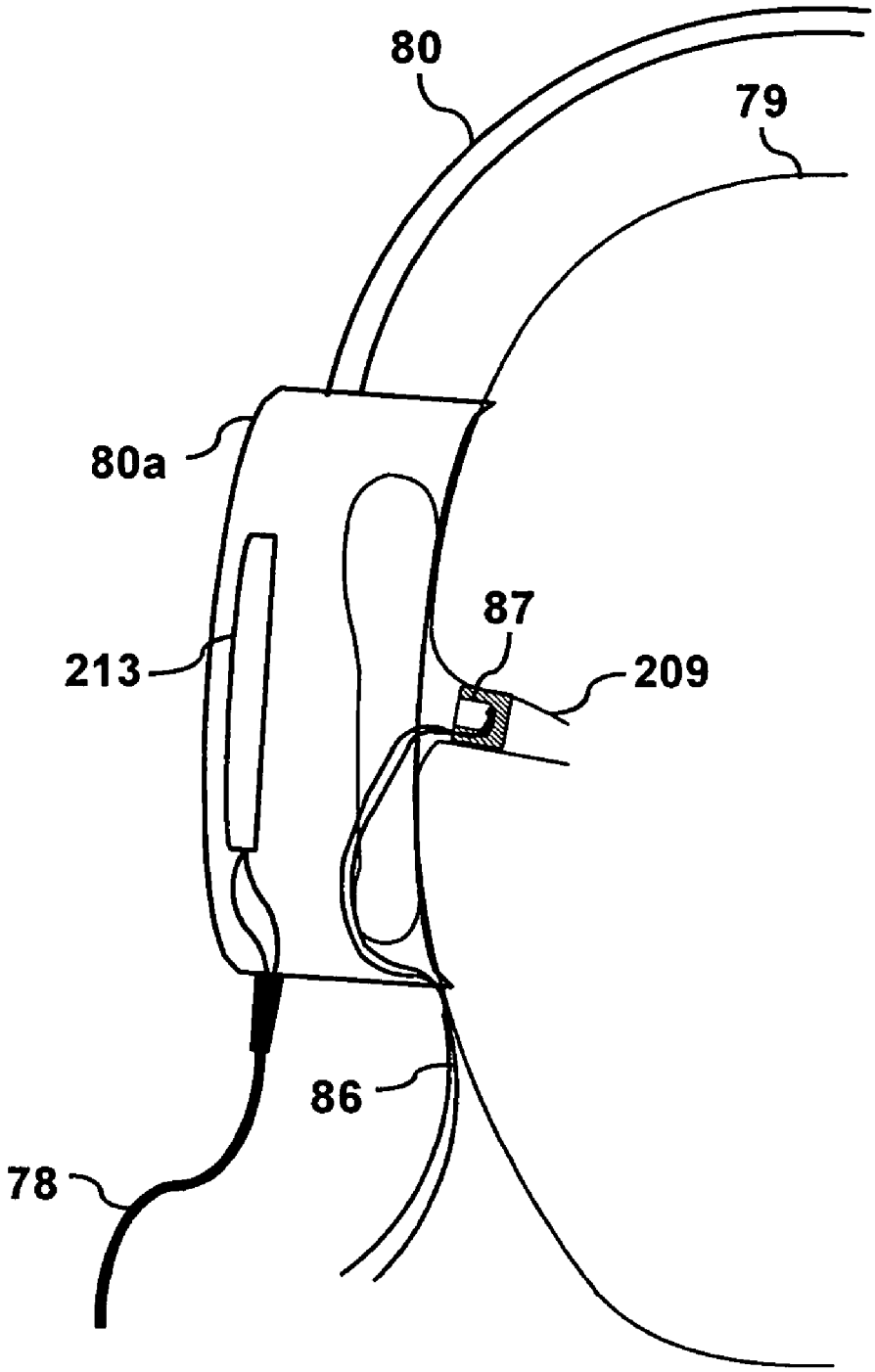
FIG. 22 is a sketch of a human subject wearing a headphone over a miniature microphone mounted in their ear canal.

FIG. 22 illustrates the placement of an ear-mounted microphone 87 in conjunction with the fitting of headphones 80 on human subject 79. The same applies for both ears. The microphone is mounted in the ear canal 209 in the same way as it is for the personalization measurements and in approximately the same location. Indeed to ensure the greatest accuracy it is preferable both left-ear and right-ear microphones remain in the ears after the personalization measurements are complete and for the headphone equalization measurement to proceed immediately following. FIG. 22 shows the microphone cables 86 having to pass underneath the headphone cushion 80*a* and to maintain a good headphone-to-head seal these cables should be flexible and of low weight. The headphone transducer 213 is driven by the MLS signal via headphone cable 78.

Figure 35:
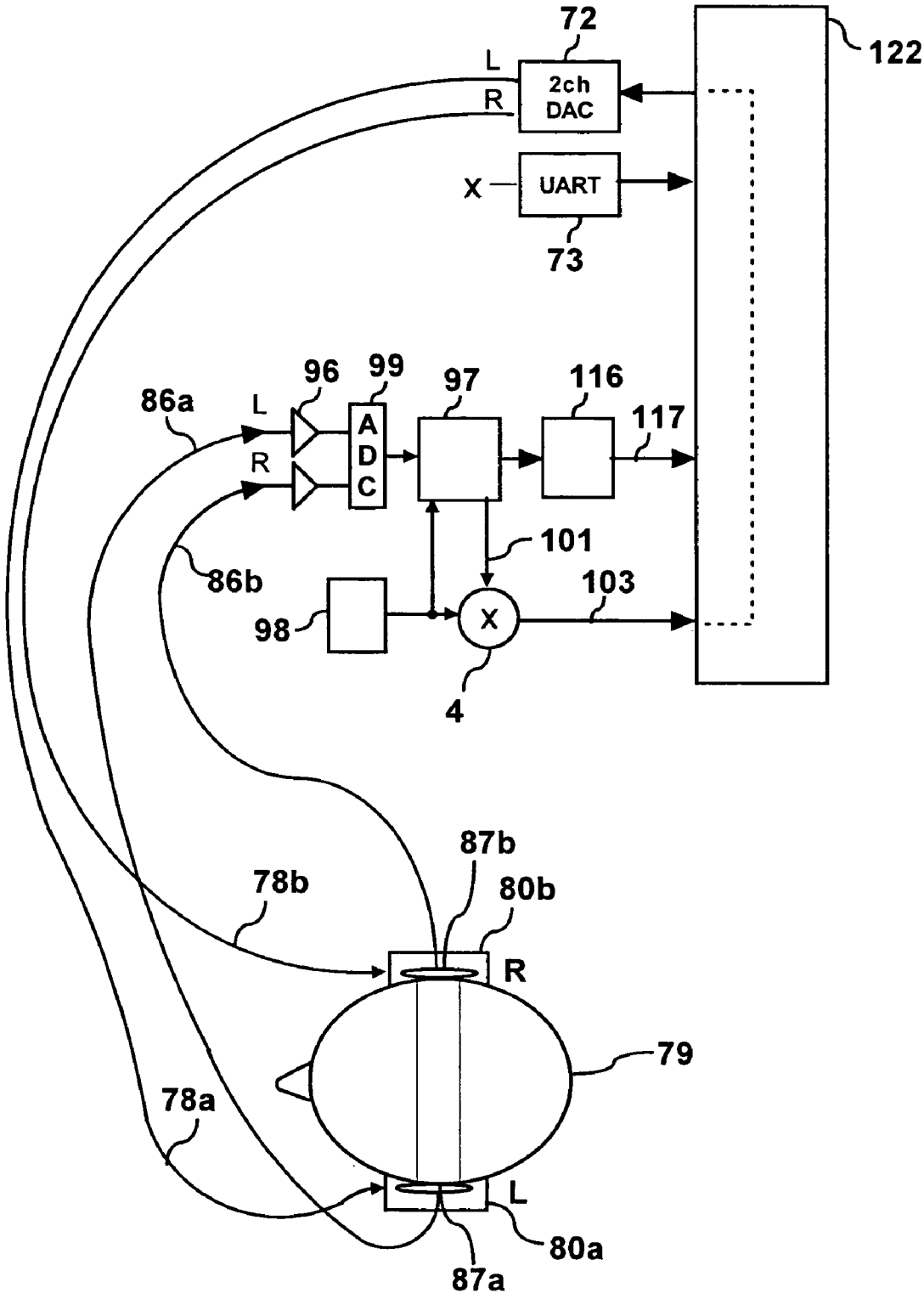
FIG. 35 illustrates a plan view of human subject undergoing a headphone equalization measurement and the connections to related processing blocks.

FIG. 35 illustrates the application of the personalization circuitry to the headphone MLS equalization measurement. The MLS generation 98, gain ranging 101 and 4, microphone amplification 96, digitization 99, cross correlation 97 and impulse-averaging processes are identical to those used for the personalization measurements. However the scaled MLS signal 103 does not drive the loudspeaker but rather is redirected to the stereo headphone output circuits 72 in order to drive the headphone transducers. The MLS measurement is conducted separately for both left-ear and right-ear headphone transducers to avoid the possibility of cross talk occurring between them if conducted simultaneously. The illustration shows a human subject 79 with microphones mounted in their left ear 87*a* and right ear 87*b*. The microphones signals 86*a* and 86*b* respectively, are connected to the microphone amplifiers 96. The subject is also wearing a stereo headphone where the left ear transducer is driven from the left headphone output 80*a* via cable 78*a* and the right transducer from the right output via cable 78*b*.

In one embodiment, the procedure for acquiring the headphone-microphone impulse responses is as follows. First the gain 101 of the MLS signal sent to the headphone is determined by analyzing the amplitude of the signals being picked up by the microphones using the same iterative approach described for the personalization measurements. The gain is measured separately for both left and right-ear circuits and the lowest gains scale factor 101 is retained and used for both MLS measurements. This ensures that amplitude differences between left and right ear impulse responses are retained. However any differences in the left or right-ear headphone transducers or the headphone drive gains will reduce the accuracy of this measurement. The MLS test then begins, starting with the left ear followed by the right ear. The MLS is output to the headphone transducer and picked up by the respective microphone in real time. As with the personalization procedure, the digitized microphone signals 99 can be stored for processing later, or the cross-correlation and impulse averaging can proceed in real time—depending on the available processing power. On completion both left and right impulse responses are time aligned and transferred 117 to the virtualizer 122 for inversion. Time alignment ensures that the headphone transducer-to-ear path lengths are symmetrical for both sides of the head. The alignment process can follow the same method described for the PRIRs.

The headphone-ear impulse responses can be inverted using a number of filter inversion techniques that are well known in the art. The most straightforward approach, and one that is used in an embodiment, converts the impulse to the frequency domain, removes the phase information, inverts the amplitude of modulus frequency components and then converts back to the time domain, resulting in a linear phase inverse impulse response. Typically the original response will be smoothed or dithered at certain frequencies to mitigate the effects of strong poles and zeros during the inversion calculation. While the inversion process will often be conducted on the separate impulse responses it is important to ensure that the relative gains between the two impulse responses are inverted correctly. This is complicated by the action of spectral smoothing and it may be necessary to recalibrate the lower frequencies amplitudes to ensure the left-right inverse balance is retained for the frequencies of interest.

Since the inverse filters are optimized for the type of headphone used to drive out the MLS and to the particular individual that wore them, the coefficients would typically be stored alongside some type of information that makes note of the headphone make and model, and also of the person involved in the test. In addition, since the position of the microphones may have been used in a personalization measurement session, information relating to this association could be stored also, for retrieval later.

Equalization of Loudspeakers

Since an embodiment of the invention has built into it an apparatus for measuring the transfer function between a loudspeaker and a microphone and for inverting such a transfer functions, a useful extension of this embodiment is to provide a means to measure the frequency response of the real loudspeaker, generate an inverse filter and then use these filters to equalize the virtual loudspeakers signals such that their apparent fidelity may be improved over the real loudspeakers.

By equalizing the virtual loudspeakers the headphone system is no longer attempting to match the sonic fidelity of the real loudspeakers, but instead is attempting to improve on the fidelity while retaining their spatiality with respect to the listener. This process is useful when, for example, the loudspeakers are of low quality and it is desirable to improve their frequency range. The equalization method could be applied to just those loudspeakers that are suspected of under performing, or it could be applied routinely to all virtual loudspeakers.

The loudspeaker to microphone transfer function can be measured in much the same way as those of the personalized PRIRs. In this application only one microphone is used and this microphone is not mounted in the ear but positioned in free space close to where the listener's head would occupy while watching movies or listening to music. Typically the microphone would be secured to some form of stand mounted boom arm so that it can be fixed at head height while the MLS measurement is made.

The MLS measurement process first selects the loudspeaker that will receive the MLS signal, as per the personalization method. It then establishes the necessary scale factor that properly scales the MLS signal output to this loudspeaker and proceeds to acquire the impulse response, again in the same way as the personalization method. In the case of the PRIRs the extended room reverberation response tail is retained with the direct impulse and used to convolve the audio signals. However in this case it is only the direct portion of the impulse response that is used to calculate the inverse filter. The direct portion normally covers a time period of about 1 to 10 ms following the onset of the impulse and represents that part of the incident sound wave that reaches the microphone prior to any significant room reflections. Hence the raw MLS derived impulse response is truncated and then applied to the inverse procedure described for the headphone equalization procedure. As with the headphone equalization, it may be desirable to smooth the frequency response to mitigate the effects of strong poles or zeros. Again, as with the headphone case, special care should be taken to ensure that the inter virtual-loudspeaker balance is not altered by the inversion processes, and it may be necessary to recalibrate these values prior to finalizing the inverse filters.

Virtual loudspeaker equalization filters can be calculated for each individual loudspeaker, or some average of many loudspeakers can be used for all virtual loudspeakers or any combination thereof. Virtual loudspeaker equalization filtering can be implemented using real time filters at the input to the virtualizer or at the virtualizer outputs or through a one-off pre-emphasis of the time aligned PRIRs (in conjunction with any desired headphone equalization) that are associated with those virtual loudspeakers.

Sub-Band Virtualization

One feature of an embodiment of the headphone virtualization process is the filtering, or convolution, of the incoming audio signals that represent the real loudspeaker signal feed, with the personalized room impulse responses (PRIR). For every loudspeaker to be virtualized it may be necessary to convolve the corresponding input signal with both left-ear and right-ear PRIRs giving a left-ear and right-ear stereo headphone feed. For example in many applications a 6-loudspeaker headphone virtualizer would run 12 convolution processes simultaneously and in real time. Typical living rooms exhibit a reverberation time of about 0.3 seconds. This means that at a sampling frequency of 48 kHz ideally each PRIR will comprise at least 14000 samples. For a 6-loudspeaker system that implements simple time domain non-recursive filtering (FIR) the number of convolution multiply/accumulate operations per second is 14000*48000*2*6 or 8.064 billion operations per second.

Such a computational requirement is beyond all low-cost digital signal processors known today and so it may be necessary to devise a more efficient method for implementing the real-time virtualization convolution processing. There exist in the art a number of such implementations based on the principle of FFT convolution, as described for example in Gardner W. G., "Efficient convolution without input-output delay," J. Audio Eng. Soc., vol. 43 no. 3, March 1995. One of the drawbacks of FFT convolution is that there is an implied latency, or delay to the process, due to the high frequency resolution involved. Large latencies are usually undesirable, especially when it is a requirement that the listener's head motion be tracked, and for any changes to modify the PRIR data used by the convolvers so that the virtual sound sources may be de-rotated to counteract such head movement. By definition, if the convolution process has a high latency, the same latency will appear in the de-rotation adaptation loop and could result in a noticeable time lag between the listener moving their head and the virtual loudspeaker locations being corrected.

Disclosed herein is an efficient convolution method that uses sub-band filter banks to implement frequency domain sub-band convolvers. Sub-band filter banks are well known in the art and their implementation will not be discussed in detail. The method leads to a significant reduction in the computational load while retaining a high level of signal fidelity and low processing latency. Medium order sub-band filter banks exhibit a relatively low latency, usually in the region of 10 ms, but as a consequence exhibit low frequency resolution. Low frequency resolution in sub-band filter banks manifests as inter-sub-band leakage and in traditional critically sampled designs this leads to a high reliance on alias cancellation to maintain signal fidelity. Sub-band convolution however, by definition, may cause large shifts in amplitude between sub-bands resulting often in a complete breakdown in the alias cancellation in the overlap regions and with it detrimental changes in the reconstruction properties of the synthesis filter bank.

But the alias problem may be alleviated through the use a class of filter banks known as over-sampling sub-band filter banks that avoid folding back the signal leakage in the vicinity of the overlap. Over sampling filter banks do exhibit some disadvantages. First the sub-band sampling rate, by definition, is higher than the critically sampled case and therefore the computational load is proportionately higher. Second the higher sampling rate means that the sub-band PRIR files will also contain proportionately more samples. Hence sub-band convolution computations will increase by the square of the over-sampling factor compared to the critically sampled counterparts. Over-sampling sub-band filter bank theory is also well known in the art (see, e.g., Vaidyanatham, P. P., "Multirate systems and filter banks," Signal processing series, Prentice Hall, January 1992), and only those details specific to understanding of the convolution method will be discussed.

Sub-band virtualization is a process whereby the convolution, or filtering, operates independently within the filter bank sub-bands. In one embodiment, the steps to achieving this include:

1) the PRIR samples pass through the sub-band analysis filter bank as a one-off process, giving a set of smaller sub-band PRIRs;
2) the audio signal is split into sub-bands using the same analysis filter bank;
3) each sub-band PRIR is used to filter the corresponding audio sub-band signal;
4) the filtered audio sub-band signals are reconstructed back into the time domain using the synthesis filter bank.

Depending on the number of sub-bands used in the filter bank, sub-band convolution has a significantly lower computational loading. For example, a 2-band critically sampled filter bank splits the 48 kHz sampled audio signals into two sub-bands each of 24 kHz sampling. The same filter bank is used to split the 14000-sample PRIR into two sub-band PRIRs of 7000 samples each. Using the example above, the computational load is now 7000*24000*2*2*6 or 4.032 billion operations, i.e., a reduction by a factor of 2. Hence for critically sampled filter banks, the reduction factor is simply equal to the number of sub-bands. For over-sampling filter banks the sub-band convolution gain, compared to critically sampled sub-band convolution, is reduced by the square of the over-sampling ratio, i.e., for 2× over sampling only filter banks of 8 bands and above offer a reduction over simple time domain convolution. Over-sampled filter banks are not constrained to integer over-sampling factors and typically can produce high signal fidelity using over-sampling factors in the region of 1.4× i.e., a computational improvement of approximately 2.0 over a 2× filter bank.

The benefits of non-integer over-sampling are not just confined to computational loading. The lower over-sampling rate also reduces the size of the sub-band PRIR files and this in turn reduces the PRIR interpolation compute loading. The most efficient implementations of non-integer over-sampled filter banks are often implemented using a real-complex-real signal flow, meaning that sub-bands signals will be complex (real and imaginary), as opposed to real. In such cases complex convolution is used to implement the sub-band PRIR filtering, requiring complex multiplications and additions which in certain digital signal processors architectures may not be efficiently implemented compared to real number arithmetic. This class of non-integer over-sampled filter banks are well known in the art (see, e.g., Cvetkovi Z., Vetterli M., "Oversampled filter banks," IEEE Trans. Signal Processing, vol. 46, no. 5, at 1245-55 (May 1998)).

Figure 19:
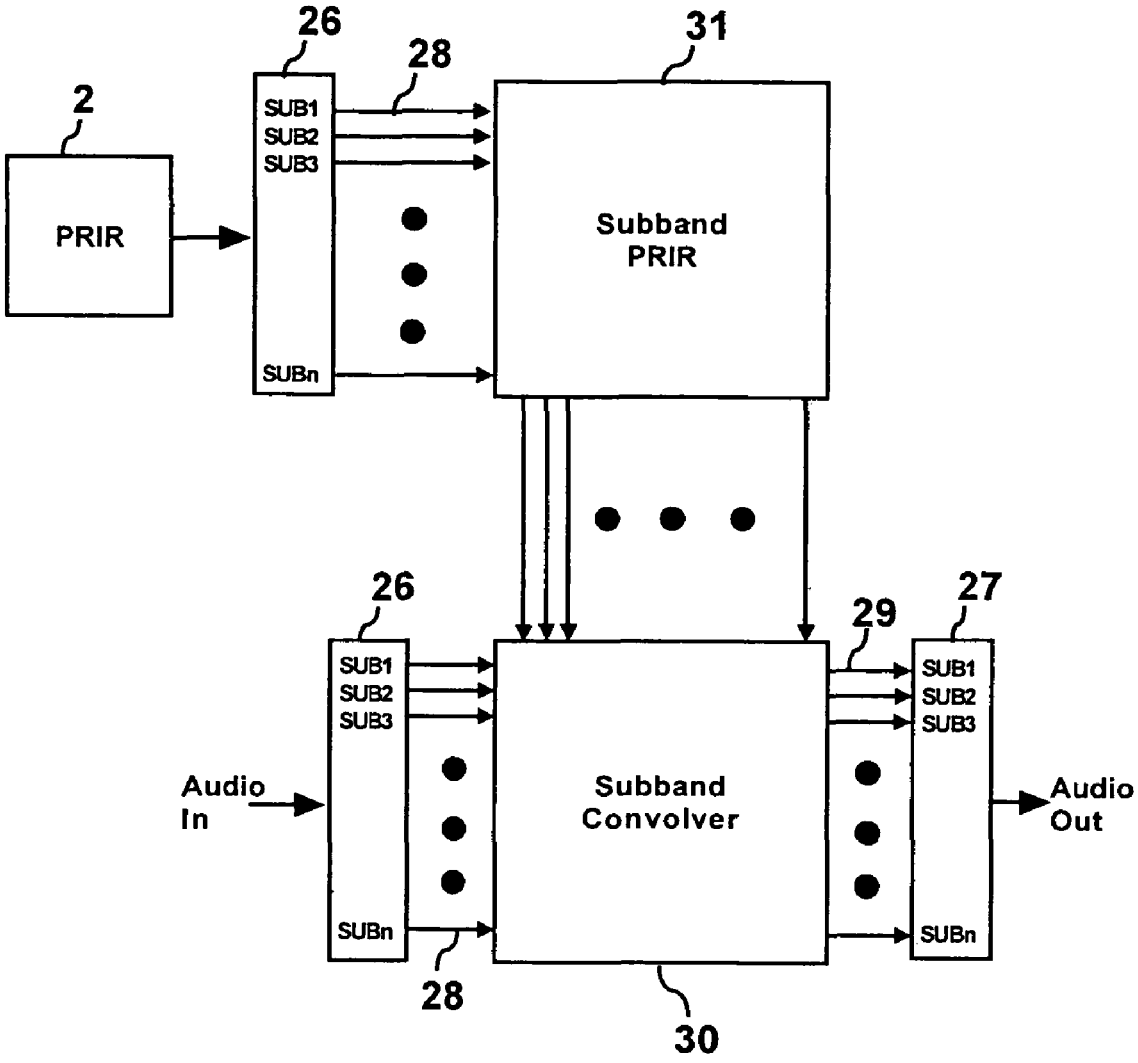
FIG. 19 is a block diagram of the concept of sub-band convolution.

The method of sub-band virtualization is illustrated in FIG. 19. First the PRIR data file is split into a number of sub-bands using an analysis filter bank 26 and the individual sub-band PRIR files 28 are stored 31 for use by the sub-band convolvers 30. The input audio signal is then split using a similar analysis filter bank 26 and the sub-band audio signals enter the sub-band convolver 30 that filters all the audio sub-bands with their respective sub-band PRIRs. The sub-band convolver outputs 29 are then reconstructed using a synthesis filter bank 27 to output a full band time domain virtualized audio signal.

Prototype low pass filters that exist in the art are designed to control the sub-band pass, transition, and stop band response such that the reconstruction amplitude ripple is minimized, and in the case of critically sampled filter banks, the alias cancellation maximized. Fundamentally they are designed to exhibit 3 dB attenuation at the sub-band overlap frequency. As a result, the analysis and synthesis filters combine to leave the transition frequencies 6 dB down from pass band. On summing the sub-band overlap zones add to 0 dB leaving the final signal effectively ripple free across its entire pass band. However, the action of convolving one sub-band with another sub-band prior to the synthesis filter bank leads to an overlap ripple with a peak of 3 dB since the audio signal has effectively passed through the prototype not twice but three times.

Figure 14A:
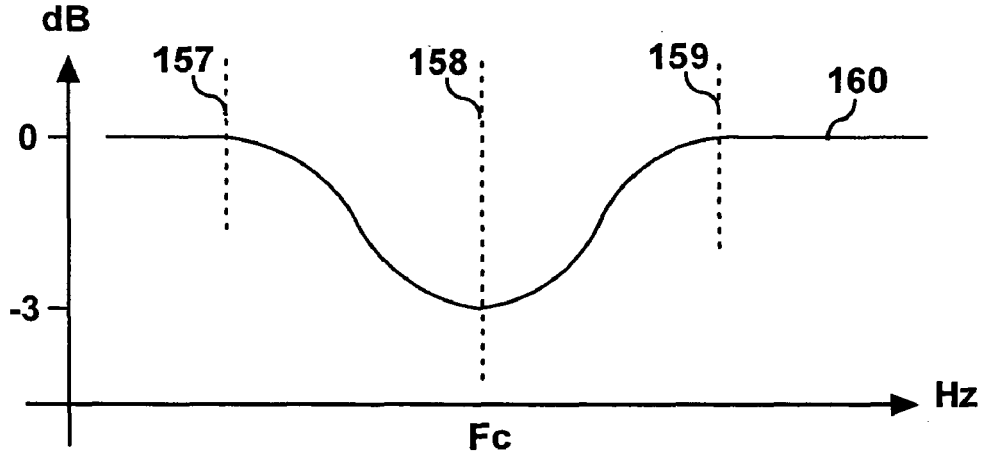
FIGS. 14*a* and 14*b* illustrate the 3 dB ripple effect of uncompensated sub-band convolution.
Figure 14B:
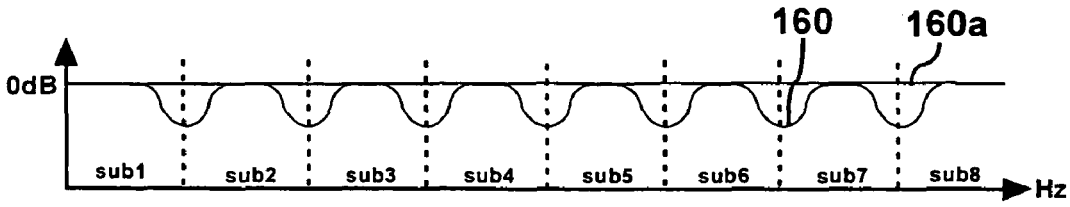

FIG. 14*a* illustrates an example of the ripple 160 that ordinarily occurs between any two adjacent sub-bands on reconstruction. The overlap, or transition, frequency 158 coincides with the maximum attenuation and depending on the specification of the prototype filters, this will be in the region of −3 dB. Either side of the transition 157 and 159 the ripple symmetrically reduces to 0 dB. Typically the bandwidth between these points is in the region 200-300 Hz. By way of example FIG. 14*b* illustrates the resulting ripple that might be present in the reconstructed audio signal having passed through a 8-band sub-band convolver.

A number of methods are disclosed herein to remove this ripple 160 and restore a flat response 160*a*. First, since the ripple is purely an amplitude distortion, it can be equalized by passing the reconstructed signal through an FIR filter whose frequency response is the inverse of the ripple. The same inverse filter could be used to pre-emphasize the input signal or the PRIRs themselves prior to the filter bank. Second, the analysis prototype filter used to split the PRIR files could be modified to decrease the transition attenuation to 0 dB. Third, a prototype filter with a transition attenuation of 2 dB could be designed for both the audio and PRIR filter banks giving a combined attenuation of 6 dB. Forth, the sub-band signals themselves could be filtered using a sub-band FIR filter with the appropriate inverse response, either prior to, or following the convolution stages. Redesigning the prototype filters may be preferable because increases in the overall system latency can be avoided. It will be appreciated that the ripple distortion can be equalized in a number of ways without departing from the spirit and scope of the invention.

Figure 36:
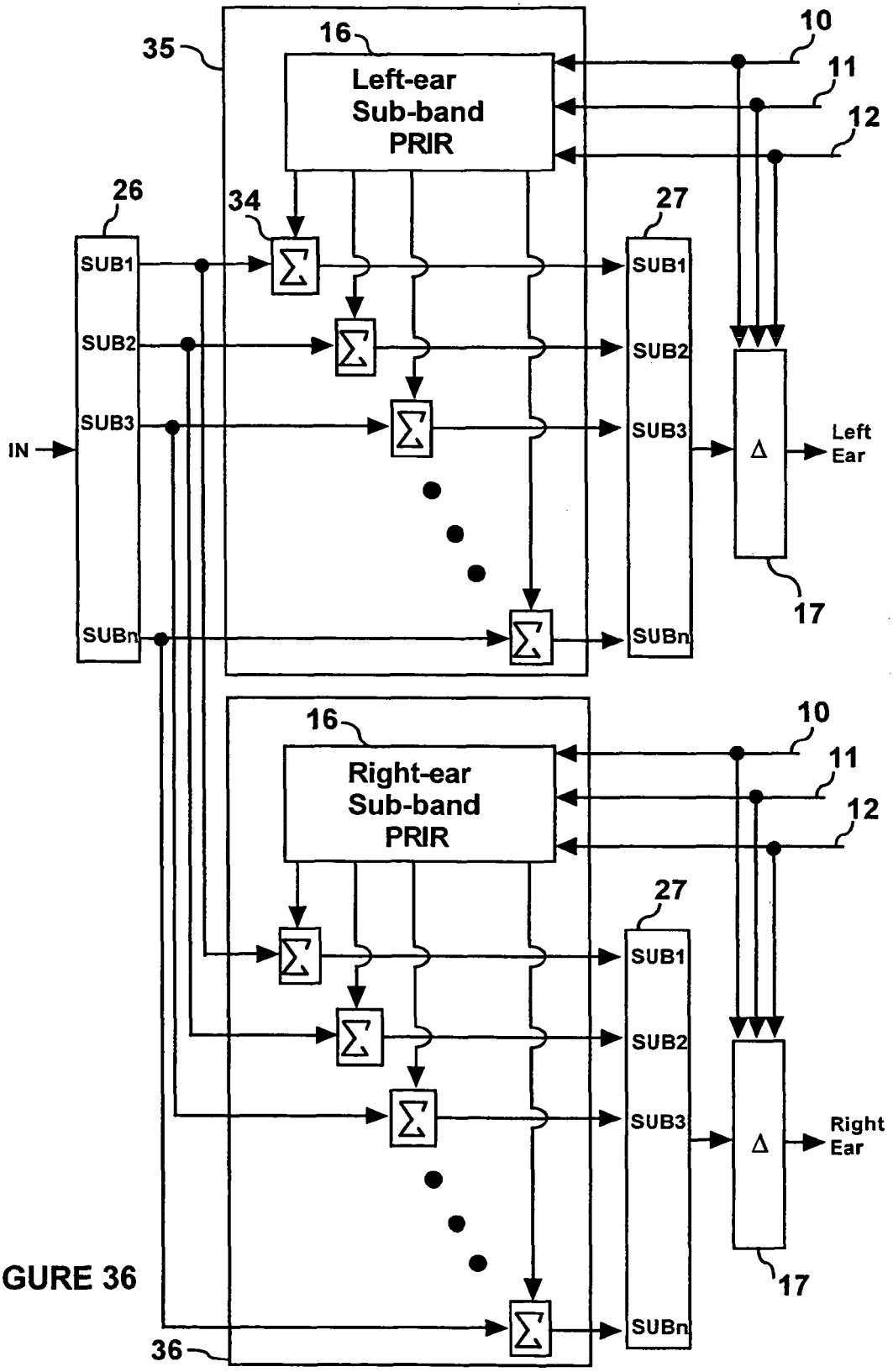
FIG. 36 illustrates the virtualization process for a single channel using sub-band convolution where the inter-aural time delays are implemented in the time-band domain following the synthesis filter bank.

FIG. 36 illustrates the steps necessary to combine the basic sub-band virtualizer with the PRIR interpolation and variable delay buffering as is required to form a single personalized head tracked virtualized channel. An audio signal is input to analysis filter bank 26 that splits the signal into a number of sub-band signals. The sub-band signals enter two separate sub-band convolution processes, one for the left-ear headphone signal 35 and the other for the right-ear headphone signal 36. Each convolution processes work in a similar way. The sub-band signals that enter the left-ear convolver block 36 are applied to individual sub-band convolvers 34 that essentially filter the sub-band audio signals with their respective left-ear sub-band time-aligned PRIR files 16, as selected by the internal sub-band PRIR interpolators driven by the head tracker angle information 10, 11, and 12.

The outputs of the sub-band convolvers 34 enter the synthesis filter bank 27 and are recombined back to a full band time domain left-ear signal. The process is identical for the right-ear sub-band convolution 36 except that it is the right-ear sub-band time-aligned PRIRs 16 that are used to convolve the separate sub-band audio signals. The virtualized left-ear and right ear signals then pass through variable delay buffers 17 whose path lengths are dynamically adjusted to simulate the inter-aural time delays that would exist for real sound sources coincident with the virtual loudspeaker associated with the PRIR data set, for the particular head orientation indicated by the head tracker.

Figure 16:
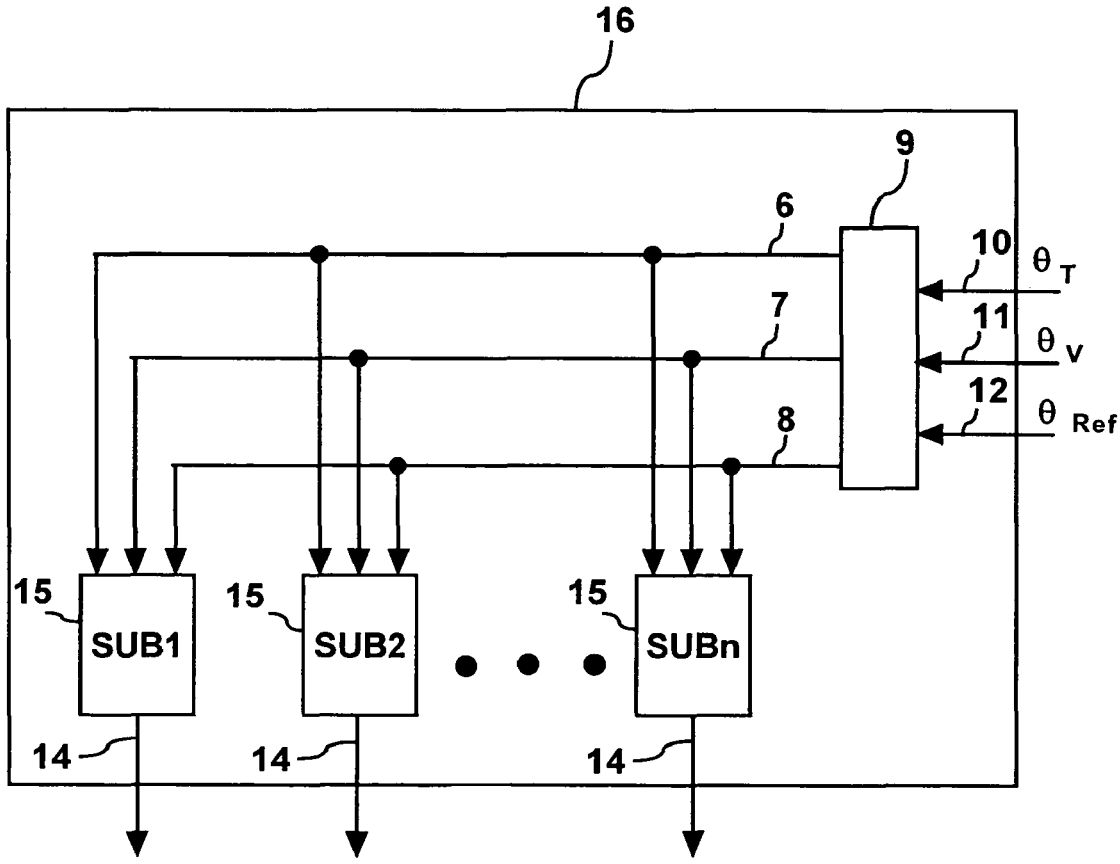
FIG. 16 is similar to FIG. 15 except that the interpolation operates in the sub-band domain.

FIG. 16 illustrates in more detail the workings of the sub-band interpolation block 16 using PRIRs measured for three lateral head positions as an example. The interpolation coefficients 6, 7 and 8 are generated in 9 on analysis of the head tracker angle information 10, reference head orientation 12, and virtual loudspeaker offset 11. A separate interpolation block 15 exists for each sub-band PRIR, whose operation is identical to that of FIG. 15 except that the PRIR data is in the sub-band domain. All interpolation blocks 15 (FIG. 16) use the same interpolation coefficients and the interpolated sub-band PRIR data are output 14 to the sub-band convolvers.

Figure 38:
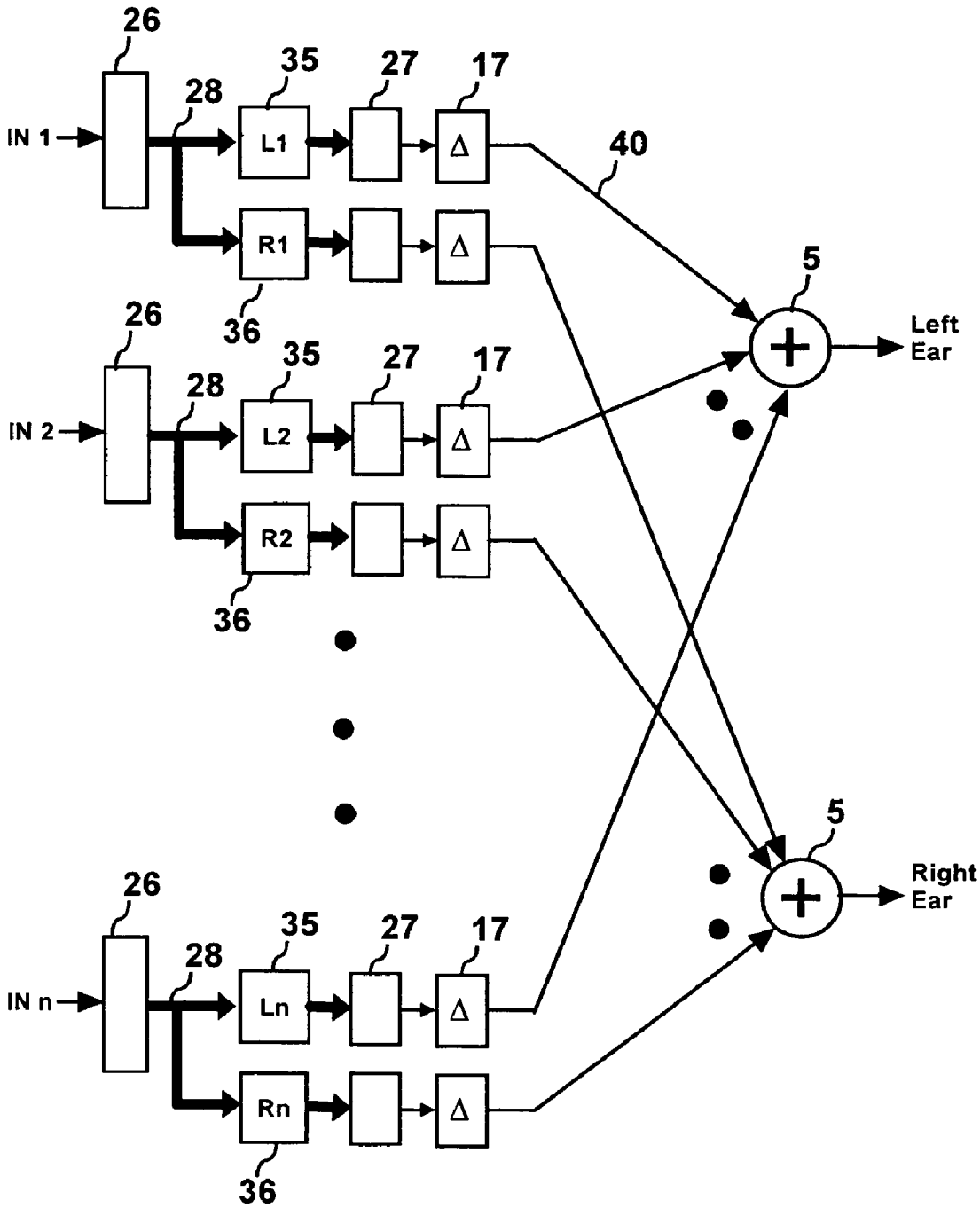
FIG. 38 is similar to FIG. 36 except that it shows the steps necessary to extend the number of input channels.

FIG. 38 illustrates how the method of FIG. 36 is expanded to include more virtual loudspeaker channels. For clarity the sub-band signal paths are combined as a single heavy line 28 and the head tracking signal paths are not shown. Each audio signal is split into sub-bands 26 and the corresponding sub-band signals pass through left and right-ear convolvers 35 and 36 whose outputs are recombined 27 into full band signals and passed to the variable delay buffers 17 to affect the appropriate inter-aural delays. The buffer outputs 40 for all the left-ear and right-ear signals are summed separately 5 to produce the left-ear and right-ear headphone signals respectively.

Figure 18:
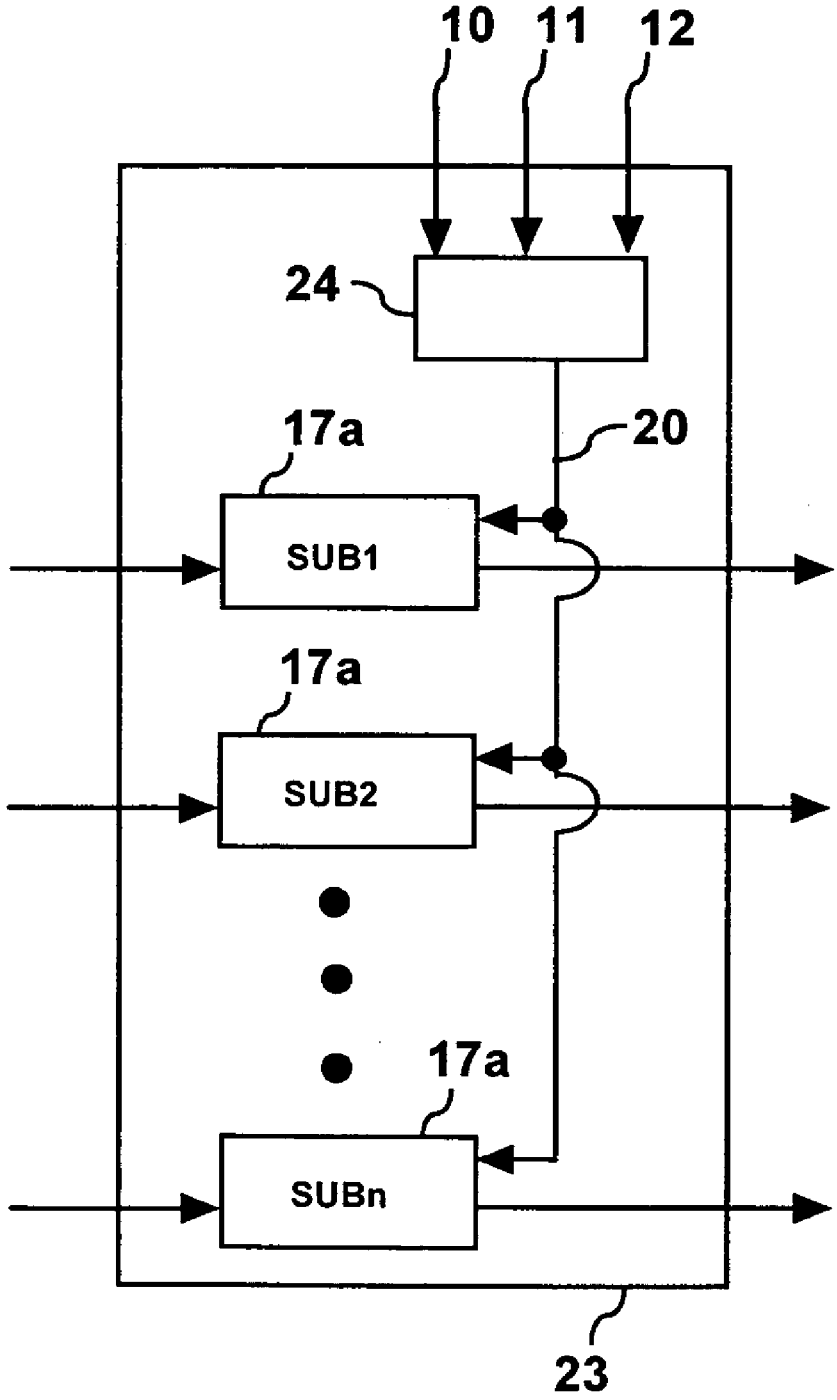
FIG. 18 is similar to FIG. 17 except that the variable delay buffers are implemented in the sub-band domain.
Figure 37:
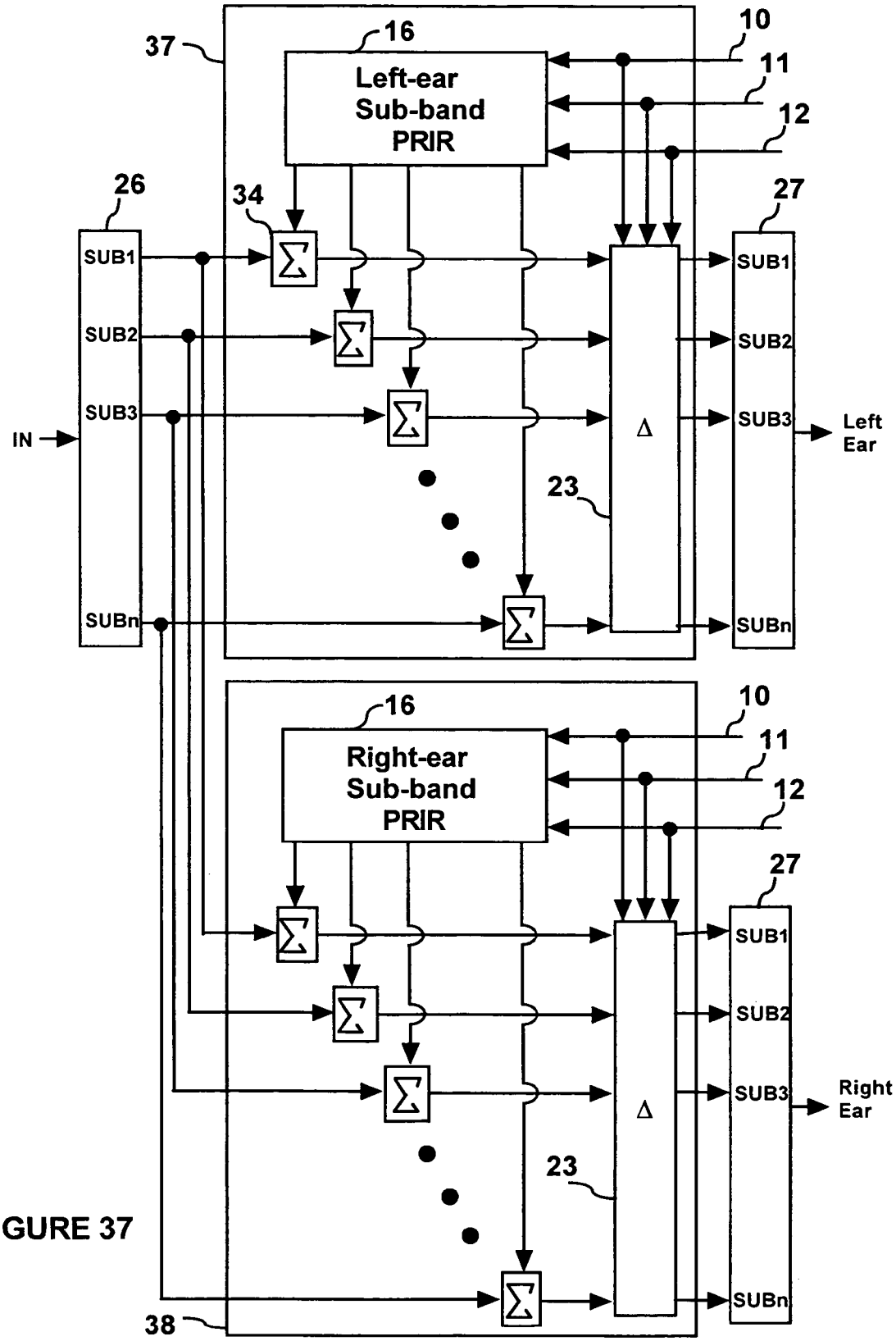
FIG. 37 illustrates the virtualization process for a single channel using sub-band convolution where the inter-aural time delays are implemented in the sub-band domain prior to the synthesis filter bank.
Figure 39:
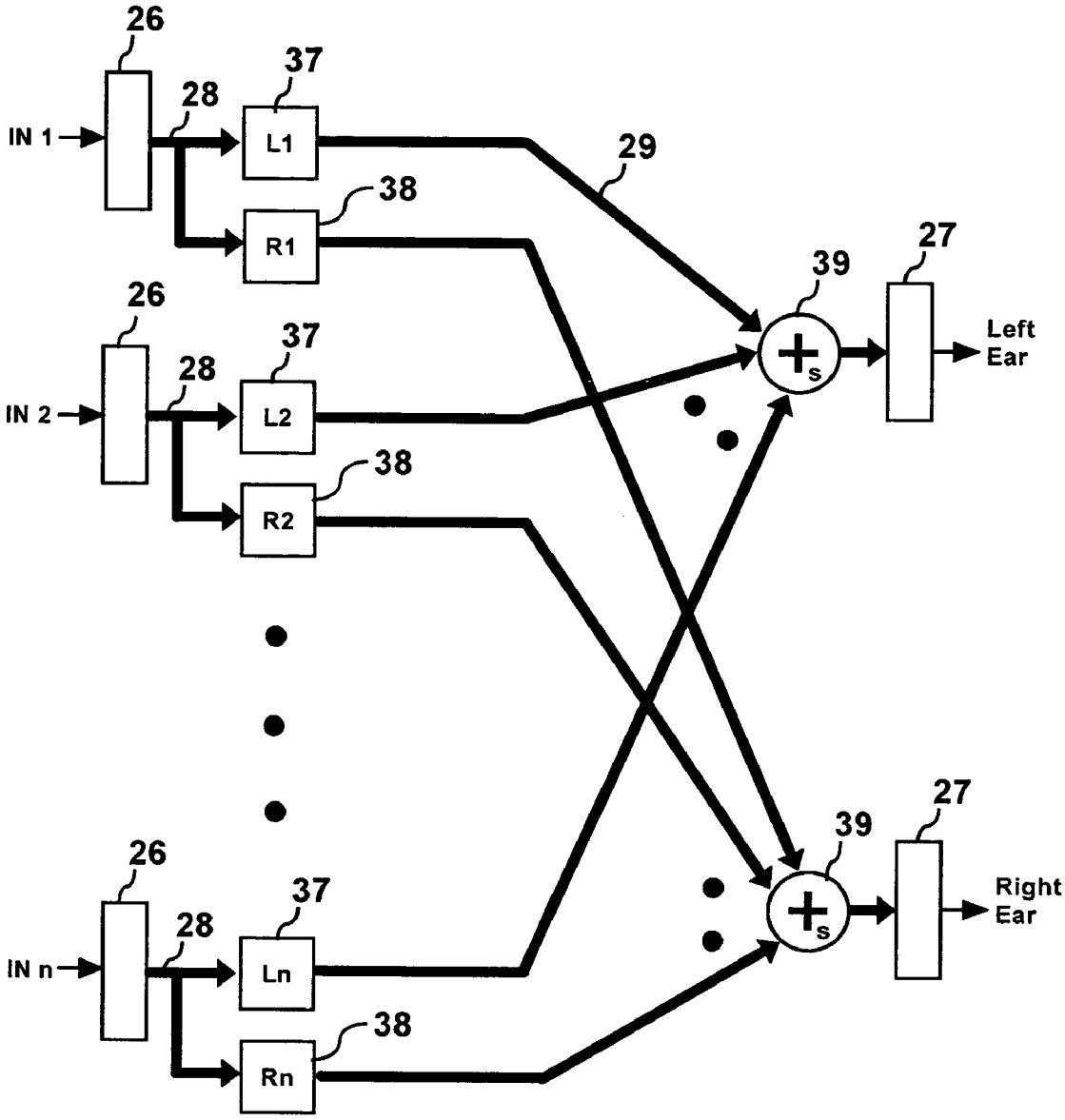
FIG. 39 is similar to FIG. 37 except that it shows the steps necessary to extend the number of input channels.

FIG. 37 illustrates a variation of the implementation of FIG. 36 where the variable delay buffers 23 are implemented in each of the sub-bands prior to the synthesis filter bank 27. Such a sub-band variable delay buffer 23 is illustrated in FIG. 18. Each sub-band signal enters its own separate over sampled delay processor 17*a* whose operation is identical to that illustrated in FIG. 17. The only difference between a sub-band and a full-band delay buffer implementation is that, for the same performance, the over-sampling factor can be reduced by the decimation factor of the filter bank sub-bands. For example, if the sub-band sample rate is ¼ of the input audio sampling rate then the over sampling rate of the variable buffer can be reduced by a factor of 4. This also leads to similar reductions in the size of the over sampling FIR and delay buffer. FIG. 18 also shows a common output buffer address 20 being applied to all sub-band delay buffers reflecting the fact that all sub-bands within the same audio signal should exhibit the same delay.

Where the variable delay buffers are implemented in the sub-band domain, as in FIG. 37, certain improvements in implementation efficiency can be had by summing the left and right-ear signals in the sub-band domain and then reconstructing these using just a single synthesis stage for each. FIG. 39 illustrates such an approach. Again for clarity the sub-band signal paths are represented by a single heavy line 28 and 29 and the head tracker information paths are not shown. Each input signal is split 26 into sub-bands 28 and each individual sub-band convolved and applied to sub-band variable delay buffers 37 and 38. The left-ear and right-ear sub-band signals, for all channels, output from their respective buffers are summed at sub-band adders 39 prior to their reconstruction back to full band signals using synthesis filter banks 27. The left-ear and right-ear sub-band summers 39 operate on individual sub-bands from each virtualized audio channel according to:

$$sub_L[i]=sub_{L1}[i]+sub_{L2}[i]+\ldots sub_{Ln}[i] \quad \text{(eqn 32)}$$

$$sub_R[i]=sub_{R1}[i]+sub_{R2}[i]+\ldots sub_{Rn}[i] \quad \text{(eqn 33)}$$

for i=1, number of filter bank sub-bands and n=number of virtualized audio channels, where $sub_L[i]$ represents the ith left-ear sub-band and $sub_R[i]$ the ith right-ear sub-band.

Figure 40:
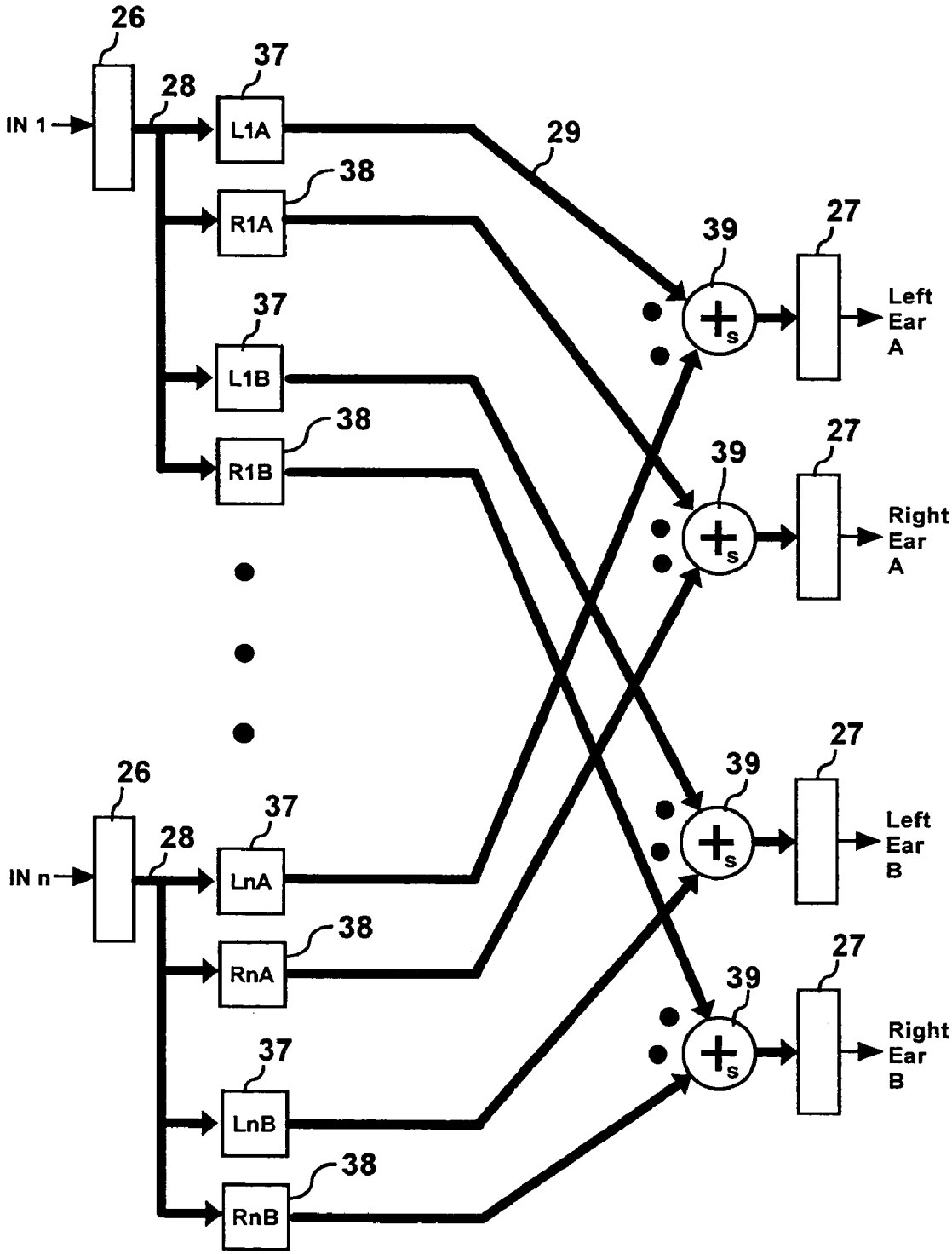
FIG. 40 is similar to FIG. 39 except that it shows the steps necessary to allow two independent users to listen to the virtualized signals.

FIG. 40 illustrates an implementation were user A and user B both wish to listen to the same virtualized audio signals but using their own PRIR and head tracking signals. Again, these signals have been removed for clarity. In this case computational savings come about because the same audio sub-band signals 28 are available to both users' left and right-ear convolution processors 37 and 38, and this saving is available for any number of users.

In previous sections the methods of headphone and loudspeaker equalization filtering have been described. It will be appreciated by those skilled in the art that such methods are equally applicable to virtualizer implementations that make use of the sub-band convolution methods just discussed.

Exploiting Variations in Sub-Band Reverberation Time

A significant benefit of the sub-band virtualization method disclosed herein is the ability to exploit deviations in the PRIR reverberation time with frequency such that further savings can be made in the convolution computational load, the PRIR interpolation computational load, and the PRIR storage space requirements. For example, typical room impulse responses will often exhibit a decline in reverberation time with rising frequency. If in this case the PRIR is split into frequency sub-bands, then the effective length of each sub-band PRIR would decline in the higher sub-bands. By way of example a 4-band critically sampled filter bank splits a 14000 sample PRIR into 4 sub-band PRIRs each of 3500 samples. However this assumes the PRIR reverberation times across the sub-bands are the same. At a sampling rate of 48 kHz, PRIR lengths of 3500, 2625, 1750 and 875, (where 3500 is for the lowest frequency sub-band) may be more typical, reflecting the fact that high frequency sound is more readily absorbed by the listening room environment. More generally therefore, the effective reverberation time of any sub-band can be determined and the convolution and PRIR lengths adjusted to only cover this time period. Since the reverberation times are related to the measured PRIRs they need only be calculated once on initializing the headphone system.

Exploiting Sub-Band Signal Masking Thresholds

The actual number of sub-bands involved in the convolution process may be reduced by determining those sub-bands that will not be audible or those that will be masked by adjacent sub-bands signals after the convolution. The theory of perceptual noise or signal masking is well known in the art and involves identifying parts of the signal spectrum that cannot be perceived by a human subject either because the signal level of the those parts of the spectrum is below the threshold of audibility or because those parts of the spectrum cannot be heard due to the high signal levels and/or nature of adjacent frequencies. For example it may be determined, through the application of some audibility threshold curve, that sub-bands above 16 kHz are not audible irrespective of the level of the input signals. In this case all sub-bands above this frequency would be permanently dropped from the sub-band convolution process. The associated sub-band PRIR could also be deleted from memory. More generally, the masking thresholds across the convolved sub-bands can be estimated on a frame by frame basis and those sub-bands that are deemed to fall below the threshold would be muted, or their reverberation time heavily curtailed, for the duration of the analysis frame. This implies that a fully dynamic masking threshold calculation will lead to a computational loading that will vary from frame to frame. However since in typical applications the convolution processing will be running across many audio channels at the same time, this variation will likely be smoothed out. If it is desired to maintain a fixed computational load then certain limits can be imposed on the number of active sub-bands or the total convolution tap length across any or all of the audio channels. For example the following limitations may prove perceptually acceptable.

First, the number of sub-bands involved in the convolutions across all channels is fixed at a maximum level such that the masking thresholds will only occasionally elect for a greater number of sub-bands. Priority could be placed on the low-frequency sub-bands such that the band limiting effect caused by exceeding the sub-band limit will be confined to the high frequency regions. Additionally priority could be given to certain audio channels and the high frequency band limiting effect confined to those channels that are considered less important.

Moreover, the total number of convolution taps is fixed such that the masking thresholds will only occasionally elect for a range of sub-bands whose reverberation times combine to exceed this limit. As before, priority can be placed on low-frequency sub-bands and/or on particular audio channels such that the high frequency reverberation times are reduced only in low priority audio channels.

Exploiting Variations in Signal or Loudspeaker Bandwidths

For audio channels or loudspeakers whose bandwidth is not scaled in proportion to its sampling rate the number of sub-bands that participate in the convolution process can be lowered permanently to match the bandwidth of the application. For example the sub-woofer channel, common in many home theatre entertainment systems has an operating bandwidth that rolls off from about 120 Hz. The same is true of the sub-woofer loudspeaker itself. Consequently, considerable savings can be achieved by restricting the bandwidth of the convolution process to match that of the audio channel by allowing only those sub-bands that contain any meaningful signal to participate in the sub-band convolution process.

Altering the Frequency-Reverberation Time Characteristics

To maximize the realism of the headphone virtualizer it is desirable to retain the frequency-reverberation time characteristics of the original PRIRs. However this characteristic can be altered by restricting the reverberation time in any sub-band by limiting the number of sub-band PRIR samples a convolver uses to filter the sub-band audio. This intervention might be required simply to limit the complexity of the convolvers at any particular frequency, as discussed, or it may be applied more aggressively if is desired to actually reduce the perceived reverberation times of the virtual loudspeakers at certain frequencies.

Trading Convolution Complexity for Virtualization Accuracy

The personalized room impulse response comprises three main sections. The first section is the impulse onset that records the initial passage of the impulse wave as it moves out from the loudspeaker past the ear mounted microphones. Typically the first section will extend beyond the initial impulse onset for about 5 to 10 ms. Following the onset is a record of the early reflections of the impulse that have bounced off the listening room boundaries. For typical listening rooms this covers a time span of about 50 ms The third section is a record of the late reflections, or room reverberations, and typically last 200 to 300 ms depending on the reverberation time of the environment.

Figure 50:
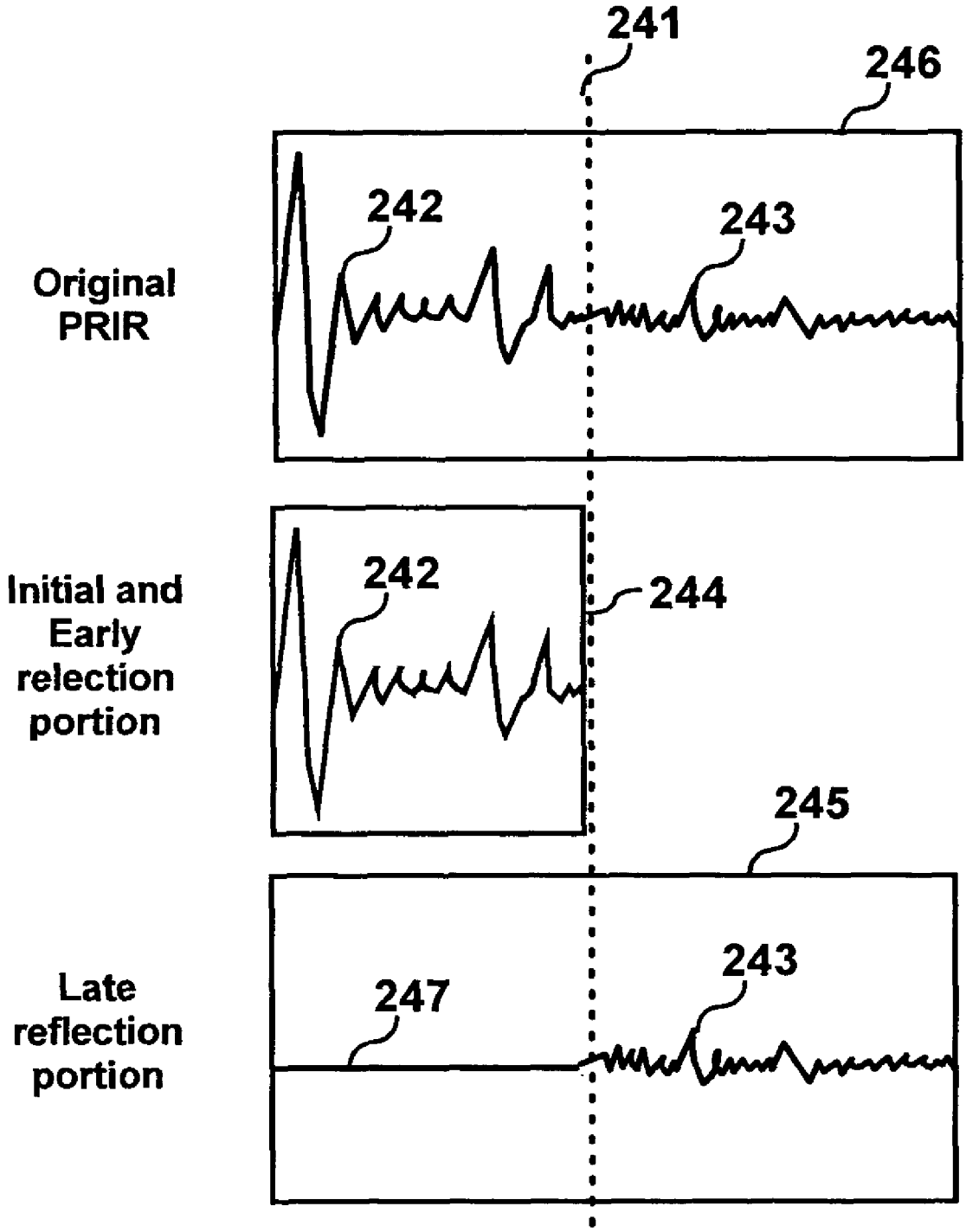
FIG. 50 illustrates a method of separating the initial/early reflections from the late reflections within typical room impulse response waveforms.

If the reverberation portion of the PRIR is sufficiently diffuse, that is, the sounds are perceived to come equally from all directions then the late reflection (reverberation) portion of all the acquired PRIRs will be similar. Since the reverberation sections represent the biggest portion of the entire impulse response significant savings can be obtained by merging these sections and the corresponding convolutions into a single process. FIG. 50 illustrates the dissection of an original time aligned PRIR 246. The impulse onset and early reflections 242 and the late reflections 243, or reverberation, are shown separated by dashed line 241. The initial and early reflection coefficients 244 form the PRIR for the main signal convolvers. The late reflection, or reverberation, coefficients 245 are used to convolve the merged signals. The early coefficient portion 247 may be zeroed in order to maintain the original time delay, or it can be removed entirely and the delay reinstated using a fixed delay buffer.

Figure 49:
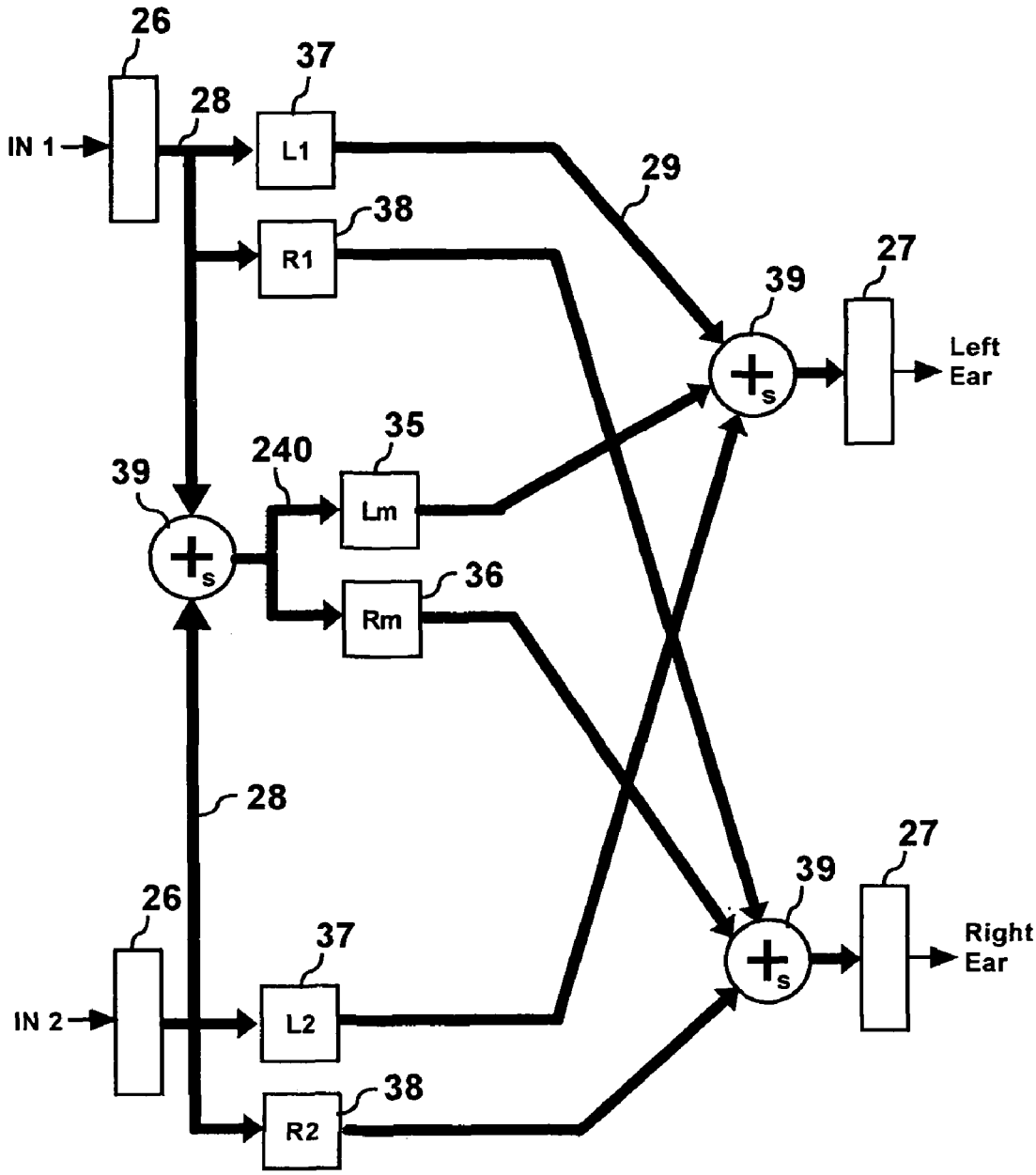
FIG. 49 illustrates a method of reducing the computational load of sub-band convolution by merging the late reflection portions of the PRIRs

By way of example FIG. 49 illustrates a system that virtualizes two input signals using the modified PRIRs. For clarity the head track signals are not shown. Two audio channels IN 1 and IN 2 are virtualized using a sub-band 28 convolution and variable time delay process for the left-ear 37 and right-ear 38 signals. The convolved and delayed sub-band signals are summed 39 and converted back to the time domain 27 resulting in left-ear and right-ear headphone signals. The PRIRs used within the left 37 and right 38 processes have been truncated to include only the onset and early reflections 244 (FIG. 50) and as such exhibit a significantly lower computational load. The head tracked sub-band PRIR interpolation within 37 and 38 operates in the normal way and is also less computationally intensive due to their reduced length. The reverberation portions of the PRIRs 245 (FIG. 50) for both input channels (CH1 and CH2) are summed together and level adjusted and loaded to the sub-band convolvers 35 and 36. These stages differ from those of 37 and 38 in that the variable delay processing is absent. Sub-band signals from both input channels 28 are summed 39 and the merged signals 240 applied to left-ear 35 and right-ear 36 sub-band convolvers. The sub-bands output from 35 and 36 are summed with their respective left-ear and right-ear sub-bands 39 prior to conversion 27 back to the time domain.

Head tracked inter-aural delay processing is not effective for the reverberation channels of 35 and 36 and is not used. This is because the merged audio signals no longer emanate from a single virtual loudspeaker meaning that no one delay value will likely be optimal for composite signals such as these. Convolver stages 35 and 36 do ordinarily use interpolated reverberation PRIRs, driven by the head tracker. A further simplification is possible by locking the interpolation process and convolving the merged signals with just one fixed reverberation PRIR, for example, the PRIR that represents the nominal viewing head orientation.

In the example of FIG. 49 the initial and early reflection portions of the PRIR might typically represent only 20% the original PRIR and the two channel convolution implementation illustrated might realize a computational savings in the order of 30%. Clearly as more channels make use of the merged reverberation path the greater the savings. For example a five channel implementation might see a 60% reduction in convolution processing complexity.

Pre-Virtualization Techniques

In the normal mode of operation, and embodiment of the system convolves the input audio signals in real time using impulse response data that is interpolated from a number of predetermined PRIRs specific to each virtual loudspeaker. The interpolation process runs continuously alongside the convolution process and uses a head-tracking device to calculate the appropriate interpolation coefficients and buffer delays such that the virtual sound sources appear fixed in the presence of listener's head movements. A significant drawback of this mode of operation is that the stereo headphone signals output from the virtualizer are related to the listener's real time head position and only meaningful at that particular instant. Consequently the headphone signals themselves cannot ordinarily be stored (or recorded) and replayed at some later date, since the listener's head movements are unlikely to match those that occurred during the recording. Moreover, since the interpolation and differential delays cannot be retrospectively applied to the headphone signals, the listener's head movements will not de-rotate the virtual image. The concept of pre-recorded virtualization, or pre-virtualization would however offer significant reductions in the computational load at playback since the intensive convolution processes would only occur during recording and would not need to be repeated during playback. Such a process would be beneficial for applications that have limited playback processing power and where the opportunity exists for the virtualization process to be run off-line, and for the pre-virtualized (or binaural) signals instead to be processed in real time under control of the listener's head tracker device.

Figure 44:
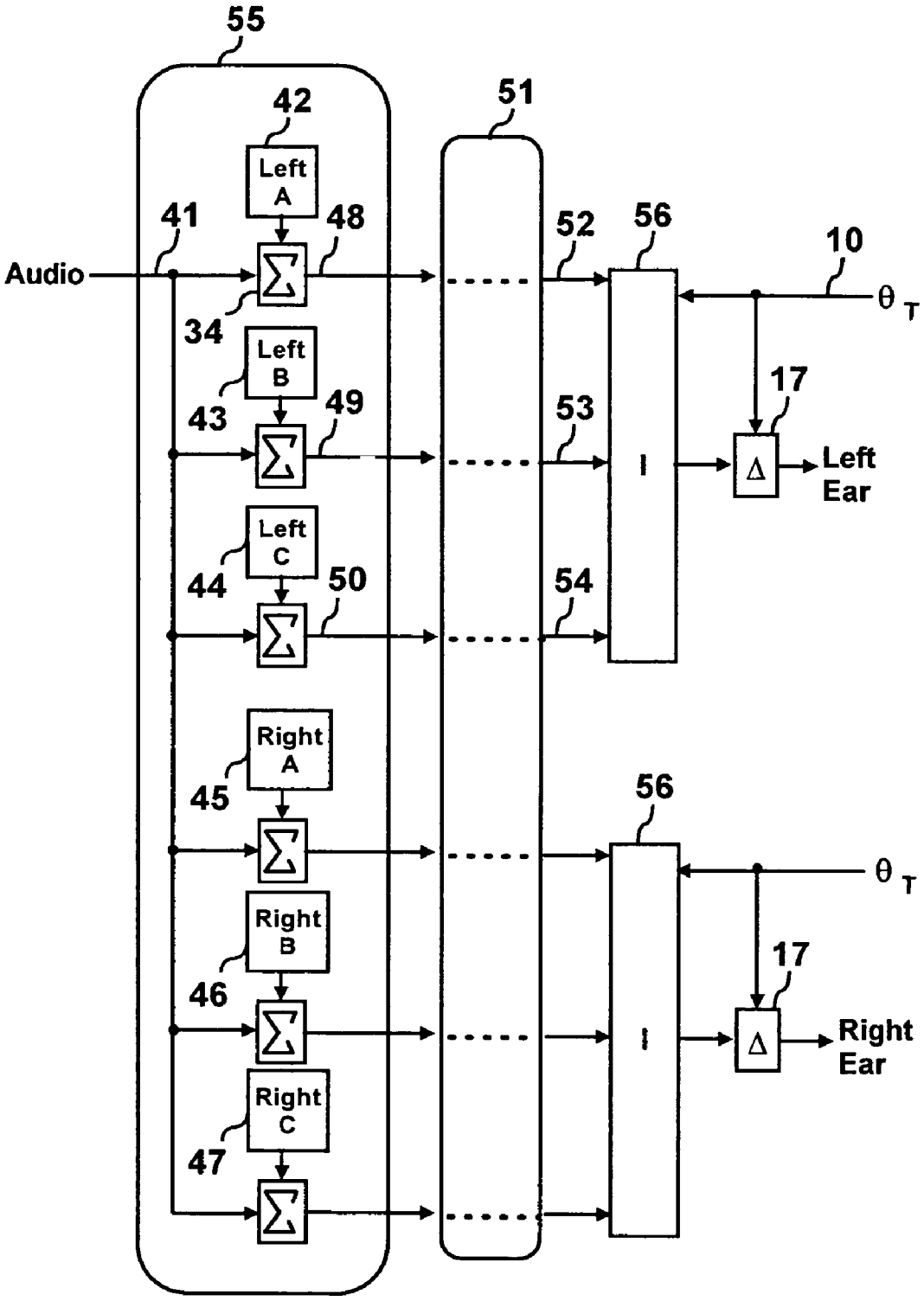
FIG. 44 illustrates the concept of pre-virtualization using a single audio channel and using a three position PRIR scope.

The basis of the pre-virtualization process is, by way of example, illustrated in FIG. 44. A single audio signal 41 is convolved 34 with three left-ear time-aligned PRIRs 42, 43 and 44, and three right-ear time-aligned PRIRs 45, 46 and 47. In this example, the three left-ear and right-ear PRIRs correspond to a single loudspeaker personalized for three different head orientations A, B and C. An illustration of such personalization orientations is shown in FIG. 29. The left-ear PRIRs for the head positions A, B and C, each convolve the input signal 41 to produce three separate virtualized signals 48, 49 and 50 respectively. In addition three separate virtualized signals are generated for the right-ear using right-ear PRIRs. The six virtualized signals in this example now represent the left and right-ear feeds for a headphone for three listener head orientations A, B and C. These signals can be transmitted to the play back device, or they can be stored for playback at a later time 51. The computational load of this intermediate virtualization stage is, in this case, 3 times greater then the equivalent interpolated version, since the PRIRs for all three head positions are used to convolve the signal, rather than just a single interpolated PRIR. However, where the virtualized signals are being stored, it may not be necessary for this to be conducted in real time.

In order for the user to listen to the virtualized version of the input audio signal 41, it may be necessary to apply the three left-ear virtualized signals 52, 53 and 54 to an interpolator 56 whose interpolation coefficients are calculated based on the listener's head angle 10 in much the same way as the conventional PRIR interpolation operates 10. In this case the interpolation coefficients are used to output a linear combination of the three input signals every sample period. The right-ear virtualized signals are also interpolated 10 using an identical process. If, for this example, the virtualized signal samples for head position A are x1($n$), those for virtualized head position B are x2($n$) and those for virtualized head position C are x3($n$) then the interpolated sample stream x(n) is given by:

$$x(n)=a*x1(n)+b*x2(n)+c*x3(n);\ \text{for nth sampling period} \qquad \text{(eqn 34)}$$

where a, b and c are the interpolation coefficients whose values vary depending on the head tracker angles according to equations 2, 3 and 4.

The left-ear interpolated output 56 is then applied to a variable delay buffer 17 that changes the path length of the buffer according to the listener's head angle. The interpolated right-ear signal also passes through a variable delay buffer and the difference in delays between the left and right-ear buffers is dynamically adapted to changes in the head angle such that they match the inter-aural delays that would have existed if the headphone signals were actually arriving from a real loudspeaker coincident with the virtual loudspeaker. These methods are all identical to those described in earlier sections. Both the interpolator and variable delay buffers have available to them the personalization measurement head angle information specific to the PRIRs used to create the virtualized signals, allowing them to dynamically calculate the appropriate interpolator coefficients and buffer delays as the head tracker dictates.

One benefit of this system is that the interpolation and variable delay processes exhibit a vastly lower computational load than that demanded by the virtualization convolution stages 34. FIG. 44 illustrates a single audio signal 41, virtualized for three head positions. It will be appreciated by those skilled in the art that this process can easily be extended to cover more head positions and a greater number of virtualized audio channels. Moreover, the pre-virtualized signals 51 (FIG. 44) may be stored locally or it may be stored in some remote site and these signals may be played back by the user synchronized to other associated media streams such as motion picture or video.

Figure 45:
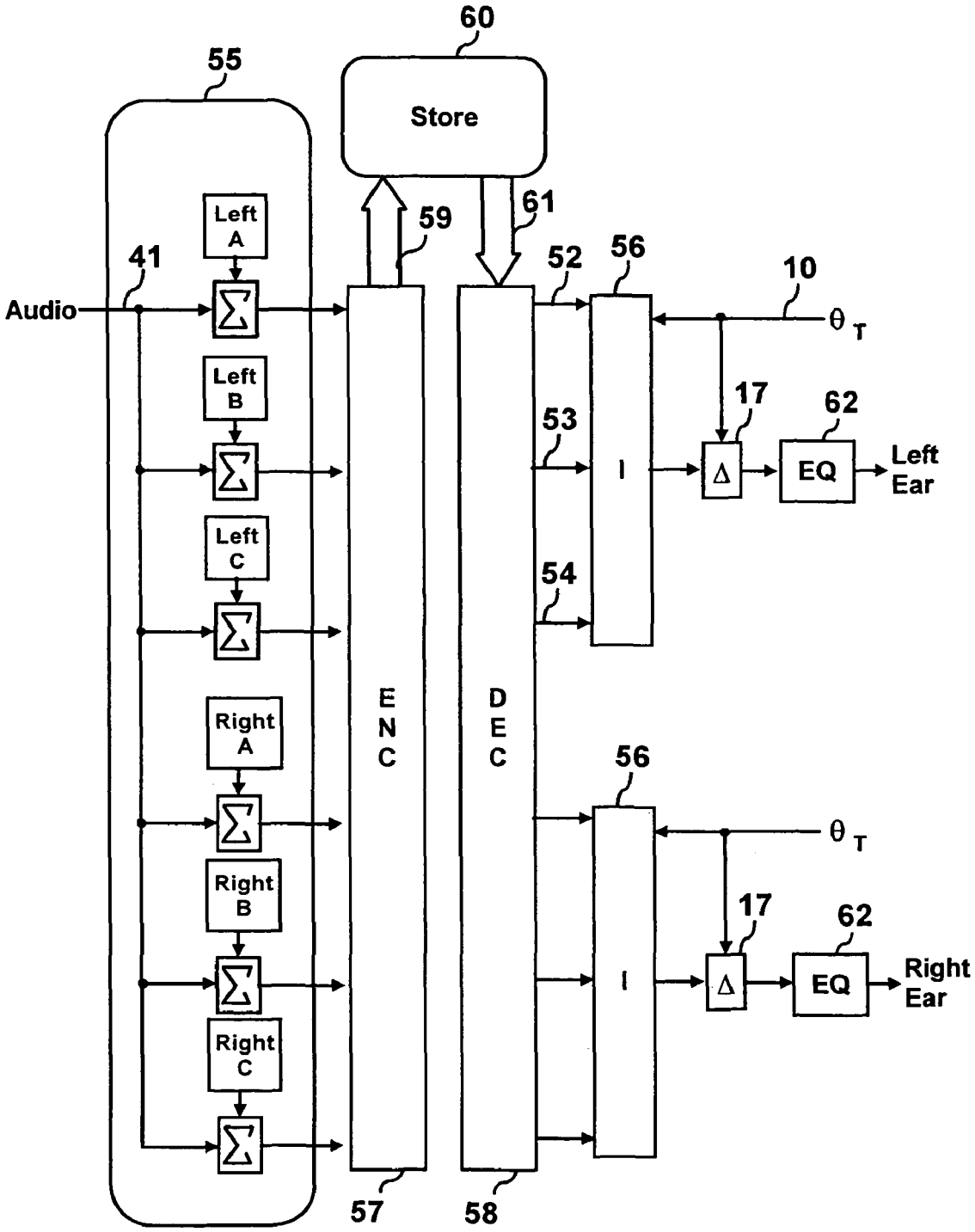
FIG. 45 is similar to FIG. 44 except that the pre-virtualized audio signals are encoded, stored and decoded prior to play back.

FIG. 45 illustrates an extension of the process whereby six virtualized signals are encoded 57 and output 59 to a storage device 60 as an interim stage. The process of taking the input audio samples 41, generating the different virtualized signals, encoding them and then storing them 60, continues until all the input audio samples have been processed. This may, or may not, be in real time. The personalization measurement head angle information specific to the PRIRs used to create the virtualized signals is also included in the encoded stream.

Some time later, the listener wishes to listen to the virtualized sound track and the virtualized data held in storage 60 is streamed 61 to a decoder 58 that extracts the personalization measurement head angle information and reconstructs the six virtualized audio streams in real time. On reconstruction the left and right-ear signals are applied to their respective interpolators 56 whose outputs pass through the variable delay buffers 17 to recreate the virtual inter-aural delays. In this example headphone equalization is implemented using filter stages that process the buffer outputs and it is the output of these filters that are used to drive the stereo headphones. Again the benefit of this system is that the processing load associated with the decoding, interpolation, buffering and equalization is small compared to the virtualization process.

In the examples of FIGS. 44 and 45, the pre-virtualization process results in a 6-fold increase in the number of audio streams to be transmitted or stored. More generally the number of streams is equal to the number of loudspeakers to be virtualized multiplied by twice the number of personalized head measurement used by the interpolators. One way of reducing the bit rate of such a transmission, or the size of the data file to be held in storage 60 is to use some form of audio bit rate compression, or audio coding within the encoder 57. A complementary audio decoding processes would then reside in the decode process 58 to reconstruct the audio streams. High quality audio coding systems that exist today can operate at a compression ratio down to 12:1 without audible distortion. This implies that the storage requirement of a pre-virtualized encoded stream would compare favorably to that of the original uncompressed audio signal. However, it is likely that for this application even greater compression efficiencies will be possible due to the high degree of correlation between the various virtualized signals entering the encode stage 57.

The processes illustrated in FIGS. 44 and 45 can be radically simplified if it is deemed acceptable to interpolate between non-time aligned pre-virtualized signals. The implication of this simplification is that the variable delay processing is dropped entirely at the playback stage allowing the left and right-ear signal groups to be summed prior to encoding, reducing the number of signals to be stored or transmitted to the decode side when more then one loudspeaker is to be virtualized.

Figure 47:
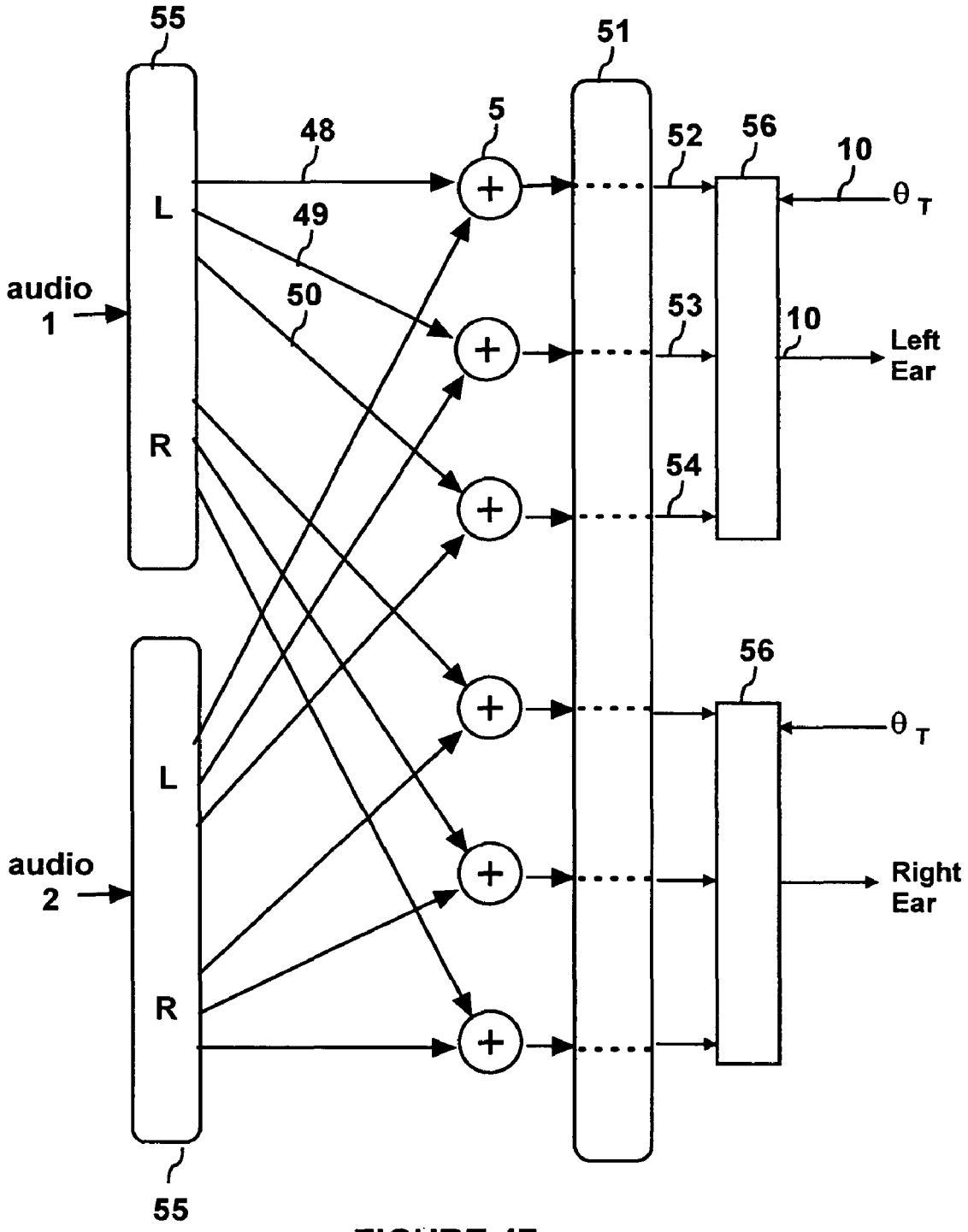
FIG. 47 illustrates a simplified pre-virtualization concept for a three position PRIR scope where the playback consists of interpolating between combined left and right-ear signals.

The simplification is illustrated in FIG. 47. Two channels of audio are applied to the pre-virtualization process 55 and 56, each being virtualized using separate loudspeaker PRIRs. The PRIR data used to convolve the audio signals are not time aligned but retain the inter-aural time delays present in the raw PRIR data. The pre-virtualized signals for the three head positions are summed with those of the second audio channel and these are passed through to the left and right-ear interpolator 56 whose outputs drive the headphones directly. The number of pre-virtualized signals that pass to the playback side 51 is now fixed and equals twice the number of PRIR head positions, substantially reducing the audio coding compression requirements that would be required to implement the system illustrated by FIG. 45.

FIG. 47 illustrates the application to 2 audio channels and 3 PRIR head positions. It will be appreciated that this can easily be extended to cover any number of audio channels using two or more PRIR head positions. The main disadvantage of this simplification is that by not time aligning the PRIRs the interpolation process produces significant comb filtering effects that tend to attenuate certain higher frequencies in the headphone audio signals as the listener's head moves between the PRIR measurement points. However since the user may spend most of their time listening to the virtualized loudspeaker sound with their head positioned close to the reference orientation, this artifact may not be perceived as significant to the average user. The headphone equalization is not shown in FIG. 47 for clarity but it will be appreciated that it may be included within the PRIR or during the pre-virtualization processing, or the filtering may be conducted on the decoded signals or on the headphone outputs themselves during playback.

The personalized pre-virtualization method of FIG. 47 can be further broadened to cover many different methods for generating the left and right-ear (binaural) headphone signals. In its broadest form the method describes a technique that generates a number of personalized binaural signals, each representing the same virtual loudspeaker arrangement but for different head orientations of the individual to which the personalized data belongs. These signals may be processed in some way, for example to aid transmission or storage, but ultimately during playback, under control from a head tracker, the binaural signals sent to the headphones are derived from these same sets of signals. In its most basic configuration, two sets of binaural signals, representing two listener head positions, will be used to generate, in real time, a single binaural signal driving the headphones and using the listener's head tracker as a means of determining the appropriate combination. Once again, headphone equalization may be performed at various stages of the process without departing from the scope of the invention.

Figure 46:
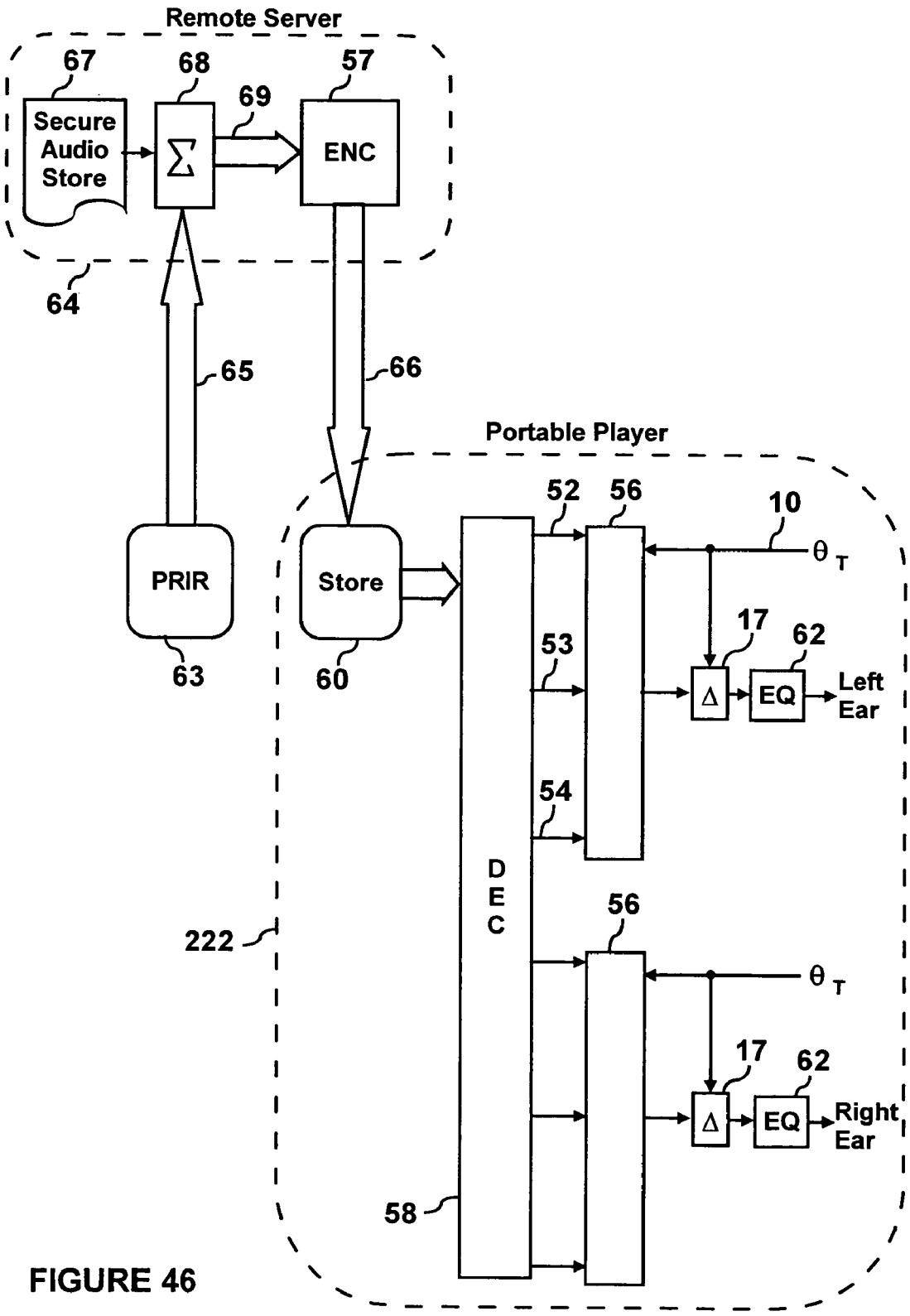
FIG. 46 is similar to FIG. 45 except that the pre-virtualization is conducted on a secure remote server using PRIR data uploaded by the user.

One final variation of the pre-virtualization method is illustrated in FIG. 46. A remote server 64 contains secure audio 67 that may be downloaded 66 to customer storage 60 for playback through a portable audio player 222. The pre-virtualization could take the form of that illustrated in FIG. 45, in that the secure audio itself is downloaded and pre-virtualized in the customer's equipment. However, to avoid piracy issues, it may be desirable to force the customer to upload 65 their PRIR files 63 to the remote server and for the server to pre-virtualize the audio 68, encode the virtualized audio 57 and then download the streams 66 to customers own storage device 60. The encoded data held in storage can then be streamed to the decoder for playback over the customer's headphones as per the earlier explanations. The headphone equalization could also be uploaded to the server and incorporated into the pre-virtualization processing, or it can be implemented 62 by the player as per FIG. 46. The pre-virtualization and playback techniques may make use of the methods exemplified in FIG. 45, or they could use the simplified approach of FIG. 47 (or its generalized form as discussed).

An advantage of this approach is simply that the audio downloaded by the customer has effectively been personalized by the action of convolving the audio with their PRIRs. The audio is much less likely to be pirated since the virtualization will likely prove somewhat ineffective for listeners other than the person for which the PRIRs were measured. Furthermore the PRIR convolution process is difficult to reverse and in the case of secure multi-channel audio, the individual channels virtually impossible to separate from the headphone signals.

FIG. 46 illustrates the use of a portable player. However, it will be appreciated that the principle of uploading PRIR data to a remote audio site and then downloading personalized virtualized (binaural) audio can be applied to many types of consumer entertainment playback platforms. It will also be appreciated that the virtualized audio may have associated with it other types of media information such as motion picture or video data and that these signals would typically be synchronized to the virtualized audio playback such that full picture-sound synchronization is achieved. For example, if the application was DVD video playback on a computer, the movie sound tracks would be read from the DVD disk, pre-virtualized and then stored back to the computers own hard drive. The pre-virtualization would typically be performed off line. To watch the movie the computer user starts the movie and rather than listen to the decoded DVD sound track the pre-virtualized audio is played in its place (using the head tracker to simulate the inter-aural delays 17 and/or interpolate 56 in the normal way) synchronized to the picture. Pre-virtualizing the DVD sound track could also be achieved on a remote server using uploaded PRIR as illustrated in FIG. 46.

The description of the pre-virtualization methods has made reference, by way of example, to a 3-point PRIR measurement scope. It will be appreciated that the methods discussed can easily be expanded to accommodate fewer of more PRIR head orientations. The same applies to the number of input audio channels. Moreover many of the features of the normal real-time virtualization methods, for example those that modify the virtualizer output for head movements that fall outside the measured scope, can equally be applied to the pre-virtualized playback system. The pre-virtualization disclosure has focused on the principle of separating the process of convolution and the interpolation and variable delay processing in order to illustrate the method. It will be appreciated to those skilled in the art that the use of efficient virtualization techniques, such as the sub-band convolution method disclosed herein or other methods such as FFT convolution will lead to improved encoding and decoding implementations. For example, convolved sub-bands audio signals, or FFT coefficients themselves exhibit certain redundancies that can be better exploited by audio coding techniques to improve their bit rate compression efficiency. Moreover, many of the methods proposed to reduce the computational loading of the sub-band convolution process can also be applied to the encoding process. For example sub-bands that fall below a perceptual mask threshold and are optionally removed from the convolution process could also be deleted from the encoding process for that frame, thereby reducing the number of sub-band signals that need to be quantized and coded, leading to a reduction in the bit rate.

Networked Real Time Personalized Virtualization Applications

Figure 48:
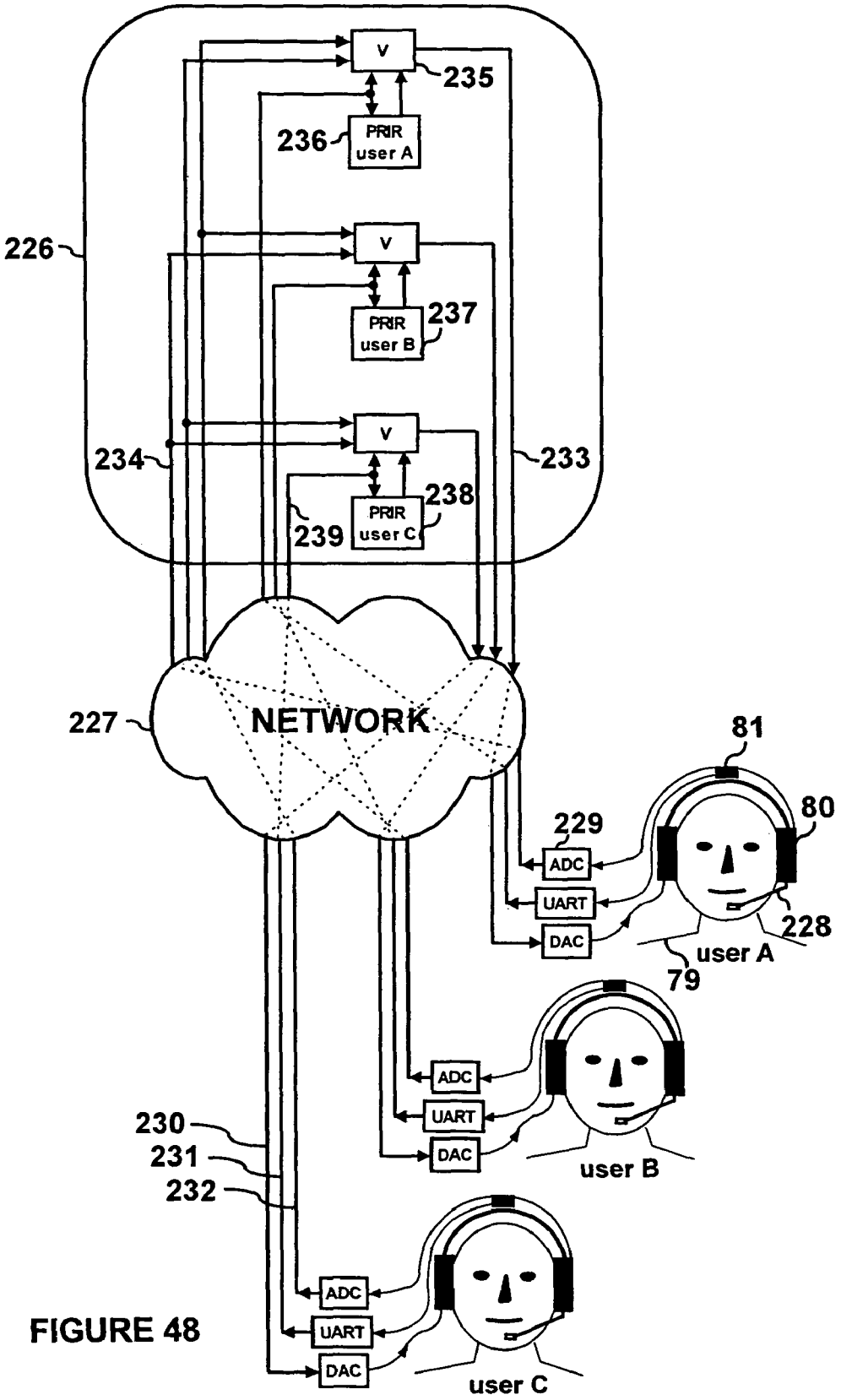
FIG. 48 illustrates the concept of personalized virtual teleconferencing where individual PRIRs are uploaded to the conference server.

Many new applications are envisaged in which personalized head tracked virtualization is used. One such general application is networked real time personalized virtualization whereby the convolution process runs on a remote networked server that has available to it PRIR data sets for various networked participants. Such a system forms the core of virtualized telephone conferencing, internet distance learning virtual classroom and interactive networked gaming systems. A general purpose networked virtualizer is illustrated in FIG. 48. By way of example three remote users A, B and C, are connected to a virtualizer hub 226 via network 227 and wish to communicate in a three-way conference type call. The purpose of the virtualization is to cause the voices of the remote parties to emanate from the local participants headphones such that they appear to come from a distinct direction relative to their reference head orientation. For example, one option would be to make the voice of one of the remote parties to come form a virtual left front loudspeaker and the voice of the other from a virtual right front loudspeaker. Each participants head position is monitored by the head trackers and these angles are continually streamed up to the server in order to de-rotate the virtual parties in the presence of head movements.

Each participant 79 wears a stereo headphone 80 whose audio signals are streamed down from the server 226. A head tracker 81 tracks the users head movement and this signal is routed up to the server to control the virtualizer 235, inter-aural delay and PRIR interpolation 236 associated with that user. Each headphone also has mounted a boom microphone 228 to allow each users digitized 229 voice signals to pass up to the server 234. Each voice signal is made available as an input to the other participant's virtualizers. In this way each user hears only the other participant's voices as virtualized sources—their own voice being fed back locally to provide a confidence signal.

Before beginning the conference, each participant 79 uploads to the server PRIR files (236, 237 and 238) that represent virtual loudspeakers, or point sources, measured for a number of head angles. This data could be the same as that acquired from a home entertainment system or it could be generated specifically for the application. For example it might include many more loudspeaker positions than would ordinarily be required for entertainment purposes. Each user is allocated an independent virtualizer 235 in the server with which their respective PRIR files and head tracker control signals 239 are associated. The left and right-ear outputs of each virtualizer 233 are streamed back in real time to each respective participant through their headphones 80. Clearly FIG. 48 can be expanded to accommodate any number of participants.

Where a large transmission delay (latency) exists in the network the head tracking response time may be improved by allowing the head tracked PRIR interpolation and path length processing to be conducted at some location on the network that is more accessible to the listener, i.e., upstream and downstream delays are lower. The new location can be another server on the network or it can be located with the listener. This implies the use of pre-virtualization methods of the type illustrated in FIGS. 44, 45 and 47 would be deployed where pre-virtualized signals are transmitted to the secondary site rather than the left and right-ear audio.

A further simplification of the teleconference application is possible when the number of participants is small. In this case it may be more economical for each of the participants voice signals to be broadcast across to the network to all other participants. In this way the entire virtualizer reverts back to the standard home entertainment setup where each incoming voice signal is simply an input to the virtualizer equipment located with each participant. Neither a networked virtualizer nor PRIR uploading is required in this case.

Real Time Implementation Using a Digital Signal Processor (DSP)

Figure 41:
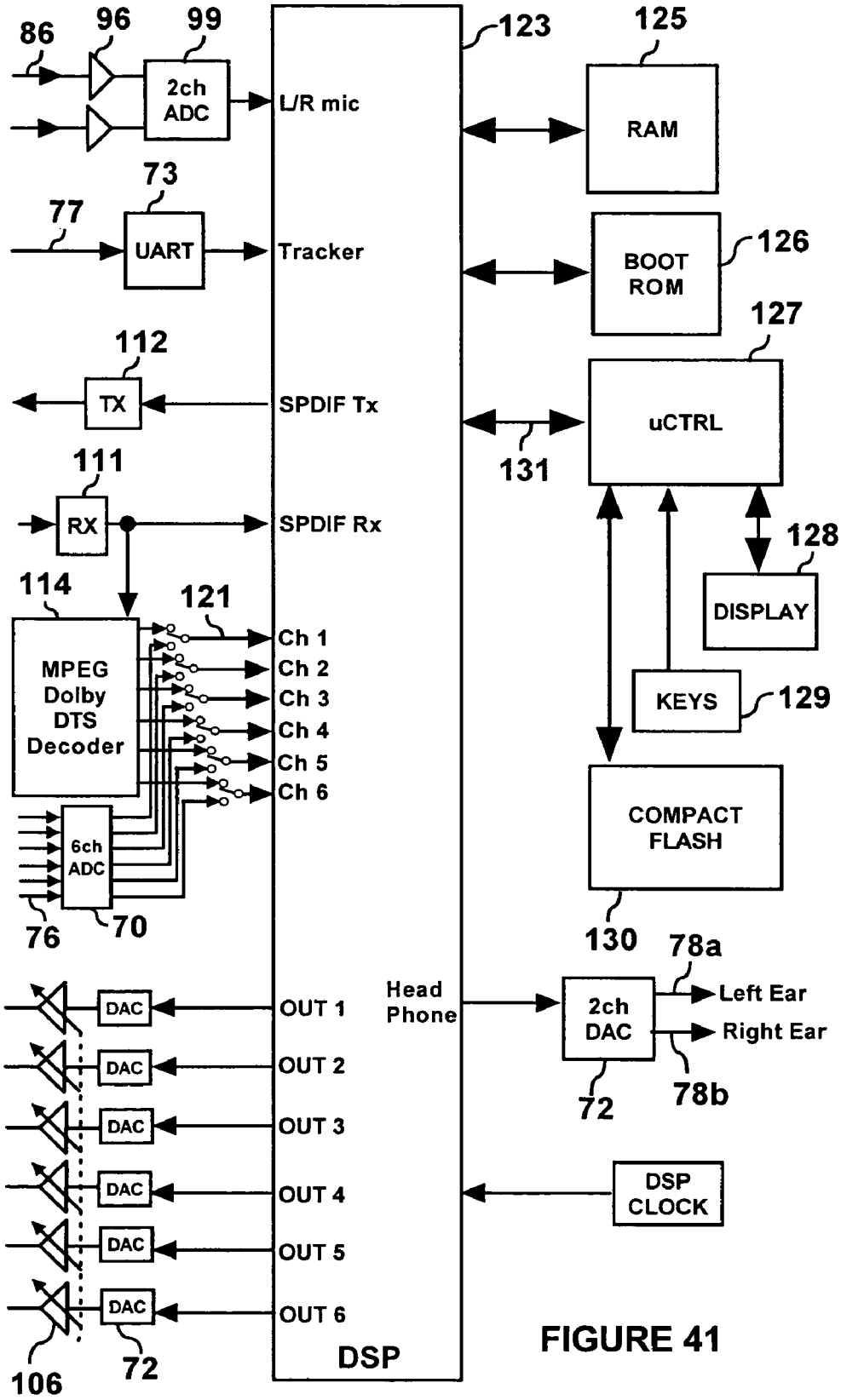
FIG. 41 is a block diagram of a DSP based virtualizer core processor and the primary support circuitry.

A real time implementation of a six channel version of the headphone virtualizer for use within multi-channel home entertainment application running at a sampling rate of 48 kHz, FIG. 1, was constructed around a single digital signal processor (DSP) chip. This implementation incorporates MLS personalization routines and virtualization routines into a single program. The implementation is able to operate in the modes shown in FIGS. 26, 27 and 28 and provides for an additional sixth input 70 and loudspeaker output 72. The DSP core plus ancillary hardware is illustrated in FIG. 41. The DSP chip 123 handles all the digital signal processing necessary to perform the PRIR measurements, the headphone equalization, head tracker decoding, real time virtualization and all other associated processes. FIG. 41 shows the various digital i/o signals as separate paths for the sake of clarity. The actual hardware uses a programmable logic multiplexer that enables the DSP to read and write the external decoder 114, ADC 99, DACs 92 & 72, SPDIF transmitter 112, SPDIF receiver 111 and the head tracker UART 73 under interrupt or DMA control. Moreover the DSP accesses the RAM 125, Boot ROM 126 and micro-controller 127 through a multiplexed external bus and this too can operate under DMA control if desired.

Figure 28:
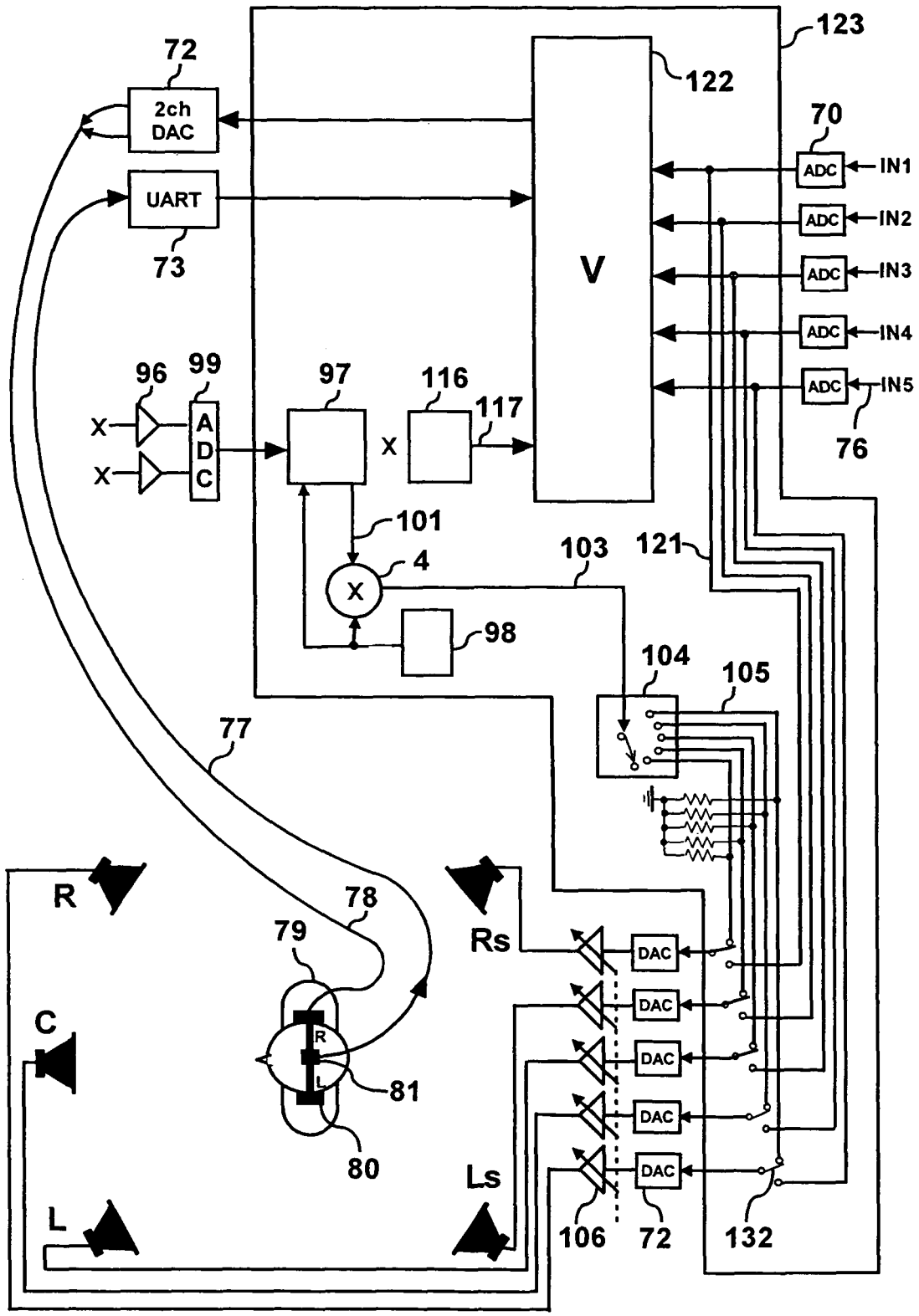
FIG. 28 is a plan view of human subject as in FIG. 26 listening to virtualized signals over head tracked headphones.

DSP block 123 is common to FIGS. 26, 27 and 28 and these illustrations provide a summary of the main signal processing blocks that are implemented as DSP routines within the chip itself. The DSP can be configured to operate in two PRIR measurement modes.

Mode A) is designed for applications where direct access to the loudspeakers is not practical, as illustrated in FIG. 27. In this mode the input audio signals 121 (FIG. 41) may be derived from a local multi-channel decoder 114 whose bit stream is input via the SPDIF receiver 111, or they can be input directly from a local multi-channel ADC 70. The personalization measurement MLS signals are encoded using an industry standard multi-channel coder and output via the SPDIF transmitter 112. The MLS bit stream is subsequently decoded using a standard AV receiver 109 (FIG. 27) and directed to the desired loudspeaker.

Mode B) is designed for applications where direct access to the loudspeaker signals is possible, as illustrated in FIG. 26. As with mode A the input audio signals 121 (FIG. 41) may be derived from a local multi-channel decoder 114 whose bit stream is input via the SPDIF receiver 111, or they can be input directly from a local multi-channel ADC 70. The personalization measurement MLS signals, however, are output directly to a multi-channel DAC 72.

Figure 42:
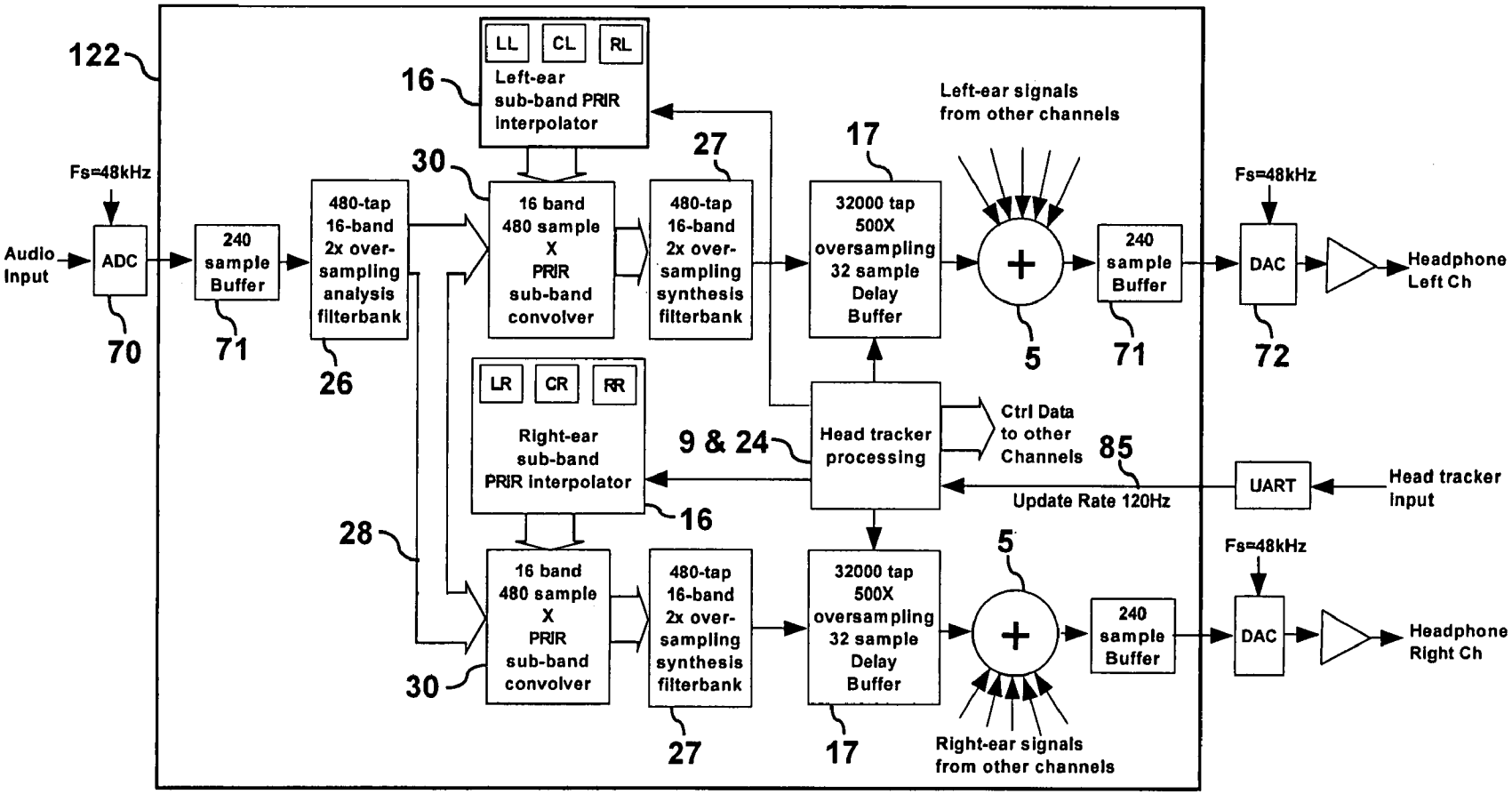
FIG. 42 is a block diagram of real-time DSP virtualization routine.
Figure 43:
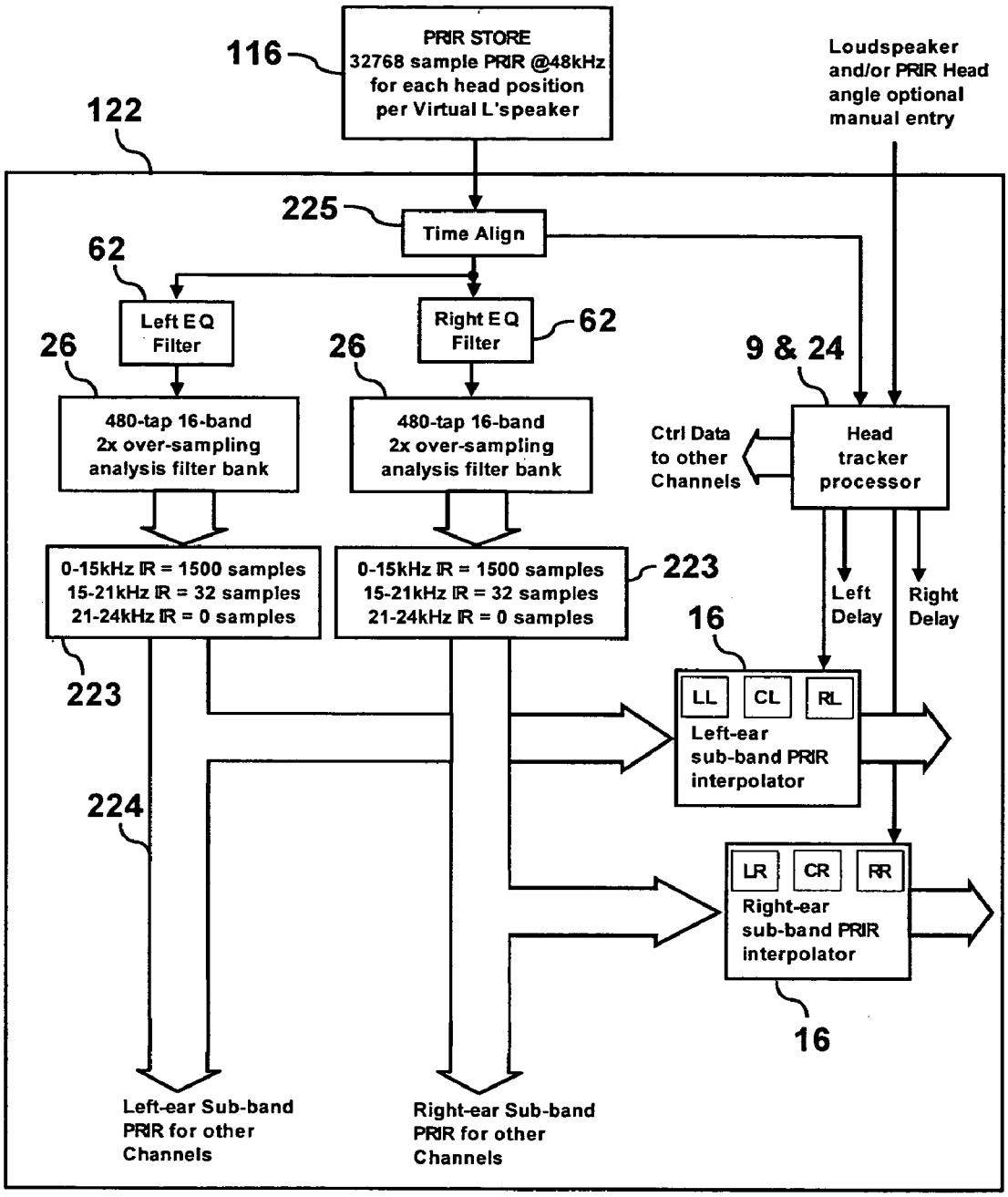
FIG. 43 is a block diagram of DSP routines that process the PRIR data prior to running the virtualizer routine.

FIG. 43 describes the steps and specifications for the personalization routines in accordance with an embodiment of the invention. FIG. 42 similarly describes those for the virtualization routines. The DSP routines are separated by function and are typically run in the following order after power up for a user that does not have any previously acquired personalized data available.

1) Acquire PRIRs for each loudspeaker and for each head position
2) Acquire headphone-microphone transfer function for both ears and generate equalization filter
3) Generate interpolation and inter-aural time delay functions and time align PRIR
4) Pre-emphasize time aligned PRIR using headphone equalization filter
5) Generate sub-band PRIRs
6) Establish the head reference angles
7) Calculate any virtual loudspeaker offsets
8) Run virtualizer Real Time Loudspeaker MLS Measurements Using the DSP The personalized room impulse response measurement routine used a 15-bit binary MLS comprising 32767 states capable of measuring impulse responses up to 32767 samples. At an audio sampling rate of 48 kHz this MLS can measure impulse responses within environmental reverberation times of approximately 0.68 seconds without significant circular convolution aliasing. Higher MLS orders could be used where the reverberation time of the room may exceed 0.68 seconds. The three point PRIR measurement method illustrated in FIG. 29 was implemented in the real-time DSP platform. Consequently head pitch and roll were not taken into account when acquiring the PRIRs. Head movements during the MLS measurement process were also ignored and so it was assumed that the human subject's head was held reasonably still for the duration of the tests.

To facilitate mode A operation the 32767 sequence was resampled to 32768 samples and a continuous stream of back-to-back blocks encoded using a 5.1 ch DTS coherent acoustics encoder running at 1536 kbps and with the perfect reconstruction mode enabled. The MLS-encoder frame alignment was adjusted in order to ensure that the original MLS window corresponded exactly to that of 64 decoded frames of 512 samples such that the DTS bit stream could be played in a loop without causing inter-frame discontinuities at the output of the decoder. Once alignment was achieved the 64 frames were extracted from the final DTS bit stream, comprising 1048576 bits, or 32768 stereo SPDIF 16-bit payload words. Bit streams were created for each of the six channels, (where the other input signals to the encoded are muted) including the sub-woofer. Ten bit streams were created per active channel covering a range of MLS amplitudes beginning −27 dB and rising to 0 dB in 3 dB steps. All 60 encoded MLS sequences were encoded off-line and the bit streams pre-stored in compact flash 130 (FIG. 41) and were uploaded to system RAM 125 every time the system was initialization with mode A enabled.

During the personalization process all non-essential routines are suspended and the incoming left and right ear microphone samples are processed directly by the circular convolution routines on a sample-per-sample basis. The personalization measurements begins by first determining the amplitude of the MLS necessary to cause the microphones recordings to exceed a −9 dB threshold. This would be tested for each loudspeaker separately and the MLS with the lowest amplitude would be used for all the subsequent PRIR measurements. The appropriate bit stream is then streamed out to the SPDIF transmitter in a loop and the digitized microphone signals 99 are circularly convolved with the original resampled MLS. This process continues for 32 MLS frame periods—approximately 22 seconds @48 kHz sampling rate. For a full 5.1 ch loudspeaker setup the test is typically conducted using the following procedure;

The human subject looks towards screen center and holds their head steady and:

1. the left loudspeaker MLS bit stream is looped and the left and right-ear PRIRs measured,
2. the right loudspeaker MLS bit stream is looped and the left and right-ear PRIRs measured,
3. the center loudspeaker MLS bit stream is looped and the left and right-ear PRIRs measured,
4. the left surround loudspeaker MLS bit stream is looped and the left and right-ear PRIRs measured,
5. the right surround loudspeaker MLS bit stream is looped and the left and right-ear PRIRs measured, and
6. the sub-woofer MLS bit stream is looped and the left and right-ear PRIRs measured.

The human subject looks towards the left loudspeaker and holds their head steady and:

1. the left loudspeaker MLS bit stream is looped and the left and right-ear PRIRs measured,
2. the right loudspeaker MLS bit stream is looped and the left and right-ear PRIRs measured,
3. the center loudspeaker MLS bit stream is looped and the left and right-ear PRIRs measured,
4. the left surround loudspeaker MLS bit stream is looped and the left and right-ear PRIRs measured, 5. the right surround loudspeaker MLS bit stream is looped and the left and right-ear PRIRs measured, and
6. the sub-woofer MLS bit stream is looped and the left and right-ear PRIRs measured.

The human subject looks towards the right loudspeaker and holds their head steady and:

1. the left loudspeaker MLS bit stream is looped and the left and right-ear PRIRs measured,
2. the right loudspeaker MLS bit stream is looped and the left and right-ear PRIRs measured,
3. the center loudspeaker MLS bit stream is looped and the left and right-ear PRIRs measured,
4. the left surround loudspeaker MLS bit stream is looped and the left and right-ear PRIRs measured,
5. the right surround loudspeaker MLS bit stream is looped and the left and right-ear PRIRs measured, and
6. the sub-woofer MLS bit stream is looped and the left and right-ear PRIRs measured.

For mode B operation 32 scaled 32767 sample MLSs were output directly to the loudspeaker under test 72 (FIG. 41). As with mode B the amplitude of the MLS is first scaled prior to commencement of the test. The MLS itself is pre-stored as a 32767 bit sequence in the compact flash 130 (FIG. 41) and uploaded to the DSP on power-up. MLS measurements are made for each loudspeaker under test and for every desired personalized head orientation.

The human subject looks towards screen center and holds their head steady and:

1. the MLS is driven out the left loudspeaker and the left and right-ear PRIRs measured,
2. the MLS is driven out the right loudspeaker and the left and right-ear PRIRs measured,
3. the MLS is driven out the center loudspeaker and the left and right-ear PRIRs measured,
4. the MLS is driven out the left surround loudspeaker and the left and right-ear PRIRs measured,
5. the MLS is driven out the right surround loudspeaker and the left and right-ear PRIRs measured, and
6. the MLS is driven out the sub-woofer and the left and right-ear PRIRs measured.

The human subject looks towards the left loudspeaker and holds their head steady and:

1. the MLS is driven out the left loudspeaker and the left and right-ear PRIRs measured,
2. the MLS is driven out the right loudspeaker and the left and right-ear PRIRs measured,
3. the MLS is driven out the center loudspeaker and the left and right-ear PRIRs measured,
4. the MLS is driven out the left surround loudspeaker and the left and right-ear PRIRs measured,
5. the MLS is driven out the right surround loudspeaker and the left and right-ear PRIRs measured, and
6. the MLS is driven out the sub-woofer and the left and right-ear PRIRs measured.

The human subject looks towards the right loudspeaker and holds their head steady and:

1. the MLS is driven out the left loudspeaker and the left and right-ear PRIRs measured,
2. the MLS is driven out the right loudspeaker and the left and right-ear PRIRs measured,
3. the MLS is driven out the center loudspeaker and the left and right-ear PRIRs measured,
4. the MLS is driven out the left surround loudspeaker and the left and right-ear PRIRs measured,
5. the MLS is driven out the right surround loudspeaker and the left and right-ear PRIRs measured, and
6. the MLS is driven out the sub-woofer and the left and right-ear PRIRs measured.

For either A or B modes the 5.1 ch personalization measurements result in 18 left-right PRIR pairs of 32768 samples each and these are both held in temporary memory 116 (FIGS. 26 and 27) for further processing and are stored back to compact flash. These measurement data can therefore be retrieved by the user at any point in the future without having to repeat the PRIR measurements.

Real Time Headphones MLS Measurements Using the DSP

For both modes A and B the headphone equalization measurement is performed using the straight MLS (mode B). The MLS headphone measurement routine is identical to the loudspeaker test except that the scaled MLS is output to the headphones via the headphone DAC rather than the loudspeaker DACs. The responses for each side of the headphone is generated separately using 32 averaged deconvolved MLS frames according to the following:

1. the MLS is driven out the left-ear headphone transducer and the left-ear PRIRs measured, and
2. the MLS is driven out the right-ear headphone transducer and the right-ear PRIRs measured.

The left and right-ear impulse responses are time aligned to the nearest sample and truncated such that only the first 128 samples from the impulse onset remain. Each 128 sample impulse is then inverted using the method described herein. During the inverse calculation frequencies above 16125 Hz are set to unity gain and pole and zeros are clipped to +/−12 dB with respect to the average level between 0 and 750 Hz. The resulting left-ch and right-ch 128 tap symmetrical impulse responses are stored back to the compact flash 130 (FIG. 41).

Preparation of PRIR Data

The preparation of the PRIR data for use in the real-time virtualization routines is illustrated in FIG. 43. On completion of the PRIR measurements the raw left and right-ear PRIR for each loudspeaker and for each of the three lateral head orientations are held in memory 116. First the inter-aural time displacements for all eighteen left and right-ear PRIR pairs are measured 225 to the nearest sample and the values temporarily stored for use by the head tracker processor 9 and 24. The PRIR pairs are then time aligned 225 to the nearest sample as per the methods described herein. The time aligned PRIRs are each convolved with the headphone equalization filters 62 and split into sixteen sub-bands 26 using a 2× over-sampling analysis filter bank whose prototype low-pass filter roll-off had been extended slightly to ensure that unity gain was maintain up to the overlap point, as discussed herein.

The action of splitting each PRIR into sub-bands results in 16 sub-band PRIR files each of 4096 samples. The sub-band PRIR files are truncated 223 in order to optimize the computational load of the following convolution processes. For all the audio channels other than the sub-woofer, sub-bands 1 through to 10 of each PRIR are trimmed to include only the first 1500 samples (giving a reverberation time of approximately 0.25 s), sub-bands 11 through to 14 are trimmed to include only the first 32 samples and sub-bands 15 and 16 are deleted altogether and therefore frequencies above 21 kHz are absent from the headphone audio. For the sub-woofer channel sub-band 1 is trimmed to include only the first 1500 samples and all other sub-bands are deleted and are not included in the sub-woofer convolution calculations. Once trimmed, the sub-band PRIR data is then loaded 224 to their respective sub-band PRIR interpolation processor 16 memory for use by the real-time virtualizing processes of FIG. 42.

The PRIR interpolation formula (equations 8-14) were used in this DSP implementation. This required that the three PRIR measurement head angles θL, θC, and θR, corresponding to viewing head angles 176, 177 and 178 (FIG. 29), respectively, be known. The implementation assumed that the front center loudspeaker 181 was exactly aligned with the reference head angle θ ref. This permitted θL, θC, and θR to be calculated by analyzing the inter-aural times delays between the left and right-ear PRIR pairs for each of the three head positions with the center loudspeaker as the MLS excitation source using equation 1. In this case the maximum absolute delay was fixed at 24 samples.

The inter-aural path length formula for each virtual loudspeaker are estimated using equations 23-25 and in combination with any virtual offset adjustment each differential path length is calculated using equation 31. The sine function is constructed in software using a 32 point single quadrant look up table combined with 4-bit linear interpolation providing an angular resolution of 0.25 degrees. The path length calculation continues even when the listeners head moves out of the scope of the PRIR measurements angles.

As an option, the PRIR interpolation and the path length formula generation routines were able to access information relating to the PRIR head angles and the loudspeaker locations manually entered into the virtualizer via the keyboard 129 (FIG. 41).

Dynamic Head Tracked Calculations

The head tracker implementation was based on a headphone mounted 3-axis magnetic sensor design utilizing a 2-axis tilt accelerometer to de-rotate the magnetic readings in the presence of listener head tilt. To avoid interference, electrostatic headphones were used to reproduce the virtualized signals. The magnetic and tilt measurements and heading calculations were conducted by an onboard microcontroller at a update rate of 120 Hz. The listeners head yaw, pitch and roll angles were streamed to the virtualizer using a simple asynchronous serial format transmitted at a baud rate 9600 bit/s. The bit stream comprised synchronization data, optional commands, and the three head orientations. The head angles were encoded using a +/−180 degree format using a Q2 binary format and therefore provided a basic resolution of 0.25 degrees in any axis. As a result two bytes were transmitted to encapsulate each head angle. The head tracker serial stream was connected to the out board UART 73 (FIG. 41) and each byte decoded and passed on to the DSP 123 via an interrupt service routine. The head tracker update rate is free running (approximately 120 Hz) and is not synchronized to that of the audio sampling rate of the virtualizer. On each head tracker interrupt the DSP reads the UART bus and checks for the presence of synchronizing bytes. Bytes that follow a recognized synchronization pattern are used to update the head orientation angles retained in the DSP and optionally flag head tracker commands.

One of the head tracker command functions is to ask the DSP to sample the current head yaw angle and copy this to the reference head orientation θ ref stored internally. This command is triggered by a micro-switch mounted on the head tracker unit itself mounted on the headphones head band. In this implementation the reference angle is established by asking the listener to place the headphones on their head and then to look towards the center loudspeaker and to press the reference angle micro-switch. The DSP then uses this head yaw angle as the reference. Changes in the reference angle can be made at any time by simply pressing the switch.

The sub-band interpolation coefficient and variable delay path length updates are calculated at the virtualizer frame rate of 200 Hz (240 input samples @Fs=48 kHz). A unique set of interpolation coefficients are independently calculated for each of the audio channels to allow for virtual offset adjustments to be made ($\theta v_X$) on a loudspeaker-by-loudspeaker basis. The resulting sub-band interpolation coefficients are used directly to generate an interpolated set of sub-band PRIRs for each audio channel 16 (FIG. 16).

However, the path length updates are not used directly to drive the over-sampled buffer addresses 20 (FIG. 18) but are used instead to update a set of 'desired path length' variables. The actual path lengths are updated every 24 input samples and are incrementally adjusted using a delta function such that they adapt in the direction of the desired path length values. This means that all the virtual loudspeaker path lengths are effectively adjusted at a rate of 2 kHz in response to changes in the head tracker yaw angle. The purpose of using the delta update is to ensure that the variable buffer path lengths do not change in large steps and thus avoids the possibility of introducing audible artifacts into the audio signals as a result of sudden changes in the listeners head angle.

For head yaw angles outside the scope of the personalization range the interpolation coefficient calculation saturates at their most extreme left or right position. Ordinarily head tracker pitch and roll angles are ignored by the virtualizer since these were not included in the PRIR measurement scope. However when the pitch angle exceeds approximately +/−65 degrees (+/−90 degrees being horizontal) the virtualizer will switch in the loudspeaker signals, where available, 132 (FIG. 28). This provides a convenient way for the listener to remove the headphones and to lay them flat and continue to listen to the audio via the loudspeakers.

Real Time 5.1 ch DSP Virtualizer

FIG. 42 illustrates a set of routines implemented to virtualize a single input audio channel, in accordance with an embodiment of the invention. All the functions are duplicated for the remainder of the channels and their left and right-ear headphone signals summed to form a composite stereo headphone output. The analogue audio input signal is digitized 70 in real time at a sample rate of 48 kHz and loaded, using an interrupt service routine, to a 240 sample buffer 71. On filling this buffer the DSP invokes a DMA routine that both copies the input samples to an internal temporary buffer and reloads the left and right channel output buffers 71 with newly virtualized audio from a pair of temporary output buffers. This DMA occurs every 240 input samples and so the virtualizer frame rate runs at 200 Hz.

The 240 newly acquired input samples are split into 16 sub-bands 26 using a 2× over-sampled 480-tap analysis filter bank. The prototype low-pass filter for this and the synthesis filter bank is designed in the normal way i.e., the overlap point is approximately 3 dB down on the pass band. The 30 samples in each sub-band are then convolved, using left-ear and right-ear sub-band convolvers 30, with the relevant sub-band PRIR samples 16 generated by the interpolation routines and using the most up-to-date interpolation coefficients. The convolved left and right-ear samples are each reconstructed back into 240 sample waveforms using a complementary 16-band sub-band 480 tap synthesis filter bank 27. The 240 reconstructed left and right-ear samples then pass through variable delay buffers 17 to effect the inter-aural time delays appropriate to the virtual loudspeaker. The variable buffer implementation uses a 500× over sampling architecture and deploys a 32000 tap anti-aliasing filter.

As a result, each buffer is separately able to delay the input sample stream up to 32 samples in steps down to 1/500th of a sample. As described earlier, the delays are updated every 24 input sample periods, or every 0.5 ms and so the variable delays are updated 10 times in each 240 input sample period. The 240 samples output from the left-ear and right-ear variable delay buffers of each channel virtualizer are summed 5 and loaded to temporary output sample buffers in preparation for their transfer to the output buffers 71 on the next DMA input/output routine. The left and right-ear output samples are transferred in real time to the DACs 72 at a rate of 48 kHz using an interrupt service routine. The resulting analogue signals are buffered and output to the headphone worn by the listener.

Variations and Alternate Embodiments

While several illustrative embodiments of the invention have been shown and described throughout the detailed description of the invention, numerous variations and alternate embodiments will occur to those skilled in the art. Such variation and alternate embodiments are contemplated and can be made without departing from the spirit and scope of the invention.

For example, the description has made reference to a personalization measurement process that establishes the scope of the listeners head movements during playback. Theoretically two or more measurement points are required in order to facilitate the interpolation. Indeed many of the examples have illustrated the use of three and five point PRIR measurement scopes. Measuring each of the loudspeakers responses in this way has the advantage that the PRIR interpolation that de-rotates head movements always has, at its disposal, PRIR data specific to the real loudspeaker that is being used to project the virtual loudspeaker, provided the head movements are within the measurement scope. In other words, virtual loudspeakers will ordinarily match, almost exactly, the experience of the real loudspeaker since they use PRIR data specific to that loudspeaker. One departure from this method is to measure only one set of PRIRs for each loudspeaker, i.e., the human subject simply takes up one fixed head position and acquires a left and right-ear PRIR for each of the loudspeakers that make up their entertainment system.

Normally, the human subject would look towards the screen center, or some other ideal listening orientation prior to making the measurements. In this situation any head movement detected by the head tracker that deviates from this reference head orientation is de-rotated using interpolated PRIR data sets that are not related to the loudspeaker that is being virtualized The inter-aural path length calculations, however, may remain accurate since they can be derived from the various loudspeaker PRIR data or input to the virtualizer itself manually in the normal way. The process of interpolating between adjacent loudspeaker PRIRs has already been discussed to some degree in one of the methods used extend the range of the virtualizer beyond the measured scope (see section entitled 'Head movements that fall outside the measured scope').

FIG. 34*b* illustrates the interpolation requirements for the left front loudspeaker for head rotations beyond the +/−30 degree measurement scope. In this example it was assumed that each loudspeaker was represented for a full 60 degrees of head turn and that only where insufficient coverage existed, were adjacent loudspeaker PRIRs interpolated to fill the gap, 203, 207, 205 (FIG. 34*b*) respectively. In the method whereby only one set of PRIRs are measured, each zone between the loudspeakers deploys adjacent loudspeaker interpolation.

The following description illustrates the process using the same loudspeaker set up shown in FIG. 34. Again, in this description, the left front loudspeaker is to be virtualized throughout the entire 360 degree head turn range. Starting with the listener viewing the center loudspeaker (0 degrees), all PRIR interpolators use those responses measured directly from the real loudspeakers. As the listener's head turns away anti-clockwise, towards the left loudspeaker position, the PRIR interpolator for the left front virtual loudspeaker begins to output a linear combination of the left and center loudspeaker PRIRs to the convolver in proportional to the listener's head angle between the center and left loudspeaker positions.

By the time the listener's head orientation reaches the left loudspeaker position, −30 degrees, the virtual left loudspeaker convolution is conducted entirely with the center loudspeaker PRIR. As the head continues in the anti-clockwise direction, −30 through to −60 degrees, the interpolator outputs a linear combination of the center and right loudspeaker PRIRs to the convolver. From −60 through to −150 degrees the right and right surround PRIRs are used by the interpolator. From −150 through to +90 degrees the right surround and left surround PRIRs are used. Finally moving anti-clockwise from +90 through to 0 degrees the left surround and left PRIRs are used by the interpolator. This description illustrates the interpolation combinations necessary to stabilize the virtual left front loudspeaker during a 360 degree head turn. The PRIR combinations for other virtual loudspeakers are easily derived by inspecting the geometry of the specific loudspeaker arrangement and the available PRIR data sets.

It will be appreciated that PRIRs measured for only a single head orientation can equally be applied to the pre-virtualization methods discussed within. In these cases the scope of the binaural signals are not limited to that of the PRIR head orientations, and so the user decides the desired range of head movement, generates the appropriate interpolated loudspeaker PRIRs that cover the range, and runs the virtualization for each. The head movement limits are then sent to the playback device in order to set up the interpolator range appropriately. If required, the path length data is also sent in order to generate the inter-aural path lengths as the listener's head moves between the limits of the interpolators.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. An audio system for personalized virtualization of a set of loudspeakers in a pair of headphones, the system comprising:

an audio input interface for receiving a loudspeaker input signal;

a speaker output interface for driving each of a set of loudspeakers with an audio signal;

a headphone output interface for driving a pair of headphones with an audio signal;

a microphone input interface for receiving response signals from one or more microphones positionable near each ear of a listener;

a head tracking system for detecting an orientation of a listener's head;

an excitation signal generator coupled to the speaker output interface, wherein when the audio system is in a personalized measurement mode, the excitation signal generator is configured to provide excitation signals to the speaker output interface for driving one or more of the loudspeakers to generate audio responses at a location near each of a listener's ears;

a measurement module coupled to the microphone input interface to receive signals from the microphone input interface for the audio responses, the measurement module configured to generate personalized response functions for the audio responses for a plurality of head orientations, and associate each personalized response function with a particular loudspeaker, a particular ear, and a particular head orientation of the listener; and a virtualizer coupled to the headphone output interface, wherein when the audio system is in a normal mode, the virtualizer is configured to transform the loudspeaker input signal using a set of response functions that is based on one or more sets of the plurality of personalized response functions, and provide the transformed loudspeaker input signal to the headphone output interface.

2. The system of claim 1 further comprising:

an excitation signal generator coupled to the headphone output interface, wherein when the audio system is in a personalized headphone equalization measurement mode, the excitation signal generator is configured to provide excitation signals to the headphone output interface for driving the headphones to generate audio responses at a location near each of the listeners' ears, responsive to which the measurement module is configured to calculate a response function for equalizing the headphones.

3. The system of claim 1, wherein the speaker output interface comprises a multi-channel encoded bit stream output, and the excitation signals are encoded using a multi-channel audio coding methodology.

4. The system of claim 1, further comprising:

a memory for storing each response function as a set of filter coefficients.

5. The system of claim 1, wherein the loudspeaker input signal comprises a plurality of channels each corresponding to a loudspeaker, and the virtualizer transforms the loudspeaker input signal by determining a set of response functions based on the listener's head orientation, transforming each channel using a left-ear and right-ear response function, and separately summing the left-ear transformed channels and the right-ear transformed channels to obtain a dual channel transformed loudspeaker input signal for the headphone output interface.

6. The system of claim 5, wherein the virtualizer determines the set of response functions by selecting two or more sets of predetermined response functions and interpolating the selected sets of predetermined response functions based on the listener's head orientation and the head orientations associated with the predetermined response functions.

7. The system of claim 6, wherein the virtualizer interpolates two or more sets of predetermined response functions by interpolating each of the response functions associated with a particular loudspeaker and a particular ear and head orientation of the listener.

8. The system of claim 6, wherein the response functions are impulse functions, and the virtualizer interpolates two or more response functions by measuring a time delay for each impulse function, removing the time delays from each impulse function, averaging the resulting impulse functions, and reincorporating the removed delay into the averaged impulse function.

9. The system of claim 8, wherein the impulse functions are averaged by weighting the impulse functions according to the listener's tracked head orientation and the orientations associated with each impulse function.

10. The system of claim 5, wherein the virtualizer determines the set of response functions by selecting a set of predetermined, pre-interpolated response functions stored in a memory, the selected set associated with a head orientation that most closely matches the listener's tracked head orientation.

11. The system of claim 1, wherein the virtualizer is further configured to adjust one or more of the response functions to change the perceived distance of the corresponding loudspeakers.

12. The system of claim 11, wherein a response function is adjusted by identifying a direct portion and a reverberant portion of the response function, and changing the amplitude and position of the direct portion relative to the reverberant portion.

13. The system of claim 1, wherein the virtualizer is further configured to apply an inverse transfer function to compensate for an effect of the headphones on a signal output therefrom.

14. The system of claim 1, wherein the virtualizer is further configured to apply an inverse transfer function and an ideal reference transfer function to the loudspeaker input signal, the inverse transfer function designed to compensate for an effect of the loudspeakers on a signal output therefrom, and the ideal reference transfer function designed to product an effect of a set of loudspeakers having improved fidelity.

15. An audio system for personalized virtualization of a set of loudspeakers in a pair of headphones, the system comprising:

an audio input interface for receiving a loudspeaker input signal;

a headphone output interface for driving a pair of headphones with an audio signal;

a head tracking system for tracking an orientation of a listener's head;

a virtualizer coupled to the headphone output interface, wherein the virtualizer is configured to select two or more sets of predetermined personalized response functions based on the listener's tracked head orientation, each set of predetermined personalized response functions being associated with a different head orientation;

estimate a set of response functions by interpolating the two or more sets of redetermined personalized response functions wherein interpolating comprises weighting response functions in the two or more sets according to the listener's tracked head orientation and the head orientations associated with the response functions;

transform the loudspeaker input signal using the set of estimated response functions, and provide a resulting virtualized audio signal to the headphone output interface.

16. The system of claim 15, wherein the virtualizer transforms the loudspeaker input signal by:

combining the transformed loudspeaker input signal to generate the virtualized audio signal.

17. A method for virtualizing a set of loudspeakers into a pair of headphones for a listener, the method comprising:

receiving an audio signal for the set of loudspeakers;

tracking a head orientation of the listener;

selecting two or more sets of predetermined personalized response functions based on the listener's tracked head orientation, each set of predetermined personalized response functions being associated with a different head orientation;

estimating a set of response functions by interpolating the two or more sets of predetermined personalized response functions, wherein interpolating comprises weighting response functions in the two or more sets according to the listener's tracked head orientation and the head orientations associated with the response functions;

transforming the received audio signal using the set of estimated response functions;

combining the transformed audio signal to generate a virtualized audio signal for the headphones; and providing the virtualized audio signal to the headphones.

18. The method of claim 17, further comprising:

storing each response function as a set of filter coefficients.

19. The method of claim 17, wherein the predetermined personalized response functions are impulse functions, and wherein interpolating two or more sets of predetermined personalized response functions comprises:

measuring a time delay for each impulse function;

removing the time delays from each impulse function;

averaging the resulting impulse functions; and reincorporating the removed delay into the averaged impulse function.

20. The method of claim 17, wherein the received audio signal comprises a channel associated with each of the loudspeakers, and transforming the received audio signal comprises transforming each channel of the received audio signal using estimated response functions associated with left and right ears.

21. The method of claim 20, wherein combining the transformed audio signal comprises separately summing the left-ear transformed channels and the right-ear transformed channels to obtain a dual channel transformed audio signal suitable for the headphones.

22. The method of claim 17, further comprising:

adjusting one or more of the estimated response functions to change the perceived distance of the corresponding loudspeakers.

23. The method of claim 22, wherein the adjusting comprises:

identifying a direct portion and a reverberant portion of the estimated response function; and changing the amplitude and position of the direct portion relative to the reverberant portion.

24. The method of claim 17, further comprising:

applying an inverse transfer function to compensate for an effect of the headphones on a signal output therefrom.

25. The method of claim 17, further comprising:

applying an inverse transfer function to the received audio signal, the inverse transfer function designed to compensate for an effect of the loudspeakers on a signal output therefrom; and applying an ideal reference transfer function to the received audio signal, the ideal reference transfer function designed to product an effect of a set of loudspeakers having improved fidelity.

26. A method for virtualizing a set of loudspeakers into a pair of headphones for a listener, the method comprising:

receiving an audio signal for the set of loudspeakers;

transforming the audio signal into multiple sets of pre-virtualized audio signals using a plurality of predetermined personalized response functions for a plurality of head orientations;

after the audio signal is transformed into multiple sets of pre-virtualized audio signals, tracking a listener's actual head orientation;

generating a set of transformed audio signals by interpolating two or more sets of pre-virtualized audio signals based on the listeners' tracked head orientation;

delaying the generated transformed audio signal based on the listener's tracked head orientation;

combining the delayed generated transformed audio signals to generate a virtualized audio signal for the headphones; and providing the virtualized audio signal to the headphones.

27. A method for virtualizing a set of loudspeakers into a pair of headphones for a listener, the method comprising:

receiving an audio signal for the set of loudspeakers;

transforming the audio signal into multiple sets of pre-virtualized audio signals using a plurality of predetermined personalized response functions for a plurality of head orientations;

combining the pre-virtualized audio signals to generate a virtualized audio signal for the headphones for each of the plurality of head orientations;

after the pre-virtualized audio signals are combined to generate a virtualized audio signal, tracking a listener's actual head orientation;

generating a single headphone signal derived from the combined pre-virtualized audio signals by interpolating two or more virtualized audio signals based on the listener's tracked head orientation; and providing the derived virtualized audio signal to the headphones.

28. The system of claim 15, wherein the predetermined personalized response functions are impulse functions, and wherein interpolating two or more predetermined personalized response functions comprises:

measuring a time delay for each impulse function;

removing the time delays from each impulse function;

averaging the resulting impulse functions; and reincorporating the removed delay into the averaged impulse function.

* * * * *

UNITED STATES PATENT AND TRADEMARK OFFICE

CERTIFICATE OF CORRECTION

PATENT NO. : 7,936,887 B2
APPLICATION NO. : 11/217637
DATED : May 3, 2011
INVENTOR(S) : Stephen Malcolm Smyth It is certified that error appears in the above-identified patent and that said Letters Patent is hereby corrected as shown below:

Claim 15, in column 60 line 45, replace “redetermined” with --predetermined--.

Signed and Sealed this
Eleventh Day of October, 2011

David J. Kappos

David J. Kappos
*Director of the United States Patent and Trademark Office*